US006935076B2

(12) United States Patent
Amir

(10) Patent No.: US 6,935,076 B2
(45) Date of Patent: Aug. 30, 2005

(54) AMIR CONCEPT STRUCTURES

(76) Inventor: Yossi Amir, P.O. Box 265, Yokneam Moshava (IL), 20600

( * ) Notice: Subject to any disclaimer, the term of this patent is extended or adjusted under 35 U.S.C. 154(b) by 0 days.

(21) Appl. No.: 10/269,294

(22) Filed: Oct. 11, 2002

(65) Prior Publication Data

US 2004/0068940 A1 Apr. 15, 2004

(51) Int. Cl.[7] ..... E04B 7/10
(52) U.S. Cl. ..... 52/80.2; 52/80.1; 52/81.1; 52/DIG. 10
(58) Field of Search ..... 52/80.2, 188, 80, 52/63, 81, DIG. 10

(56) References Cited

U.S. PATENT DOCUMENTS

| | | | | |
|---|---|---|---|---|
| 2,986,241 A | | 5/1961 | Buckminster | |
| 3,600,825 A | | 8/1971 | Pearce | |
| 3,925,941 A | | 12/1975 | Pearce | |
| 3,931,697 A | | 1/1976 | Pearce | |
| 4,092,992 A | | 6/1978 | Huddle | |
| 4,133,152 A | * | 1/1979 | Penrose | 52/105 |
| 4,584,800 A | | 4/1986 | Burt et al. | |
| 4,620,998 A | | 11/1986 | Lalvani | |
| 4,651,479 A | | 3/1987 | Kersavage | |
| 4,711,062 A | | 12/1987 | Gwilliam et al. | |
| 4,869,041 A | | 9/1989 | Chu | |
| 4,982,534 A | | 1/1991 | Saitoh et al. | |
| 5,036,635 A | | 8/1991 | Lalvani | |
| 5,155,951 A | | 10/1992 | Lalvani | |
| 5,423,341 A | * | 6/1995 | Brady | 135/139 |
| 5,857,294 A | | 1/1999 | Castro | |
| 5,899,028 A | | 5/1999 | Warner | |
| 6,564,513 B2 | * | 5/2003 | Henbid et al. | 52/86 |

OTHER PUBLICATIONS

J. Francois Gabriel, "Space Frames: An Alternative to the Architectural Cube", International Journal of Space Structures, vol. 6, No. 4, 1991.
Vachman, A. et al., Infinite Polyhedra, 1974.
Pearce, Structures in Nature is a strategy for Design, 1978.
Michael Burt, "Spatial Arrangement and Polyhedra with Surfaces and their Architectural Applications", Haifa, Nov. 1996.
Korren, A., Periodic 2 Manifolds Surfaces which Divide the Space into Two Identical Subspaces, 1993.
Burt, M. The Periodic Table of the Polyhedral Universe, 1996.
Gabriel, J.F., Beyond the Cube, 1997.

* cited by examiner

*Primary Examiner*—Carl D. Friedman
*Assistant Examiner*—Nahid Amiri
(74) *Attorney, Agent, or Firm*—Darby & Darby

(57) ABSTRACT

A building structure formed of at least one saddle element defining a plurality of edges and rigid structural elements extending along the edges of each of the at least one saddle element, the rigid structural elements being characterized in that they lie along diagonals of sides of a rectangular parallelepiped forming part of a modular array of rectangular parallelepiped geometrical structures underlying the at least one saddle element and may include octet-like beams or octet-like trusses Multiple saddle elements, either of a similar type or of varying types, may be combined into a wide variety of possible structures Saddle elements can be a tensioned membrane element or any other suitable material.

21 Claims, 60 Drawing Sheets

AMIR CONCEPT STRUCTURES

FIELD OF THE INVENTION

The present invention relates to building structures and methodologies generally and more particularly to building structures and methodologies incorporating a plurality of saddle elements

BACKGROUND OF THE INVENTION

A great variety of building structures are known in the prior art patent literature The following U.S. Patents and texts are believed to be representative of the current state of the art U.S. Pat. Nos. 2,986,241, 3,600,825, 3,925,941; 3,931,697, 4,092,992; 4,584,800; 4,620,998, 4,651,479; 4,869,041; 5,036,635, 5,155,951 and 5,899,028

Vachman, A et al, Infinite Polyhedra, 1974;

Pearce, Structures in Nature is a Strategy for Design, 1978;

Korren, A, Periodic 2 Manifolds Surfaces which divide the Space into two identical Subspaces, 1993

Burt, M, The Periodic Table of the Polihedral Universe, 1996,

Gabriel, J F, Beyond the Cube, 1997

SUMMARY OF THE INVENTION

The present invention seeks to provide improved building structures and methodologies employing saddle elements One example, but not the only example, of a saddle element is a hypar Another example of a saddle element is commonly termed a "minimal surface" The saddle element is preferably formed of a flexible material, but alternatively may be rigid or semi-rigid. The saddle element may be formed of any suitable material or combination of materials and may be constructed in any suitable manner The present invention provides building structures formed of at least one saddle element defining a plurality of edges and rigid structural elements extending along the edges of each of the at least one saddle element, the rigid structural elements being, characterized in that they lie along diagonals of sides of a rectangular parallelepiped forming part of a modular array of rectangular parallelepiped geometrical structures underlying the at least one saddle element and comprise octet-like trusses.

The present invention also provides a building structure formed of a plurality of saddle elements and rigid structural elements extending along the edges of each of the plurality of saddle elements, the rigid structural elements being characterized in that they lie along diagonals of sides of a rectangular parallelepiped forming part of a modular array of rectangular parallelepiped geometrical structures underlying the plurality of saddle elements Preferably, the rigid structural elements are further characterized in that they lie along diagonals which form part of an octet structure In accordance with a preferred embodiment of the present invention, the at least one saddle element includes at least two saddle elements of different types Preferably, the rigid structural elements comprise octet trusses An octet geometry is described in U.S. Pat. No. 2,986,241 of Buckminster Fuller and is here defined with reference to a cubic grid as follows:

Take eight adjacent imaginary cubes which all have a single common corner Twelve diagonals extend outwardly from the single common corner, each such diagonal extending along a common wall of a pair of adjacent cubes from the single common corner to each common corner at the junction of the pair of adjacent cubes. The angle between each of the twelve diagonals and an adjacent diagonal lying along the same plane of a surface of a cube is 90 degrees, while the angle between each of the twelve diagonals and an adjacent diagonal lying in a plane of a surface of a cube perpendicular thereto is 60 degrees.

An octet geometry is based on diagonals having the geometrical relationship described above and may have multiple single common corners.

An octet geometry includes octahedrons and tetrahedrons, wherein each surface of each octahedron is coextensive with a surface of a tetrahedron and each surface of each tetrahedron is coextensive with a surface of an octahedron Each diagonal is common to two octahedrons and to two tetrahedrons.

An octet structure is a structure constructed in accordance with an octet geometry An octet-like structure is a generalization of an octet structure to a wherein the cubes referred to hereinabove are replaced by any rectangular parallelepiped forming part of a modular array of rectangular parallelepiped geometrical structures Thus, an octet-like truss is a truss formed of diagonals which define an octet-like structure

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
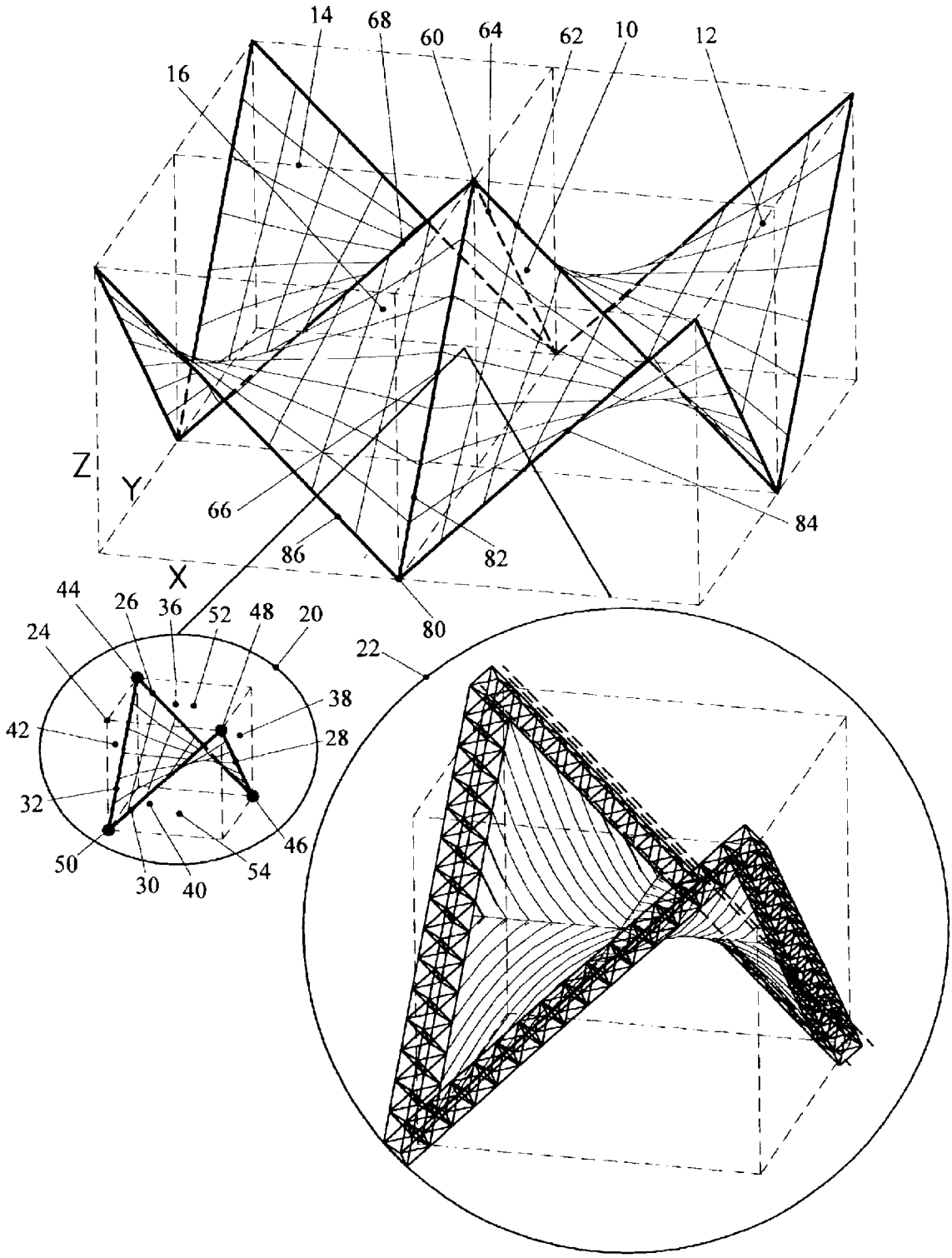
FIG. 1 is a simplified illustration of a building structure, constructed and operative in accordance with a preferred embodiment of the present invention.

Reference is now made to FIG. 1, which is a simplified illustration of a building structure, constructed and operative in accordance with a preferred embodiment of the present invention, including four type A saddle elements, as well as rigid structural elements fixed to the edges thereof and lying along diagonals of sides of cubes The rigid structural elements define part of an octet structure The saddle elements are preferably formed of a flexible material, such as a tensioned membrane, but alternatively may be rigid or semi-rigid The saddle elements may be formed of any suitable material or combination of materials and may be constructed in any suitable manner.

As seen in FIG. 1, the building structure comprises type A saddle elements 10, 12, 14 and 16 in two different orientations A single type A saddle element surrounded by rigid structural elements in the form of beams arranged to define part of an octet structure is shown in window 20 and a single type A saddle element surrounded by rigid structural elements in the form of trusses arranged to define part of an octet structure is shown in window 22 The use of trusses, particularly octet trusses, enables significantly increased dimensions to be spanned, as illustrated symbolically by the size difference between the saddle elements shown in windows 20 and 22

The type A saddle elements in this embodiment are characterized in that they define four 60 degree junctions It is appreciated that type A saddle elements are each circumscribed by a single cube, whose side dimensions X, Y & Z are all equal. FIG. 1 illustrates a type A saddle element which is circumscribed by a rectangular parallelepiped, designated by reference numeral 24, whose side dimensions X, Y & Z are all equal, thus defining a cube.

Figure 2A:
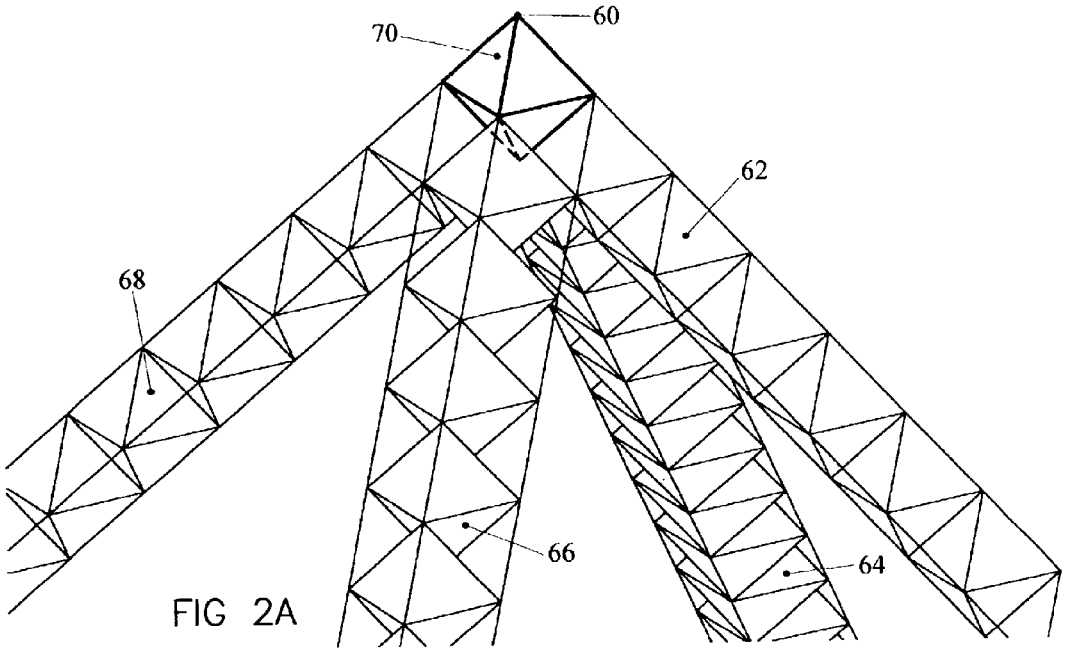
FIGS. 2A & 2B are simplified illustrations of two junctions of rigid structural elements in the embodiment of FIG. 1.
Figure 2B:
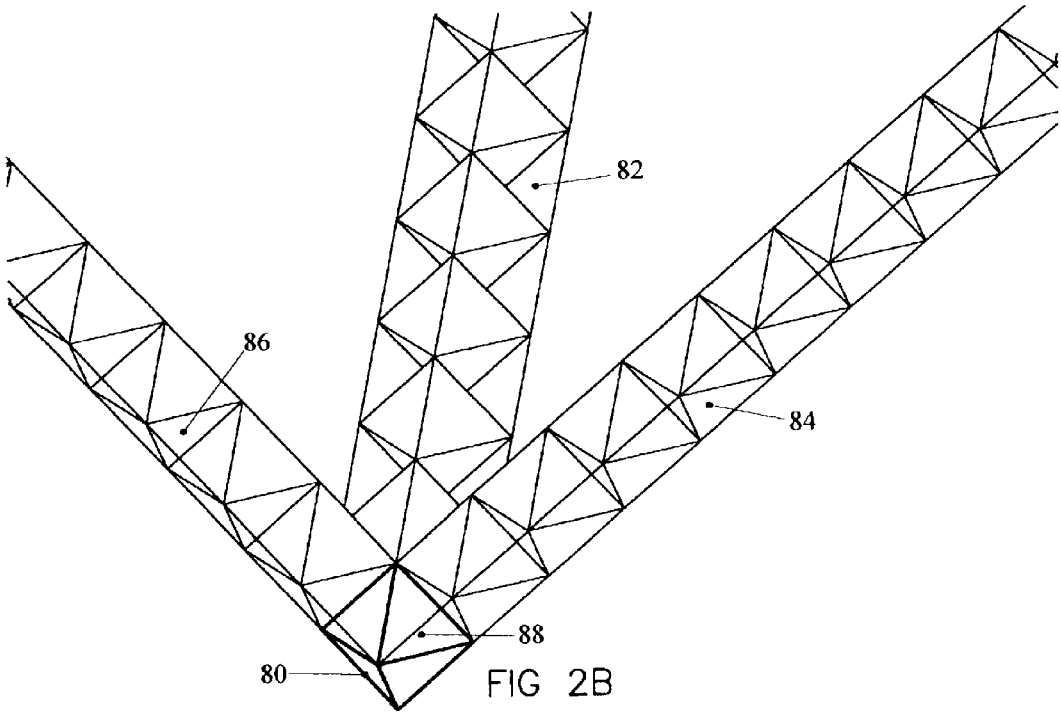
Figure 3:
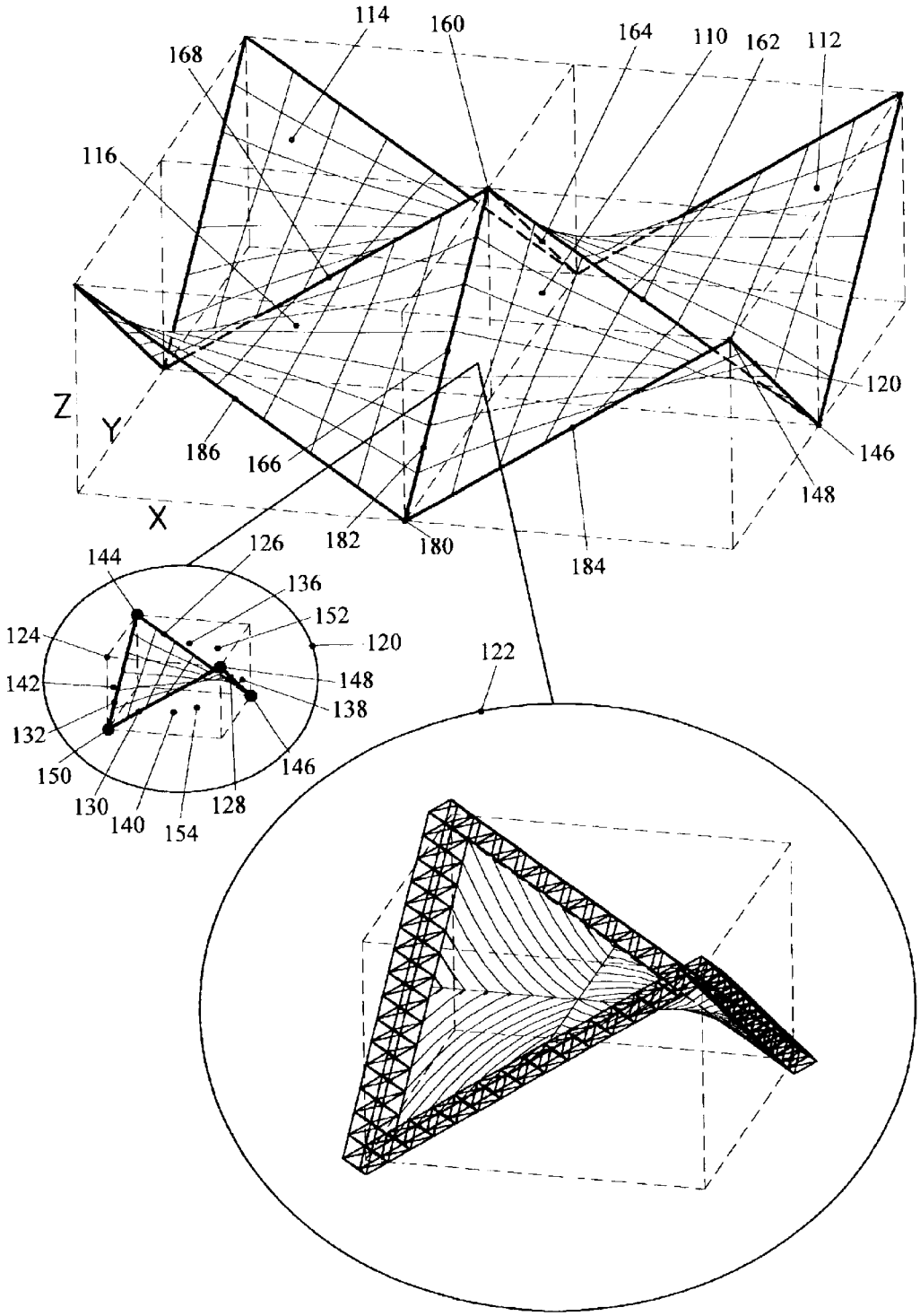
FIG. 3 is a simplified illustration of a building structure, constructed and operative in accordance with another preferred embodiment of the present invention.

Type A saddle elements are characterized in that they have four edges, designated in FIG. 1 by reference numerals 26, 28, 30 and 32, each defined by a diagonal extending, along a side surface of the rectangular parallelepiped The side surfaces whose diagonals define edges 26, 28, 30 and 32 are respectively designated by reference numerals 36, 38, 40 and 42 Four junctions, designated by reference numerals 44, 46, 48 and 50, are defined by the four edges, each junction being located at the meeting of the ends of two adjacent edges Two parallel side surfaces of the cube, here designated by reference numerals 52 and 54, do not have edges defined along the diagonals thereof The rigid structural elements may be any suitable rigid structural elements, such as beams, as shown in window 20 According to a preferred embodiment of the present invention, rigid structural elements are constructed as trusses, most preferably as octet trusses, linear combinations of octahedrons and tetrahedrons, as shown in window 22 Rigid structural elements of this type are known, for example in U.S. Pat. No. 4,869,041, for other applications Reference is now made to FIGS. 2A & 2B, which are simplified illustrations of two junctions of rigid structural elements in the embodiment of FIG. 1. FIG. 2A shows the junction 60 of four rigid structural elements, designated here and in FIG. 1 by reference numerals 62, 64, 66 and 68. It is seen that the junction of rigid structural elements 62, 64, 66 and 68 defines an octahedron 70, which is common to all four elements FIG. 2B shows the junction 80 of three rigid structural elements, designated here and in FIG. 1 by reference numerals 82, 84 and 86 It is seen that the junction of rigid structural elements 82, 84 and 86 is also an octahedron 88, which is common to all three elements Reference is now made to FIG. 3, which is a simplified illustration of a building structure, constructed and operative in accordance with another preferred embodiment of the present invention including four type A saddle elements as well as rigid structural elements fixed to the edges thereof and lying along diagonals of sides of non-cubic rectangular parallelepipeds. The rigid structural elements define part of an octet-like structure As seen in FIG. 3, the building structure comprises type A saddle elements 110, 112, 114 and 116 in two different orientations. A single type A saddle element surrounded by rigid structural elements in the form of beams is shown in window 120 and a single type A saddle element surrounded by rigid structural elements in the form of trusses is shown in window 122 The use of trusses, particularly octet-like trusses, enables significantly increased dimensions to be spanned, as illustrated symbolically by the size difference between the saddle elements shown in windows 120 and 122

The type A saddle elements in this embodiment are characterized in that they define four junctions which are not necessarily identical It is appreciated that type A saddle elements are each circumscribed by a single rectangular parallelepiped, whose side dimensions X, Y & Z may be, but need not be, equal FIG. 3 illustrates a type A saddle element which is circumscribed by a rectangular parallelepiped, designated by reference numeral 124, whose side dimensions X, Y & Z are not all equal Type A saddle elements are characterized in that they have four edges, designated in FIG. 3 by reference numerals 126, 128, 130 and 132, each defined by a diagonal extending, along a side surface of the rectangular parallelepiped. The side surfaces whose diagonals define edges 126, 128, 130 and 132 are respectively designated by reference numerals 136, 138, 140 and 142 Four junctions, designated by reference numerals 144, 146, 148 and 150, are defined by the four edges, each junction being located at the meeting of the ends of two adjacent edges Two parallel side surfaces of the rectangular parallelepiped, here designated by reference numerals 152 and 154, do not have edges defined along the diagonals thereof The rigid structural elements may be any suitable rigid structural elements, such as beams, as shown in window 120 According to a preferred embodiments of the present invention, rigid structural elements are constructed as trusses, most preferably as octet-like trusses linear combinations of octahedron-like structures and tetrahedron-like structures, as shown in window 122

Figure 4A:
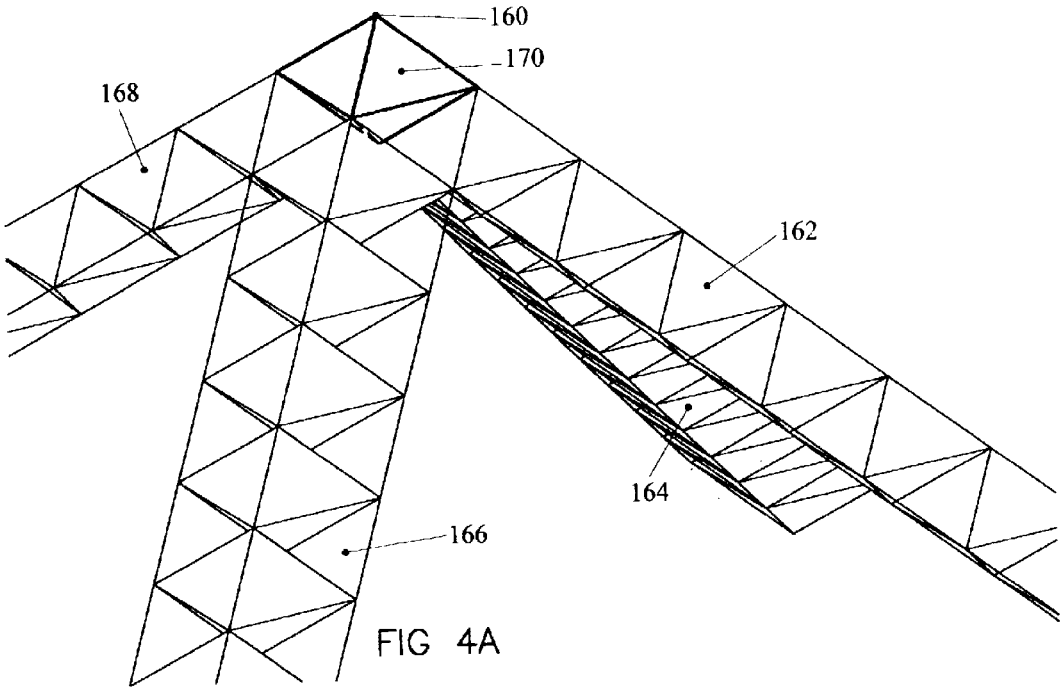
FIGS. 4A & 4B are simplified illustrations of two junctions of rigid structural elements in the embodiment of FIG. 3.
Figure 4B:
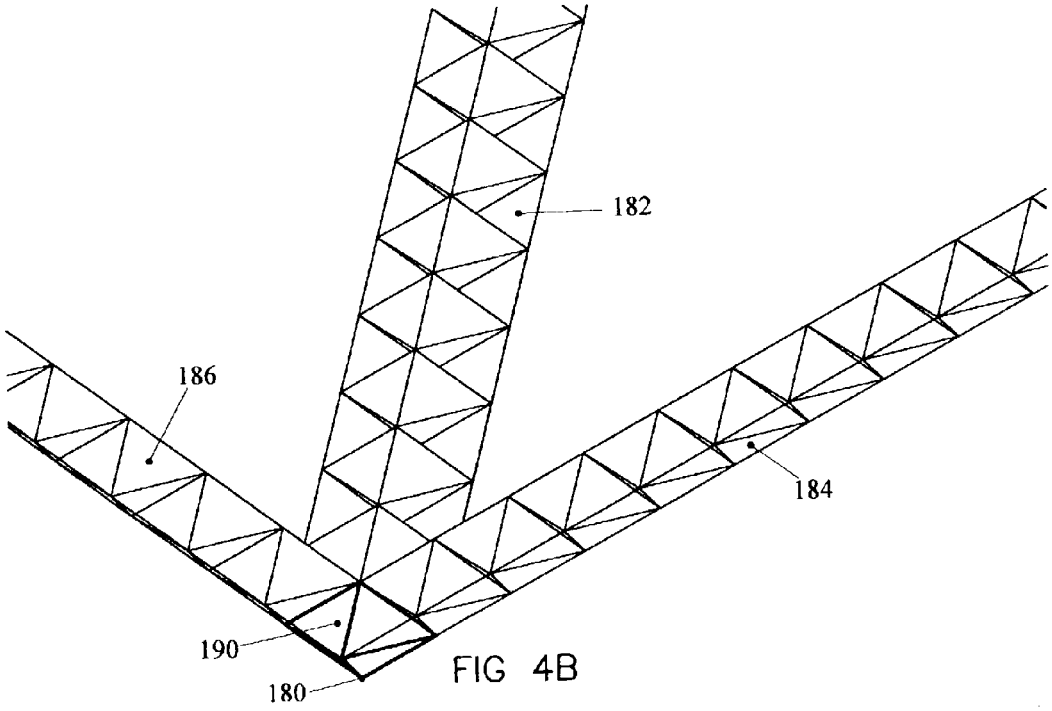

Reference is now made to FIGS. 4A & 4B, which are simplified illustrations of two junctions of rigid structural elements in the embodiment of FIG. 3 FIG. 4A shows the junction 160 of four rigid structural elements, designated here and in FIG. 3 by reference numerals 162, 164, 166 and 168. It is seen that the junction of rigid structural elements 162, 164, 166 and 168 defines an octahedron-like pair of pyramids having a common base This pair of pyramids, designated by reference numeral 170, is common to all four elements FIG. 4B shows a junction 180 of three rigid structural elements designated here and in FIG. 3 by reference numerals 182, 184 and 186 It is seen that the junction of rigid structural elements 182, 184 and 186 is also an octahedron-like pair of pyramids having a common base This pair of pyramids, designated by reference numeral 190, is common to all three elements Reference is now made to FIG. 5, which is a simplified illustration of a building structure, constructed and operative in accordance with a preferred embodiment of the present invention including five type B saddle elements as well as rigid structural elements fixed to the edges thereof and lying along diagonals of sides of cubes The rigid structural elements define part of an octet structure.

Figure 5:
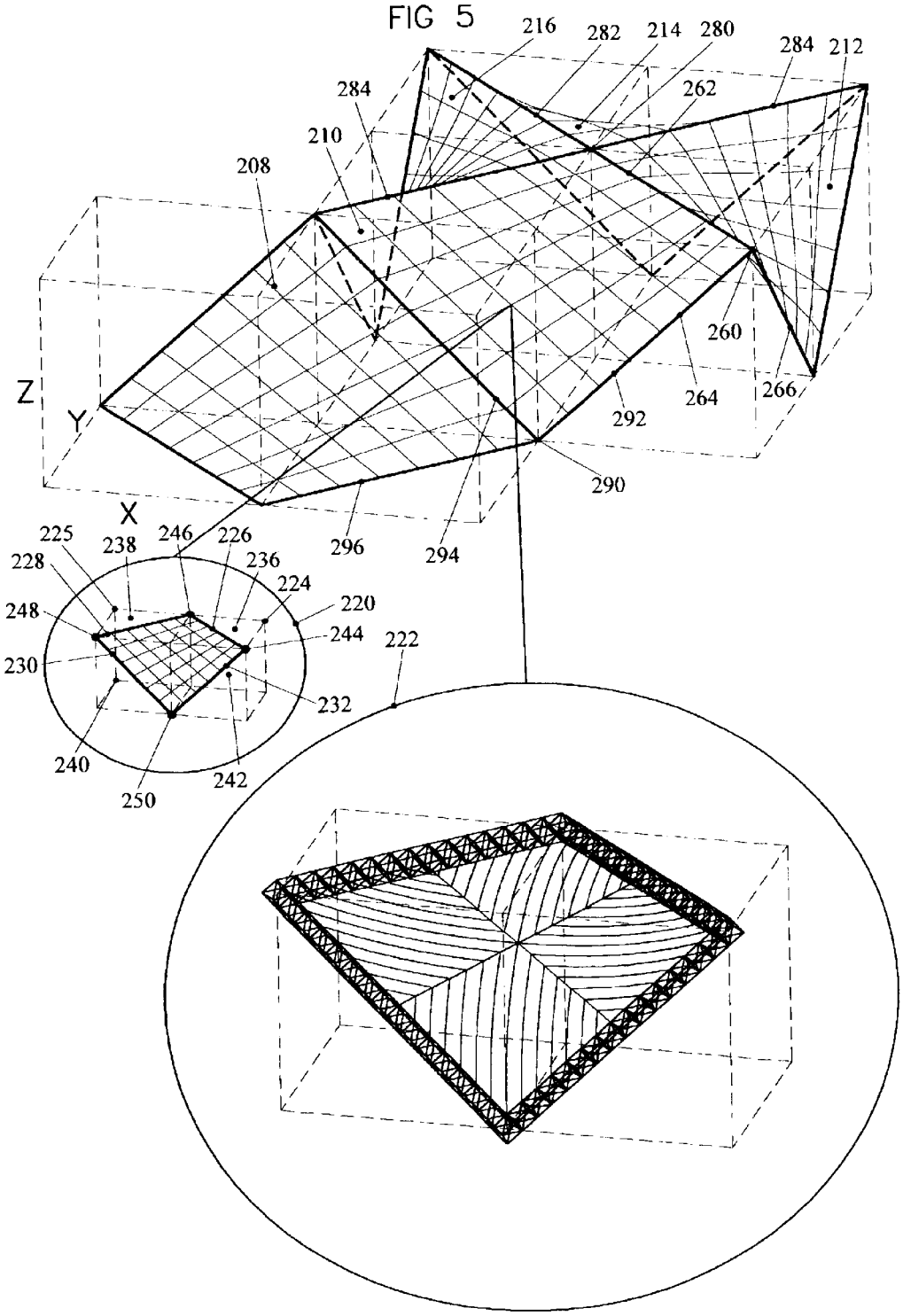
FIG. 5 is a simplified illustration of a building structure, constructed and operative in accordance with yet another preferred embodiment of the present invention.

As seen in FIG. 5, the building structure comprises type B saddle elements 208, 210, 212, 214 and 216 in five different orientations A single type B saddle element surrounded by rigid structural elements in the form of beams is shown in window 220 and a single type B saddle element surrounded by rigid structural elements in the form of trusses is shown in window 222 The use of trusses, particularly octet trusses, enables significantly increased dimensions to be spanned, as illustrated symbolically by the size difference between the saddle elements shown in windows 220 and 222

The type B saddle elements in this embodiment are characterized in that they define two 60 degree junctions and two 90 degree junctions. It is appreciated that type B saddle elements are each circumscribed by a pair of adjacent cubes, whose side dimensions X, Y & Z are all equal FIG. 5 illustrates a type B saddle element which is circumscribed by a pair of adjacent rectangular parallelepipeds having a common side surface, designated by reference numerals 224 and 225, whose side dimensions X, Y & Z are all equal, thus defining a pair of adjacent cubes Type B saddle elements are characterized in that they have four edges, designated in FIG. 5 by reference numerals 226, 228, 230 and 232, each defined by a diagonal extending along a side surface of a rectangular parallelepiped. The side surfaces whose diagonals define edges 226, 228, 230 and 232 are respectively designated by reference numerals 236, 238, 240 and 242 Surfaces 236 and 238 lie in the same plane, which extends perpendicularly to the plane of surfaces 240 and 242. Four junctions, designated by reference numerals 244, 246, 248 and 250, are defined by the four edges, each junction being located at the meeting of the ends of two adjacent edges The rigid structural elements may be any suitable rigid structural elements, such as beams, as shown in window 220 According to a preferred embodiment of the present invention, rigid structural elements are constructed as trusses, most preferably as octet trusses, linear combinations of octahedrons and tetrahedrons, as shown in window 222 Rigid structural elements of this type are known, for example in U.S. Pat. No. 4,869,041, for other applications.

Figure 6A:
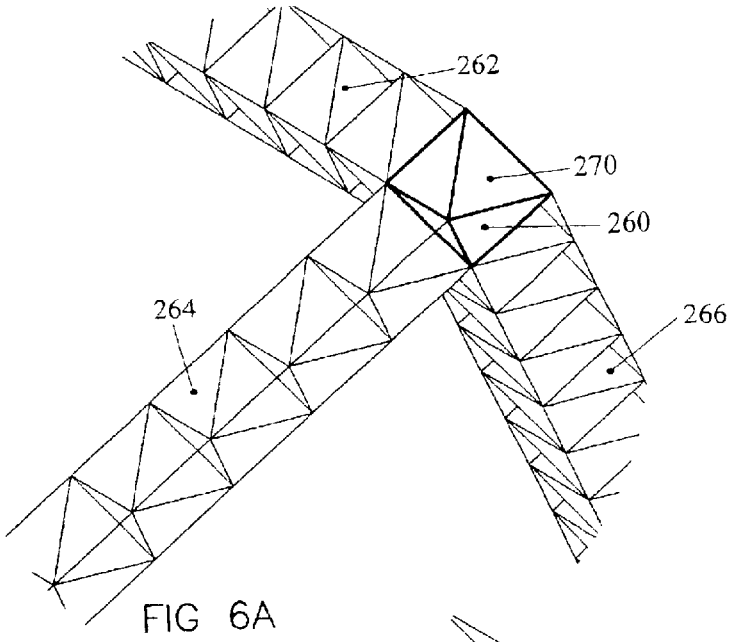
FIGS. 6A, 6B and 6C are simplified illustrations of three junctions of rigid structural elements in the embodiment of FIG. 5.
Figure 6B:
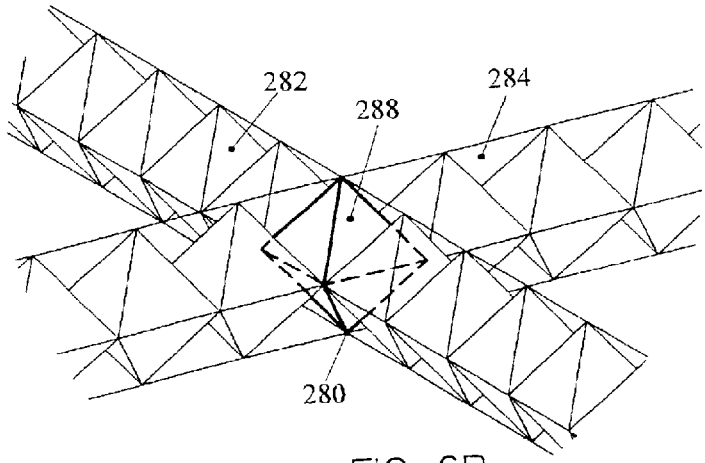
Figure 6C:
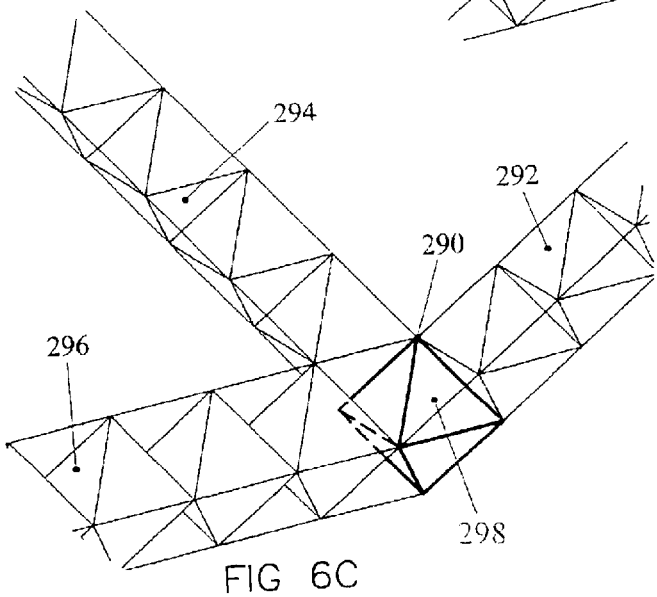

Reference is now made to FIGS. 6A, 6B & 6C, which are simplified illustrations of three junctions of rigid structural elements in the embodiment of FIG. 5 FIG. 6 A shows the junction 260 of three rigid structural elements, designated here and in FIG. 5 by reference numerals 262, 264 and 266 It is seen that the junction of rigid structural elements 262, 264 and 266 defines an octahedron 270, which is common to all three elements FIG. 6B shows the junction 280 of two rigid structural elements, designated here and in FIG. 5 by reference numerals 282 and 284. It is seen that the junction of rigid structural elements 282 and 284 is also an octahedron 288, which is common to both elements FIG. 6C shows the intersection 290 of three rigid structural elements, designated here and in FIG. 5 by reference numerals 292, 294 and 296 It is seen that the intersection of rigid structural elements 292, 294 and 296 is also an octahedron 298, which is common to all three elements Reference is now made to FIG. 7, which is a simplified illustration of a building structure, constructed and operative in accordance with a preferred embodiment of the present invention including five type B saddle elements as well as rigid structural elements fixed to the edges thereof and lying along diagonals of sides of non-cubic rectangular parallelepipeds The rigid structural elements define part of an octet-like structure As seen in FIG. 7, the building structure comprises five type B saddle elements 308, 310, 312, 314 and 316 in five different orientations A single type B saddle element surrounded by rigid structural elements in the form of beams is shown in window 320 and a single type B saddle element surrounded by rigid structural elements in the form of trusses is shown in window 322 The use of trusses, particularly octet-like trusses, enables significantly increased dimensions to be spanned, as illustrated symbolically by the size difference between the saddle elements shown in windows 320 and 322

The type B saddle elements in this embodiment are each circumscribed by a pair of adjacent rectangular parallelepipeds having a common side surface, whose side dimensions X, Y & Z are not all equal. The pair of adjacent rectangular parallelepipeds having a common side surface are designated by reference numerals 324 and 325

Figure 7:
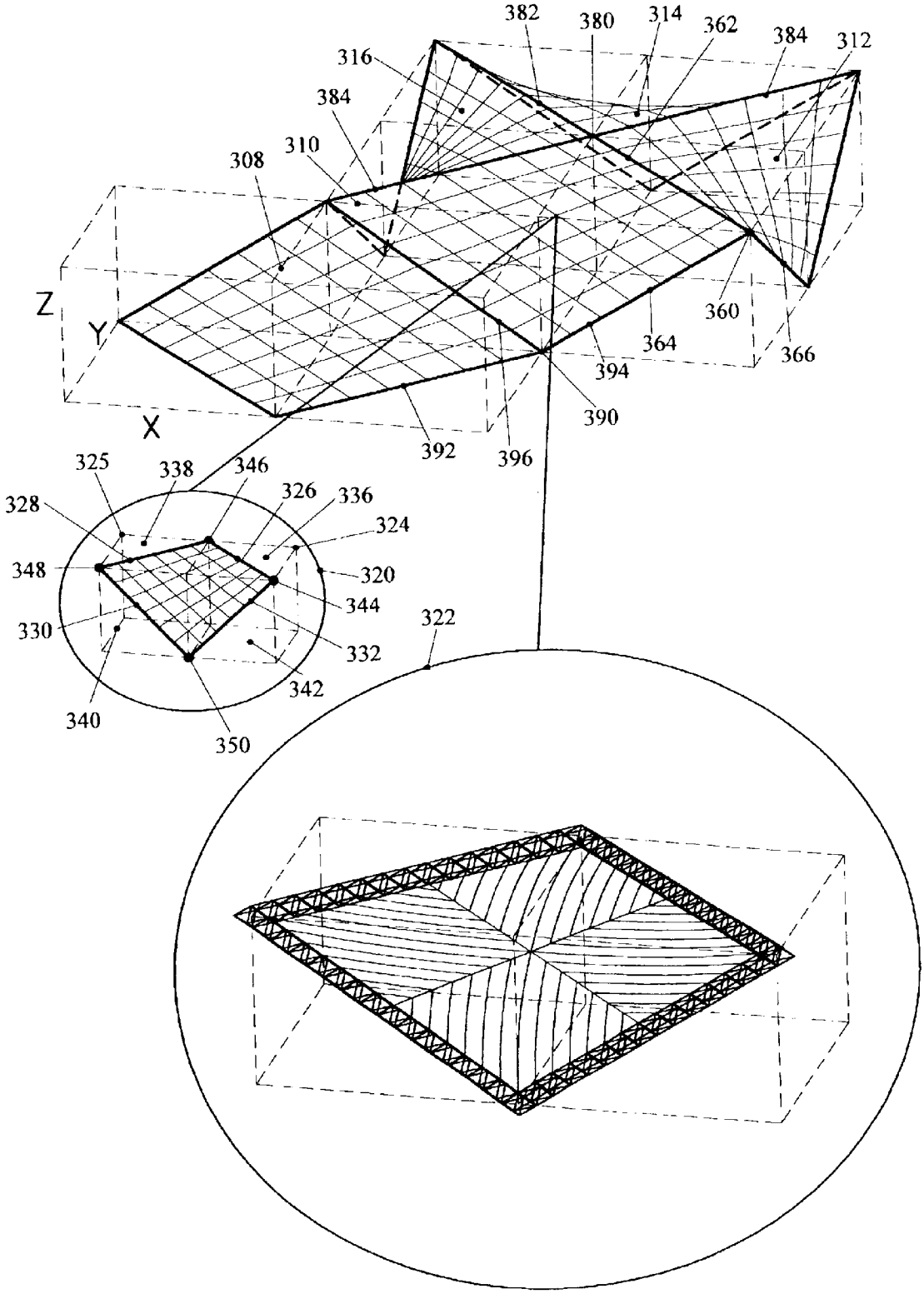
FIG. 7 is a simplified illustration of a building structure, constructed and operative in accordance with still another preferred embodiment of the present invention.

Type B saddle elements are characterized in that they each have four edges, designated in FIG. 7 by reference numerals 326, 328, 330 and 332, each defined by a diagonal extending, along a side surface of a rectangular parallelepiped The side surfaces whose diagonals define edges 326, 328, 330 and 332 are respectively designated by reference numerals 336, 338, 340 and 342 Surfaces 336 and 338 lie in the same plane, which extends perpendicularly to the plane of surfaces 340 and 342. Four junctions, designated by reference numerals 344, 346, 348 and 350, are defined by the four edges, each junction being located at the meeting of the ends of two adjacent edges The rigid structural elements may be any suitable rigid structural elements, such as beams, as shown in window 320 According to a preferred embodiment of the present invention, rigid structural elements are constructed as trusses, most preferably as octet-like trusses, linear combinations of octahedron-like structures and tetrahedron-like structures, as shown in window 322

Figure 8A:
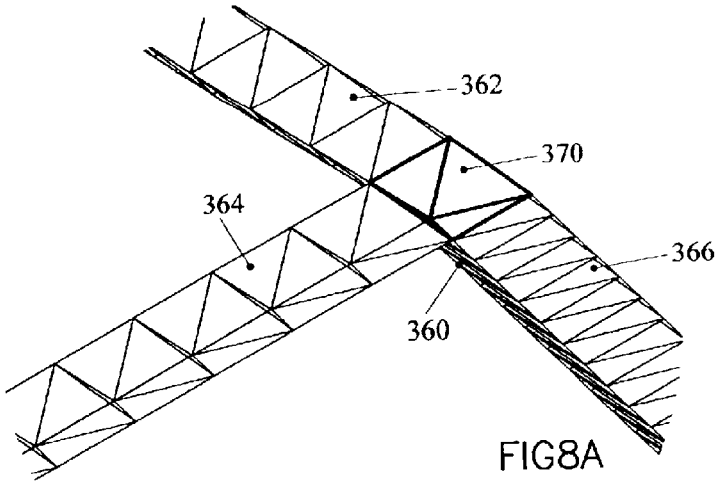
FIGS. 8A, 8B and 8C are simplified illustrations of three junctions of rigid structural elements in the embodiment of FIG. 7.
Figure 8B:
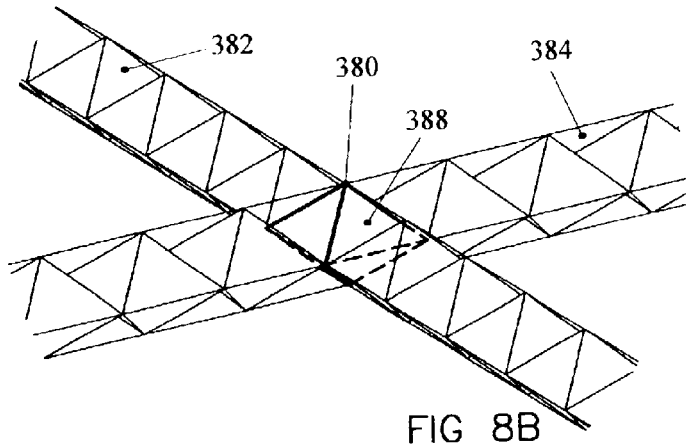
Figure 8C:
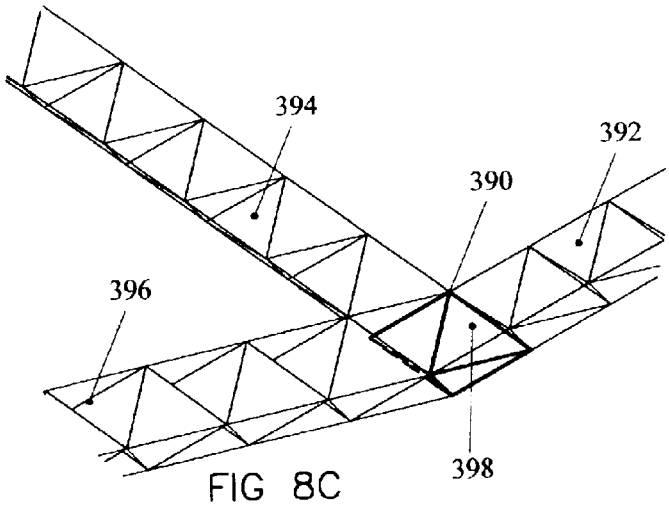

Reference is now made to FIGS. 8A, 8B & 8C, which are simplified illustrations of three junctions of rigid structural elements in the embodiment of FIG. 7. FIG. 8A shows the junction 360 of three rigid structural elements, designated here and in FIG. 7 by reference numerals 362, 364 and 366 It is seen that the junction of rigid structural elements 362, 364 and 366 defines an octahedron-like pair of pyramids having a common base This pair of pyramids, designated by reference numeral 370, is common to all three elements FIG. 8B shows the junction 380 of two rigid structural elements, designated here and in FIG. 7 by reference numerals 382 and 384 It is seen that the junction of rigid structural elements 382 and 384 is also an octahedron-like pair of pyramids having a common base This pair of pyramids, designated by reference numeral 388, is common to both elements.

Figure 9:
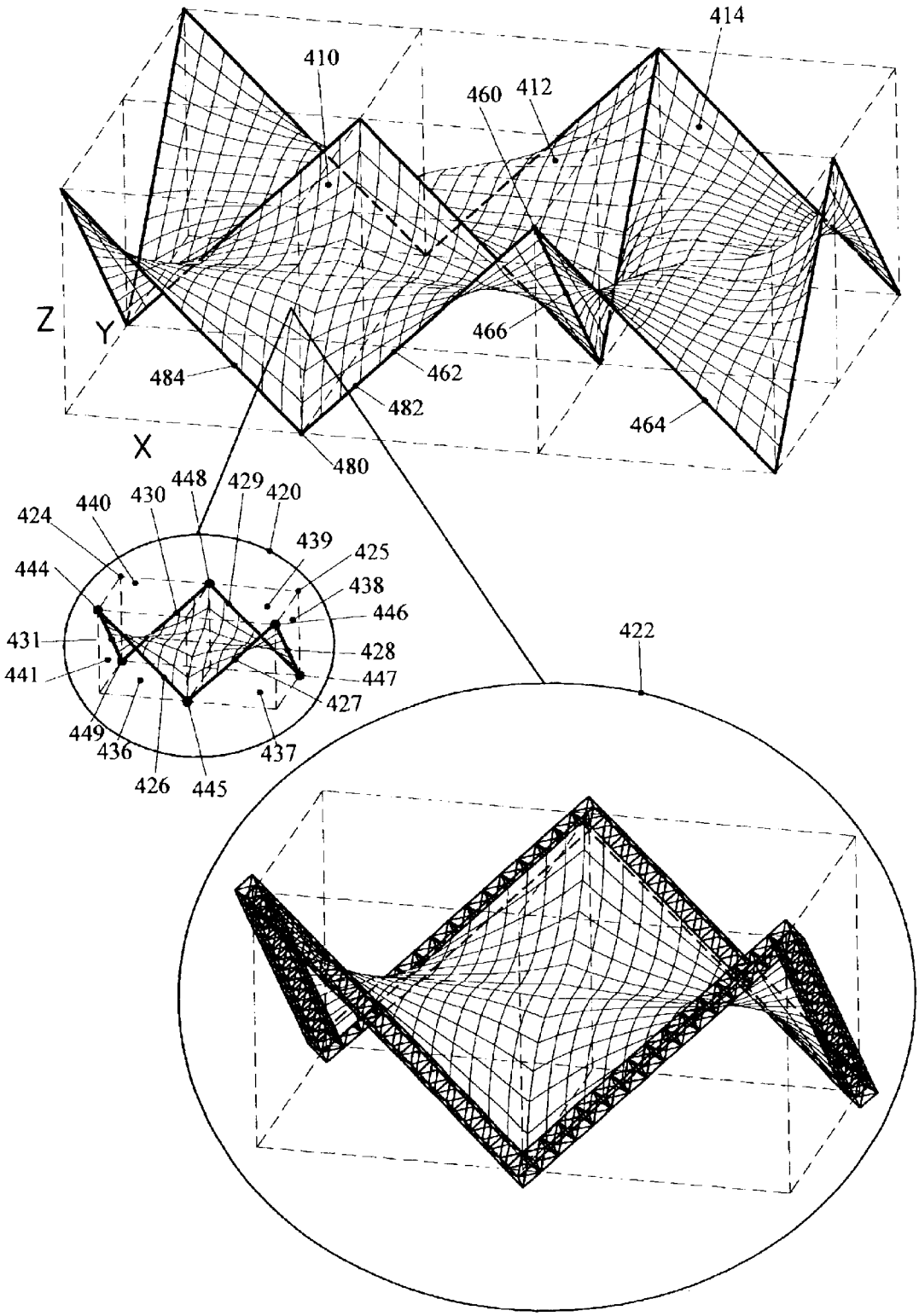
FIG. 9 is a simplified illustration of a building structure, constructed and operative in accordance with another preferred embodiment of the present invention.

FIG. 8C shows the intersection 390 of three rigid structural elements, designated here and in FIG. 7 by reference numerals 392, 394 and 396 It is seen that the intersection of rigid structural elements 392 394 & 396 is also an octahedron-like pair of pyramids having a common base This pair of pyramids, designated by reference numeral 398, is common to all three elements Reference is now made to FIG. 9, which is a simplified illustration of a building structure, constructed and operative in accordance with a preferred embodiment of the present invention including three type C saddle elements as well as rigid structural elements fixed to the edges thereof and lying along diagonals of sides of cubes The rigid structural elements define part of an octet structure As seen in FIG. 9, the building structure comprises type C saddle elements 410, 412 and 414 in three different orientations A single type C saddle element surrounded by rigid structural elements in the form of beams is shown in window 420 and a single type C saddle element surrounded by rigid structural elements in the form of trusses is shown in window 422 The use of trusses, particularly octet trusses, enables significantly increased dimensions to be spanned, as illustrated symbolically by the size difference between the saddle elements shown in windows 420 and 422

The type C saddle elements in this embodiment are characterized in that they define four 60 degree junctions and two 90 degree junctions It is appreciated that type C saddle elements are each circumscribed by a pair of adjacent cubes having a common face, whose side dimensions X, Y & Z are all equal FIG. 9 illustrates a type C saddle element which is circumscribed by a pair of adjacent rectangular parallelepipeds having a common side surface, designated by reference numerals 424 and 425, whose side dimensions X, Y & Z are all equal, thus defining a pair of adjacent cubes.

Figure 10A:
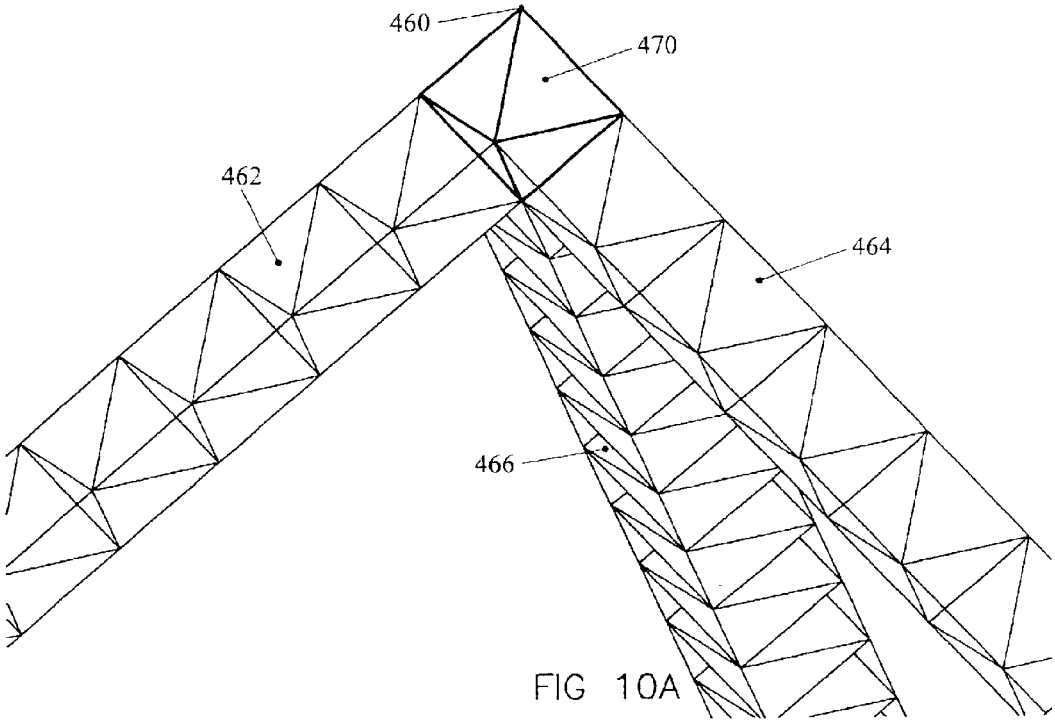
FIGS. 10A and 10B are simplified illustrations of two junctions of rigid structural elements in the embodiment of FIG. 9.
Figure 10B:
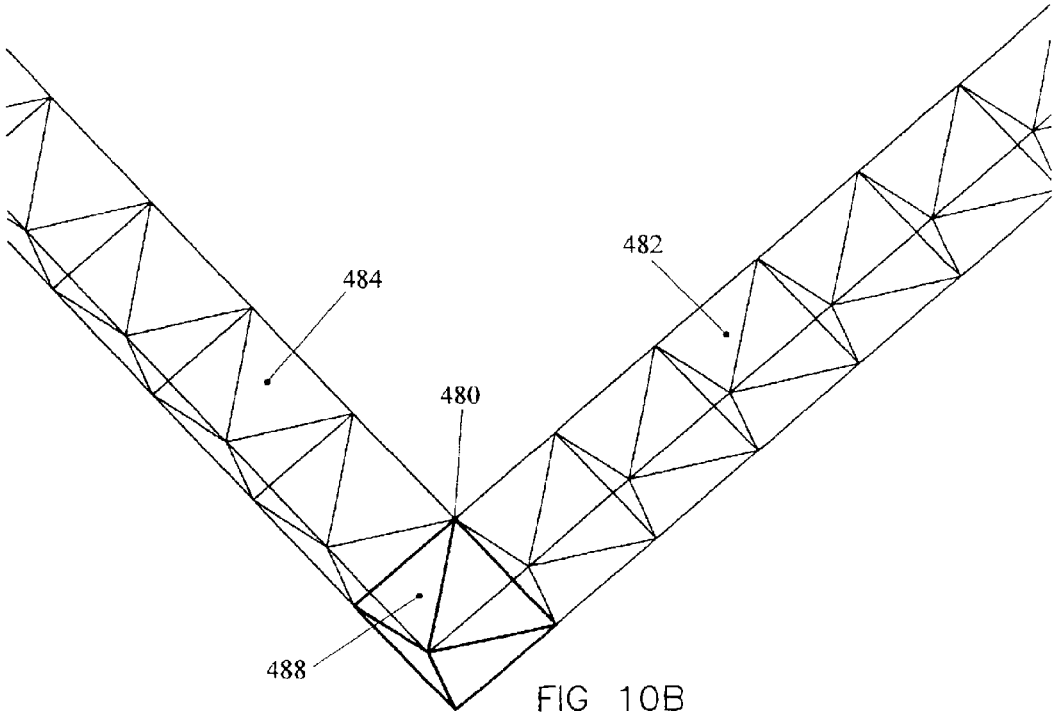

Type C saddle elements are characterized in that they have six edges, designated in FIG. 9 by reference numerals 426, 427, 428, 429, 430 and 431, each defined by a diagonal extending along a side surface of a rectangular parallelepiped. The side surfaces whose diagonals define edges 426, 427, 428, 429, 430 and 431 are respectively designated by reference numerals 436, 437, 438, 439, 440 and 441 Surfaces 436 and 437 lie in the same plane, which extends parallel to and spaced from the plane of surfaces 439 and 440 Surfaces 436, 437, 439 and 440 are perpendicular to planes 438 and 441, which are mutually parallel and spaced from each other Six junctions, designated by reference numerals 444, 445, 446, 447, 448 and 449, are defined by the six edges, each junction being located at the meeting of the ends of two adjacent edges The rigid structural elements may be any suitable rigid structural elements, such as beams, as shown in window 420 According to a preferred embodiment of the present invention, rigid structural elements are constructed as trusses, most preferably as octet trusses, linear combinations of octahedrons and tetrahedrons as shown in window 422 Rigid structural elements of this type are known, for example in U.S. Pat. No. 4,869,041, for other applications Reference is now made to FIGS. 10A and 10B, which are simplified illustrations of two junctions of rigid structural elements in the embodiment of FIG. 9 FIG. 10A shows the junction 460 of three rigid structural elements, designated here and in FIG. 9 by reference numerals 462, 464 and 466 It is seen that the junction of rigid structural elements 462, 464 and 466 defines an octahedron 470, which is common to all three elements FIG. 10B shows the junction 480 of two rigid structural elements, designated here and in FIG. 9 by reference numerals 482 and 484 It is seen that the junction of rigid structural elements 482 and 484 is also an octahedron 488, which is common to both elements Reference is now made to FIG. 11, which is a simplified illustration of a building structure, constructed and operative in accordance with a preferred embodiment of the present invention including three type C saddle elements as well as rigid structural elements fixed to the edges thereof and lying along diagonals of sides of non-cubic rectangular parallelepipeds. The rigid structural elements define part of an octet-like structure As seen in FIG. 11, the building structure comprises type C saddle elements 510, 512 and 514 in three different orientations A single type B saddle element surrounded by rigid structural elements in the form of beams is shown in window 520 and a single type B saddle element surrounded by rigid structural elements in the form of trusses is shown in window 522 The use of trusses, particularly octet-like trusses, enables significantly increased dimensions to be spanned, as illustrated symbolically by the size difference between the saddle elements shown in windows 520 and 522

The type C saddle elements in this embodiment are each circumscribed by a pair of adjacent non-cubic rectangular parallelepipeds having a common side surface, whose side dimensions X, Y & Z are not all equal. The pair of adjacent rectangular parallelepipeds having a common side surface are designated by reference numerals 524 and 525

Figure 11:
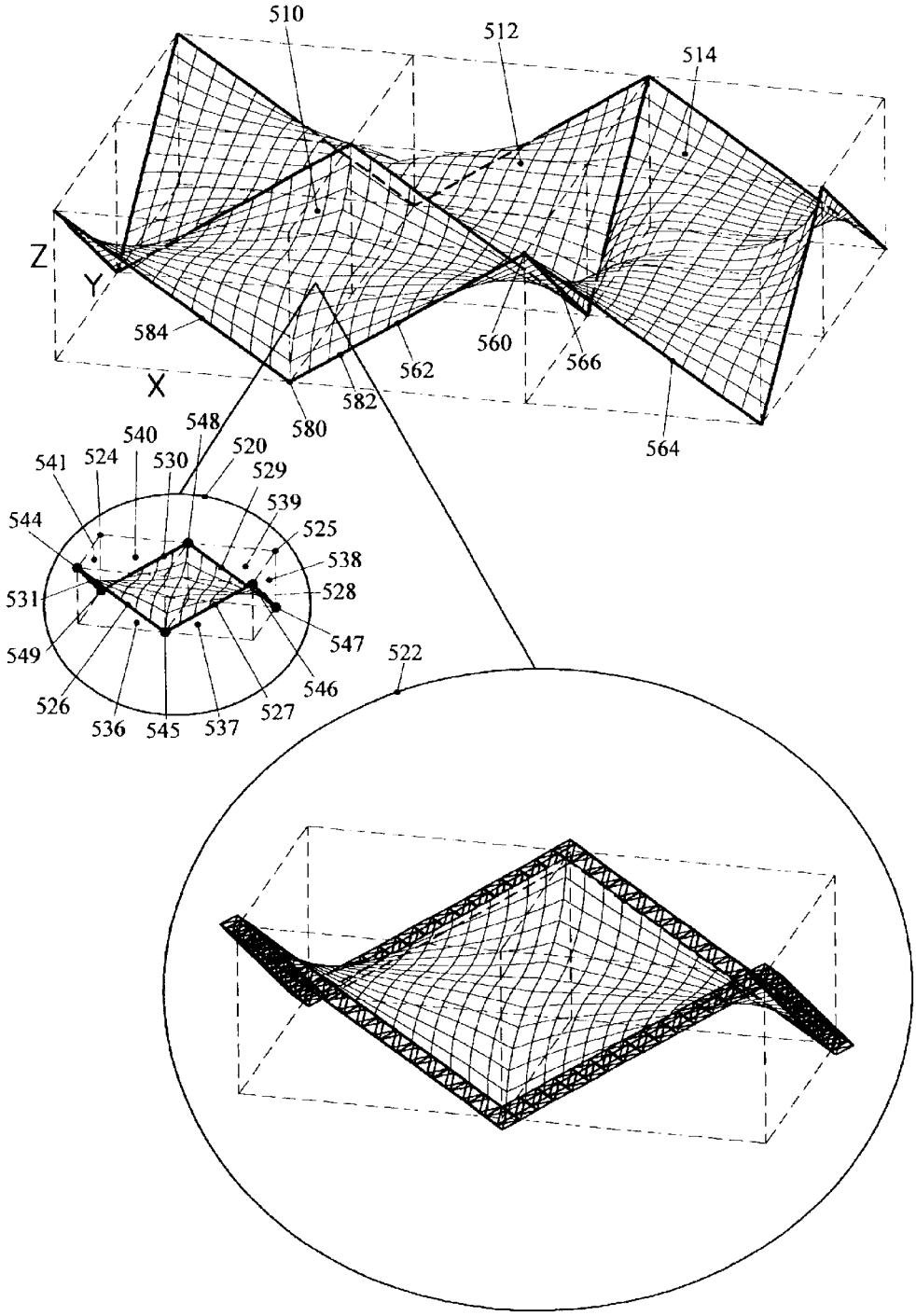
FIG. 11 is a simplified illustration of a building structure, constructed and operative in accordance with yet another preferred embodiment of the present invention.

Type C saddle elements are characterized in that they have six edges, designated in FIG. 11 by reference numerals 526, 527, 528, 529, 530 and 531, each defined by a diagonal extending along a side surface of a rectangular parallelepiped The side surfaces whose diagonals define edges 526, 527, 528, 529, 530 and 431 are respectively designated by reference numerals 536, 537, 538, 539, 540 and 541 Surfaces 536 and 537 lie in the same plane, which extends parallel to and spaced from the plane of surfaces 539 and 540 Surfaces 536, 537, 539 and 540 are perpendicular to planes 538 and 541, which are mutually parallel and spaced from each other. Six junctions, designated by reference numerals 544, 545, 546, 547, 548 and 549, are defined by the six edges, each junction being located at the meeting of the ends of two adjacent edges The rigid structural elements may be any suitable rigid structural elements, such as beams, as shown in window 520 According to a preferred embodiment of the present invention, rigid structural elements are constructed as trusses, most preferably as octet-like trusses, linear combinations of octahedron-like structures and tetrahedron-like structures, as shown in window 522

Figure 12A:
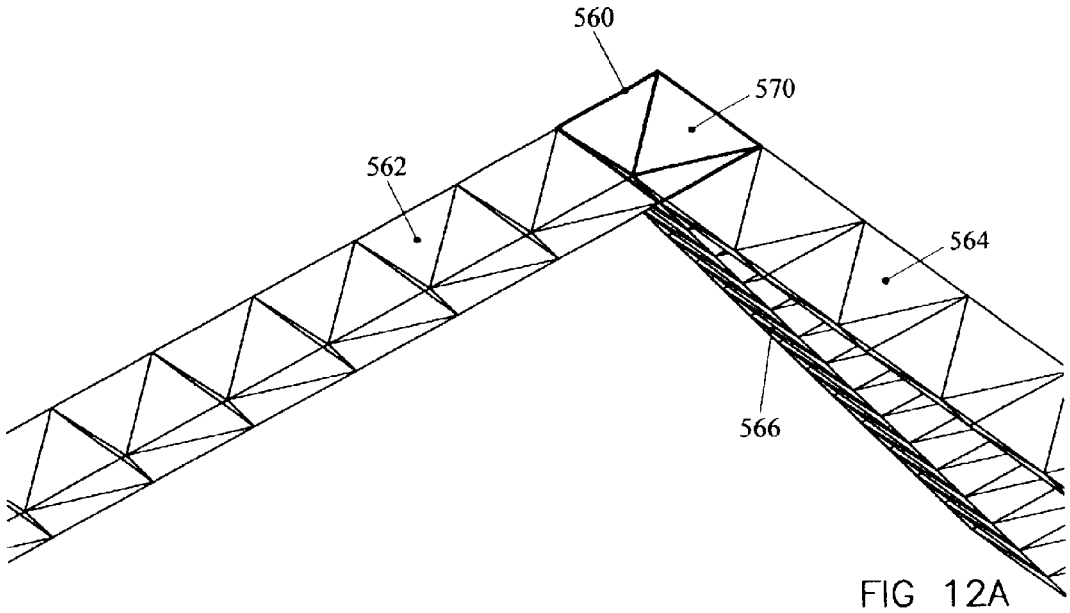
FIGS. 12A and 12B are simplified illustrations of two junctions of rigid structural elements in the embodiment of FIG. 11.
Figure 12B:
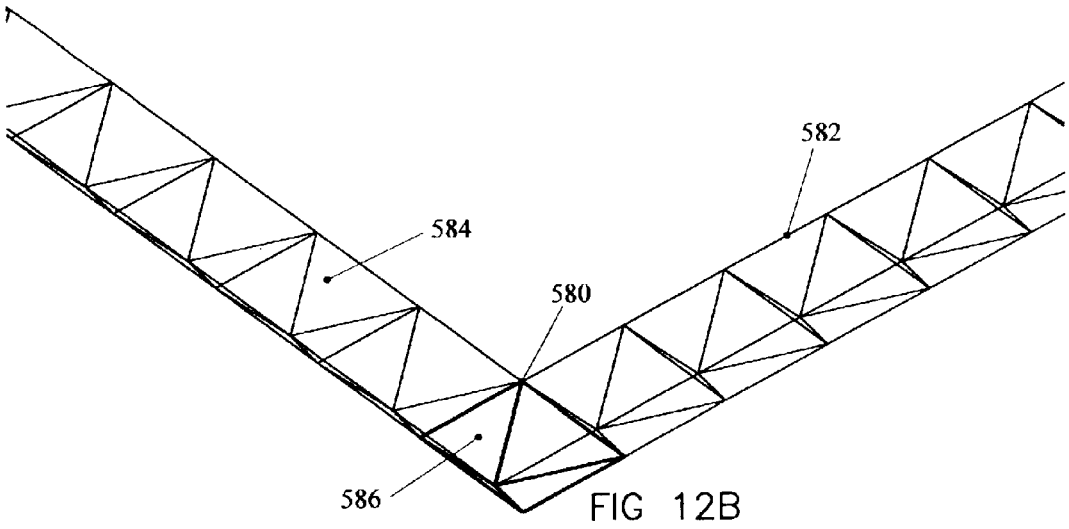

Reference is now made to FIGS. 12A & 12B, which are simplified illustrations of two junctions of rigid structural elements in the embodiment of FIG. 11 FIG. 12A shows the junction 560 of three rigid structural elements, designated here and in FIG. 11 by reference numerals 562, 564 and 566 It is seen that the junction of rigid structural elements 562, 564 and 566 defines an octahedron-like pair of pyramids having a common base This pair of pyramids, designated by reference numeral 570, is common to all three elements FIG. 12B shows the junction 580 of two rigid structural elements, designated here and in FIG. 11 by reference numerals 582 and 584. It is seen that the intersection of rigid structural elements 582 and 584 is also an octahedron-like pair of pyramids having a common base This pair of pyramids, designated by reference numeral 586 is common to both elements Reference is now made to FIG. 13, which is a simplified illustration of a building structure, constructed and operative in accordance with a preferred embodiment of the present invention including three type D saddle elements as well as rigid structural elements fixed to the edges thereof and lying along diagonals of sides of cubes The rigid structural elements define part of an octet structure.

Figure 13:
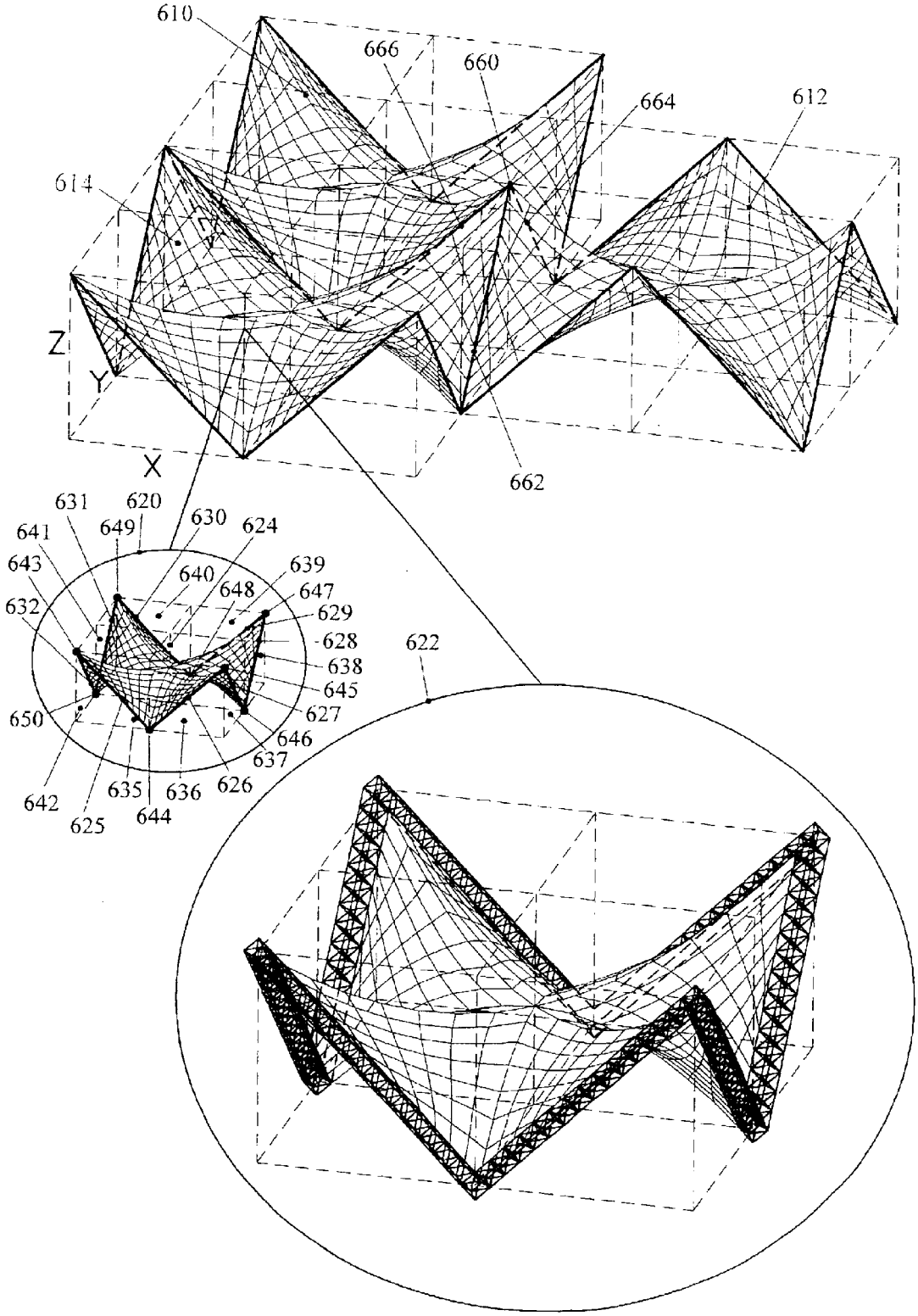
FIG. 13 is a simplified illustration of a building structure, constructed and operative in accordance with still another preferred embodiment of the present invention.

As seen in FIG. 13, the building structure comprises type D saddle elements 610, 612 and 614 in two different orientations A single type D saddle element surrounded by rigid structural elements in the form of beams is shown in window 620 and a single type D saddle element surrounded by rigid structural elements in the form of trusses is shown in window 622 The use of trusses, particularly octet trusses, enables significantly increased dimensions to be spanned, as illustrated symbolically by the size difference between the saddle elements shown in windows 620 and 622.

The type D saddle elements in this embodiment are characterized in that they define four 60 degree junctions and four 90 degree junctions. It is appreciated that type D saddle elements are each circumscribed by four adjacent cubes having a common edge, whose side dimensions X, Y & Z are all equal. FIG. 13 illustrates a type D saddle element which is circumscribed by four adjacent rectangular parallelepipeds having a common edge, designated by reference numeral 624, whose side dimensions X, Y & Z are all equal, thus defining four adjacent cubes Type D saddle elements are characterized in that they have eight edges, designated in FIG. 13, by reference numerals 625, 626, 627, 628, 629, 630, 631 and 632 each defined by a diagonal extending along a side surface of a rectangular parallelepiped The side surfaces whose diagonals define edges 625, 626, 627, 628, 629, 630, 631 and 632 are respectively designated by reference numerals 635, 636, 637, 638, 639, 640, 641 and 642 Surfaces 635 and 636 lie in the same plane, which extends parallel to and spaced from the plane of surfaces 639 and 640. Surfaces 637 and 638 lie in a common plane, which is perpendicular to planes 635, 636, 639 and 640 Surfaces 637 and 638 lie in parallel spaced relationship with surfaces 641 and 642, which both lie in a common plane Eight junctions, designated by reference numerals 643, 644, 645, 646, 647, 648, 649 and 650 are defined by the eight edges, each junction being located at the meeting of the ends of two adjacent edges The rigid structural elements may be any suitable rigid structural elements, such as beams, as shown in window 620 According to a preferred embodiment of the present invention, rigid structural elements are constructed as trusses, most preferably as octet trusses, linear combinations of octahedrons and tetrahedrons, as shown in window 622 Rigid structural elements of this type are known, for example in U.S. Pat. No. 4,869,041, for other applications.

Figure 14:
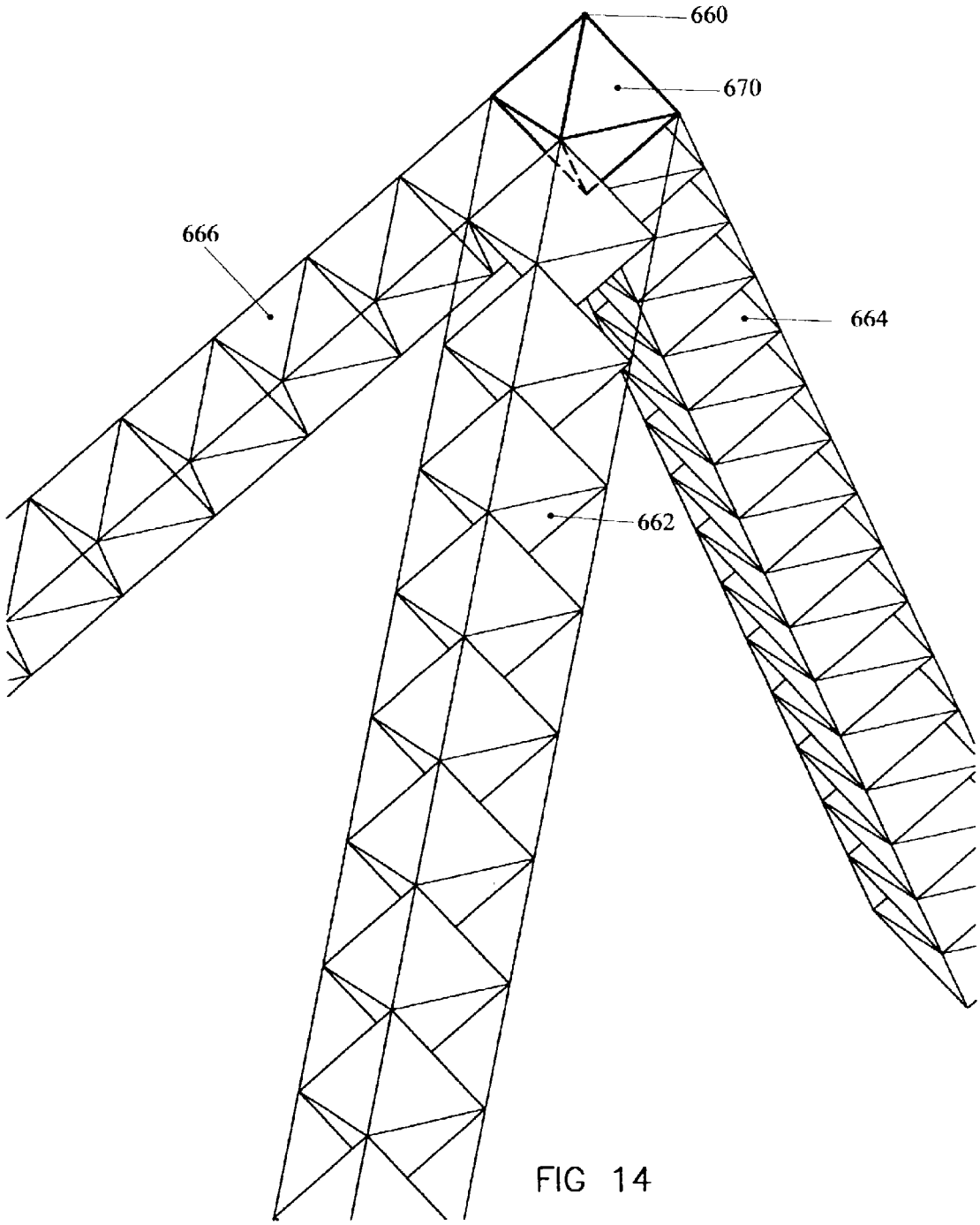
FIG. 14 is a simplified illustration of a junction of rigid structural elements in the embodiment of FIG. 13.
Figure 15:
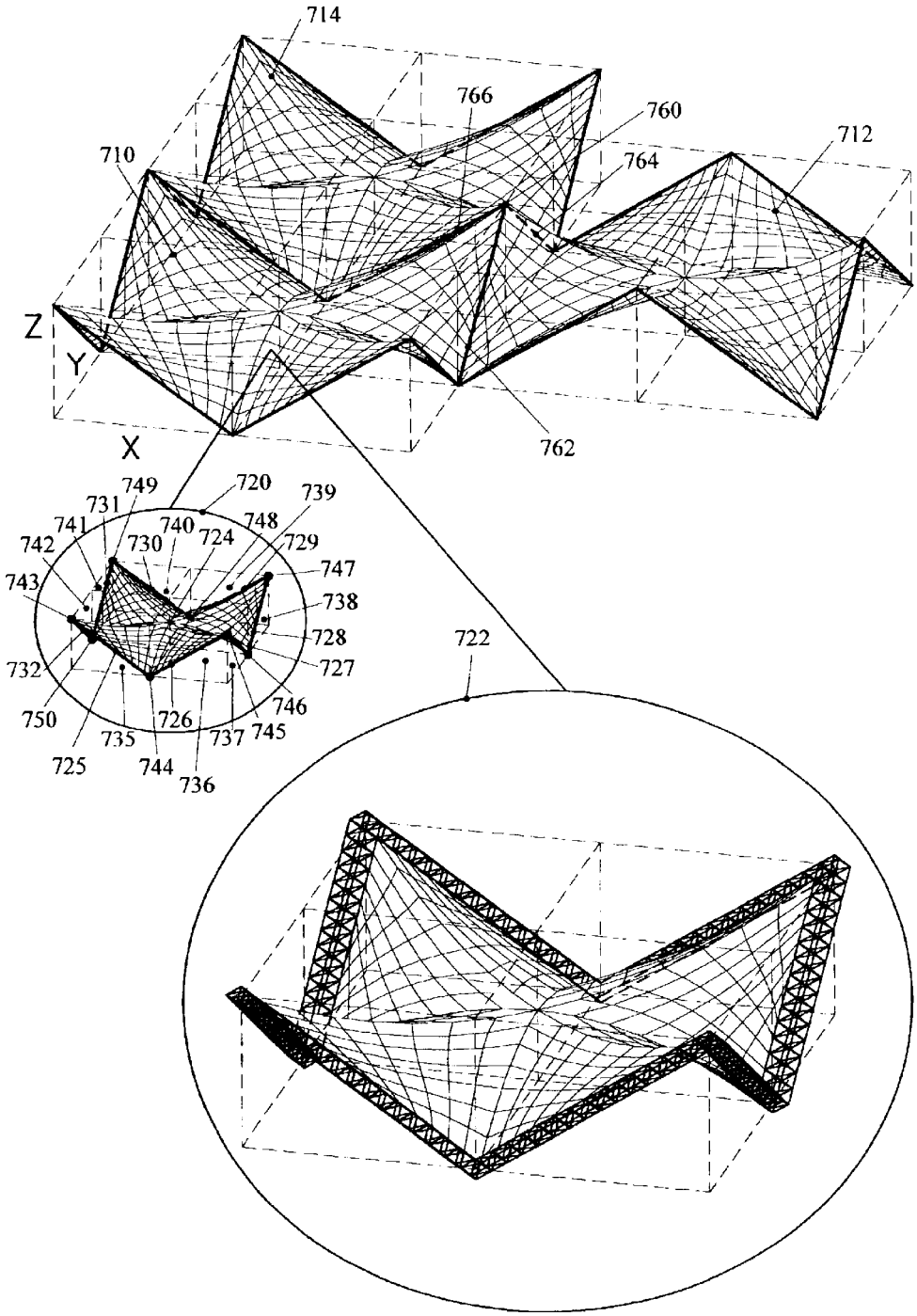
FIG. 15 is a simplified illustration of a building structure, constructed and operative in accordance with yet another preferred embodiment of the present invention.

Reference is now made to FIG. 14, which is a simplified illustration of a junction of rigid structural elements in the embodiment of FIG. 13 FIG. 14 shows the junction 660 of three rigid structural elements, designated by reference numerals 662, 664 and 666 It is seen that the junction of rigid structural elements 662, 664 and 666 defines an octahedron 670, which is common to all three elements Reference is now made to FIG. 15, which is a simplified illustration of a building structure, constructed and operative in accordance with a preferred embodiment of the present invention including three type D saddle elements as well as rigid structural elements fixed to the edges thereof and lying along diagonals of sides of non-cubic rectangular parallelepipeds The rigid structural elements define part of an octet-like structure As seen in FIG. 15, the building structure comprises type D saddle elements 710, 712 and 714 in two different orientations A single type D saddle element surrounded by rigid structural elements in the form of beams is shown in window 720 and a single type D saddle element surrounded by rigid structural elements in the form of trusses is shown in window 722 The use of trusses, particularly octet-like trusses, enables significantly increased dimensions to be spanned, as illustrated symbolically by the size difference between the saddle elements shown in windows 720 and 722

Figure 16:
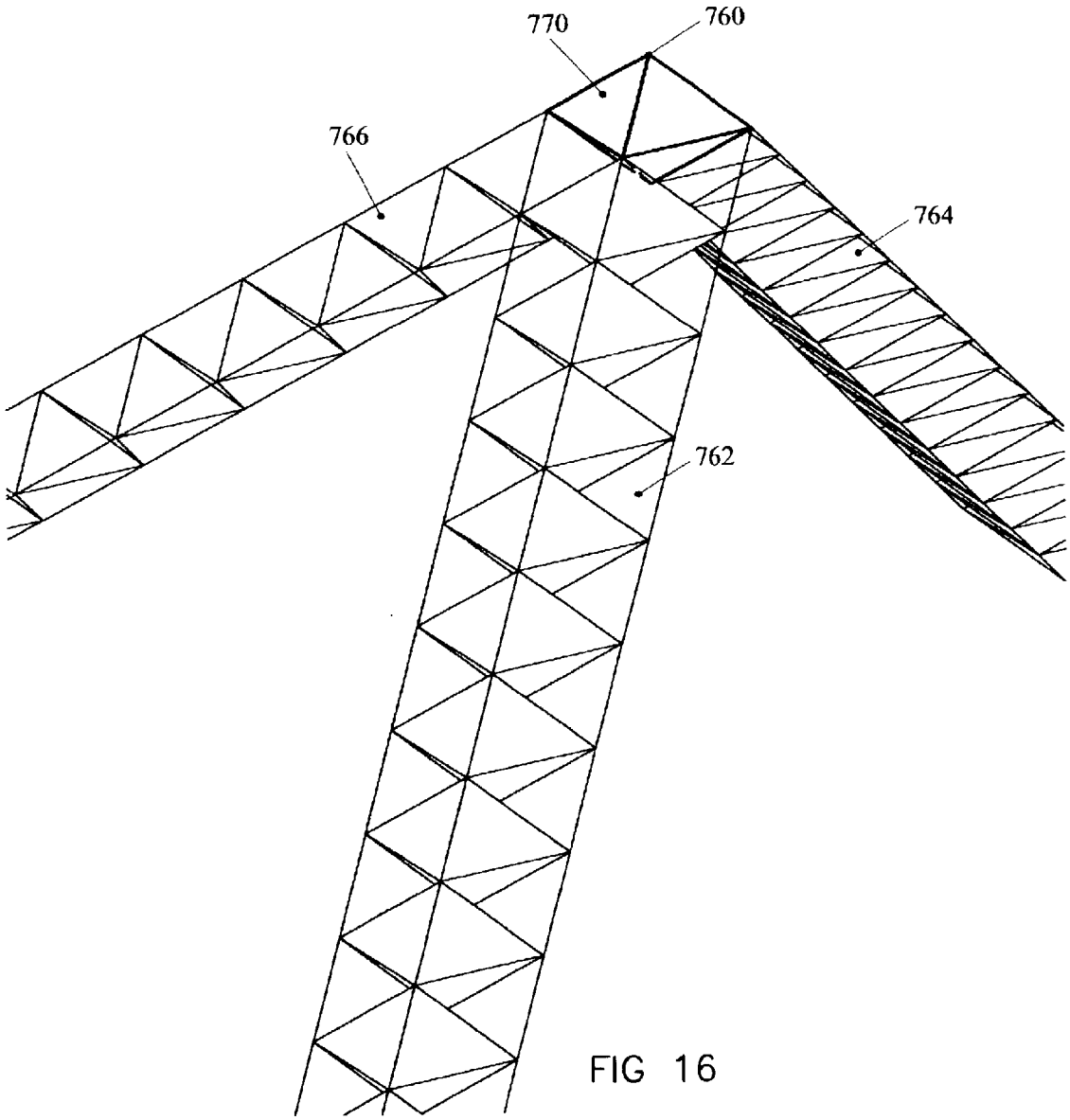
FIG. 16 is a simplified illustration of a junction of rigid structural elements in the embodiment of FIG. 15.

It is appreciated that type D saddle elements are each circumscribed by four adjacent non-cubic rectangular parallelepipeds having a common edge, whose side dimensions X, Y & Z are not all equal FIG. 15 illustrates a type D saddle element which is circumscribed by four adjacent rectangular parallelepipeds having a common edge, designated by reference numeral 724, whose side dimensions X, Y & Z are not all equal Type D saddle elements are characterized in that they have eight edges, designated in FIG. 15 by reference numerals 725, 726, 727, 728, 729, 730, 731 and 732, each defined by a diagonal extending along a side surface of a rectangular parallelepiped The side surfaces whose diagonals define edges 725, 726, 727, 728, 729, 730, 731 and 732 are respectively designated by reference numerals 735, 736, 737, 738, 739, 740, 741 and 742 Surfaces 735 and 736 lie in the same plane, which extends parallel to and spaced from the plane of surfaces 739 and 740 Surfaces 737 and 738 lie in a common plane, which is perpendicular to planes 735, 736, 739 and 740. Surfaces 737 and 738 lie in parallel spaced relationship with surfaces 741 and 742, which both lie in a common plane Eight junctions, designated by reference numerals 743, 744, 745, 746, 747, 748, 749 and 750 are defined by the eight edges, each junction being located at the meeting of the ends of two adjacent edges The rigid structural elements may be any suitable rigid structural elements, such as beams, as shown in window 720. According to a preferred embodiment of the present invention, rigid structural elements are constructed as trusses, most preferably as octet-like trusses, linear combinations of octahedron-like structures and tetrahedron-like structures, as shown in window 722. Rigid structural elements of this type are known, for example in U.S. Pat. No. 4,869,041, for other applications Reference is now made to FIG. 16, which is a simplified illustration of a junction of rigid structural elements in the embodiment of FIG. 15. FIG. 16 shows the junction 760 of three rigid structural elements, designated by reference numerals 762, 764 and 766 It is seen that the junction of rigid structural elements 762, 764 and 766 defines octahedron-like pair of pyramids having a common base. This pair of pyramids, designated by reference numeral 770, is common to all three elements Reference is now made to FIG. 17, which is a simplified illustration of a building structure, constructed and operative in accordance with a preferred embodiment of the present invention including two type E saddle elements as well as rigid structural elements fixed to the edges thereof and lying along diagonals of sides of cubes The rigid structural elements define part of an octet structure.

Figure 17:
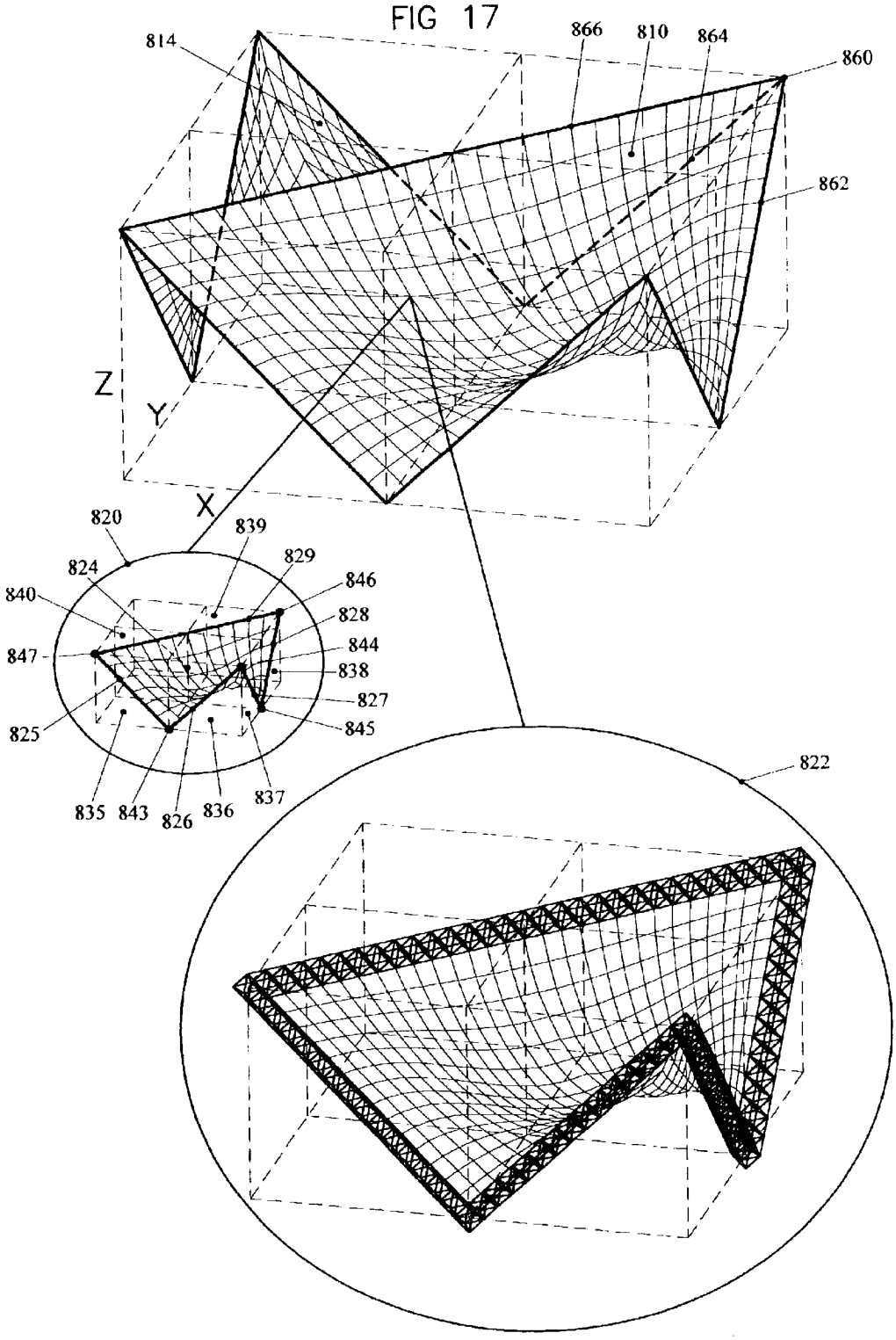
FIG. 17 is a simplified illustration of a building structure, constructed and operative in accordance with still another preferred embodiment of the present invention.

As seen in FIG. 17, the building structure comprises type E saddle elements 810 and 814 in two different orientations. A single type E saddle element surrounded by rigid structural elements in the form of beams is shown in window 820 and a single type E saddle element surrounded by rigid structural elements in the form of trusses is shown in window 822. The use of trusses, particularly octet trusses, enables significantly increased dimensions to be spanned, as illustrated symbolically by the size difference between the saddle elements shown in windows 820 and 822

The type E saddle elements in this embodiment are characterized in that they define three 60 degree junctions and two 90 degree junctions It is appreciated that type E saddle elements are each circumscribed by three adjacent cubes having a common edge, whose side dimensions X, Y & Z are all equal. FIG. 17 illustrates a type E saddle element which is circumscribed by three adjacent rectangular parallelepipeds having a common edge, designated by reference numeral 824, whose side dimensions X, Y & Z are all equal, thus defining three adjacent cubes Type E saddle elements are characterized in that they have four edges, designated in FIG. 17 by reference numerals 825, 826, 827 and 828, each defined by a diagonal extending along a side surface of a rectangular parallelepiped, and an edge 829, which extends along side surfaces of two rectangular parallelepipeds and is double the length of each of the remaining four edges. The side surfaces whose diagonals define edges 825, 826, 827 and 828 are respectively designated by reference numerals 835, 836, 837 and 838 The side surfaces whose diagonals define edge 829 are designated by reference numerals 839 and 840

Figure 18:
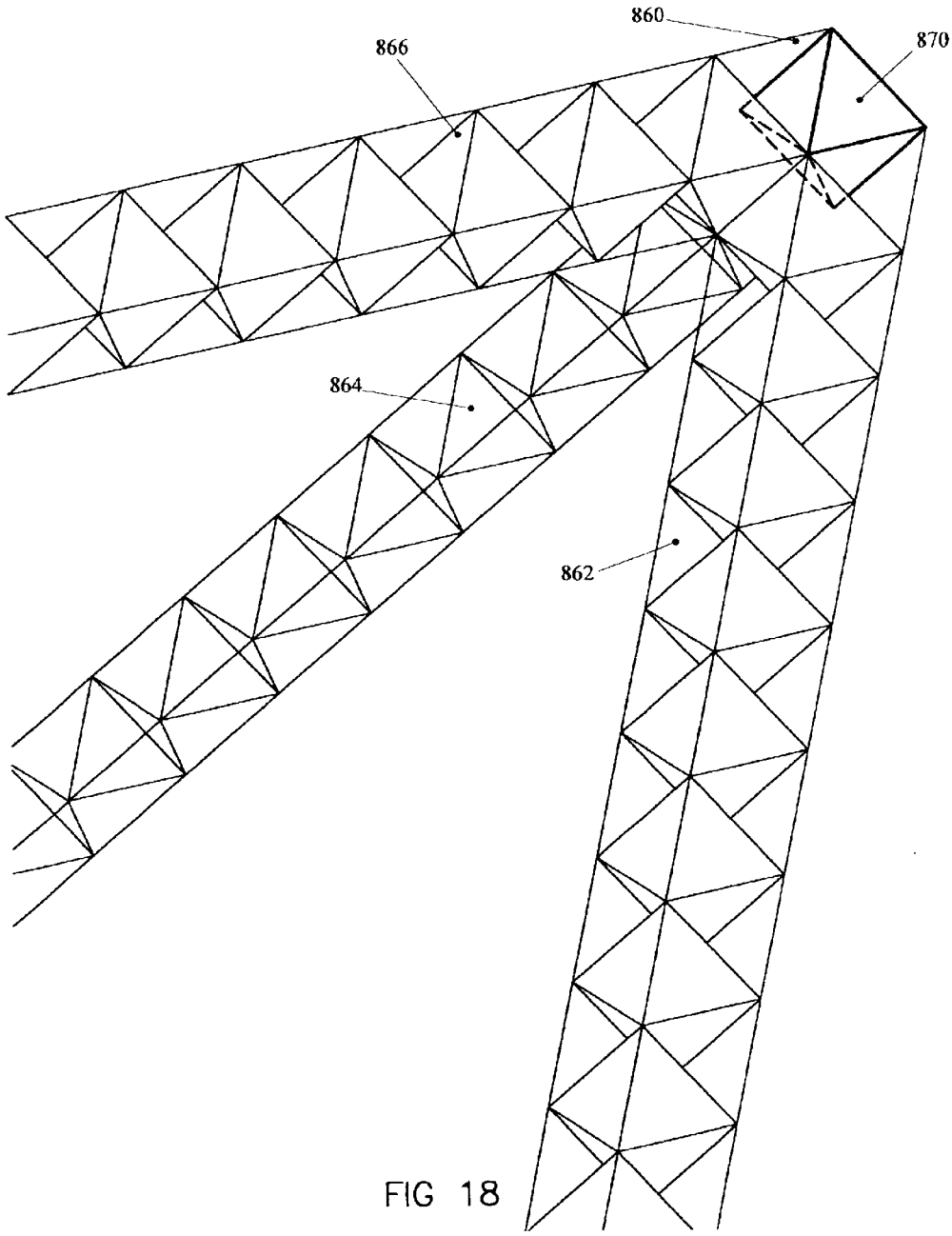
FIG. 18 is a simplified illustration of a junction of rigid structural elements in the embodiment of FIG. 17.

Surfaces 835 and 836 lie in the same plane, which extend perpendicular to the plane of surfaces 837 and 838 These two planes lie perpendicular to a plane of surfaces 839 and 840 Five junctions, designated by reference numerals 843, 844, 845, 846 and 847 are defined by the five edges, each junction being located at the meeting of the ends of two adjacent edges The rigid structural elements may be any suitable rigid structural elements, such as beams, as shown in window 820 According to a preferred embodiment of the present invention, rigid structural elements are constructed as trusses, most preferably as octet trusses, linear combinations of octahedrons and tetrahedrons, as shown in window 822. Rigid structural elements of this type are known, for example in U.S. Pat. No. 4,869,041, for other applications Reference is now made to FIG. 18, which is a simplified illustration of a junction of rigid structural elements in the embodiment of FIG. 17 FIG. 18 shows the junction 860 of three rigid structural elements, designated by reference numerals 862, 864 and 866 It is seen that the junction of rigid structural elements 862, 864 and 866 defines an octahedron 870, which is common to all three elements.

Figure 19:
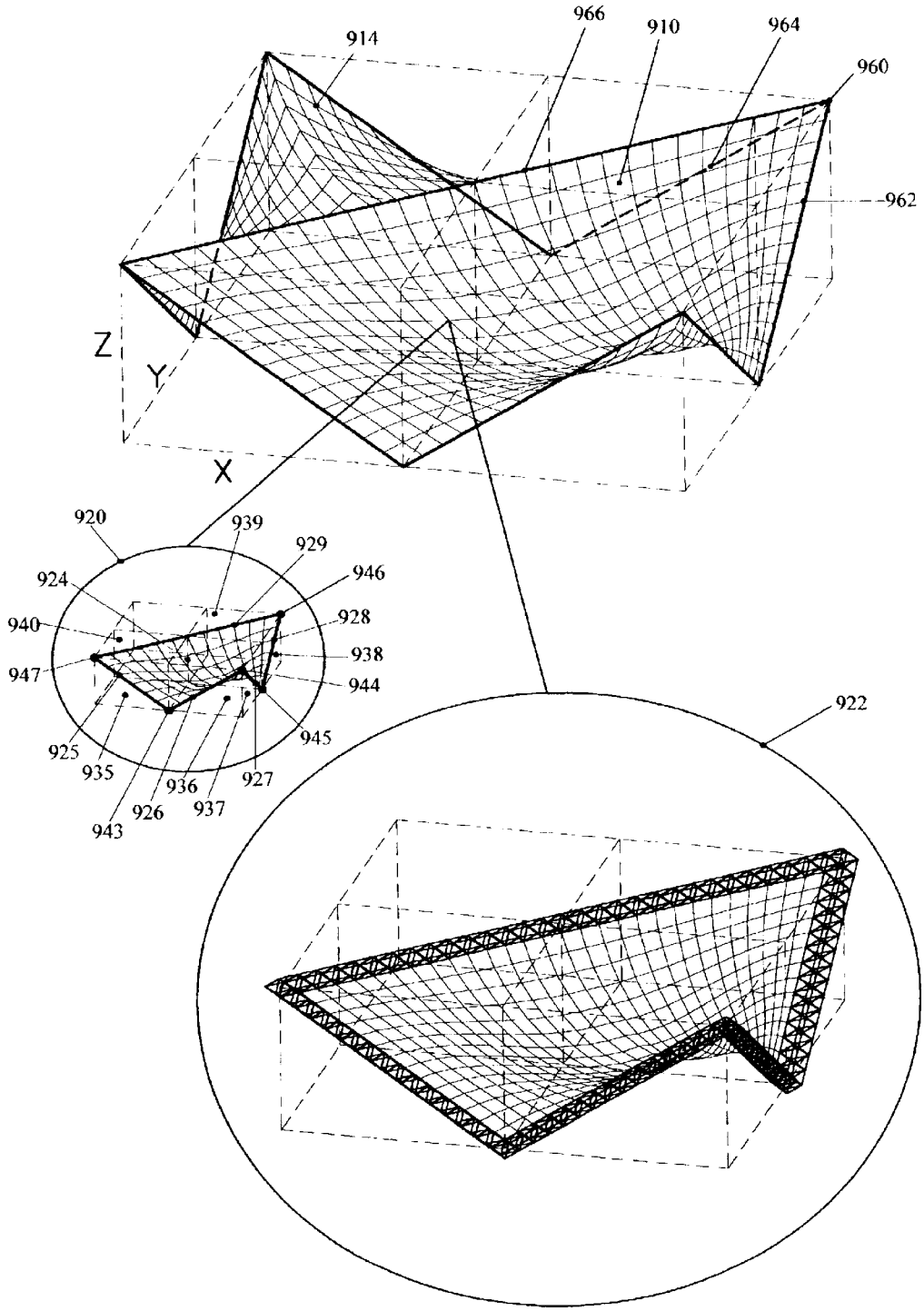
FIG. 19 is a simplified illustration of a building structure, constructed and operative in accordance with yet another preferred embodiment of the present invention.

Reference is now made to FIG. 19, which is a simplified illustration of a building structure, constructed and operative in accordance with a preferred embodiment of the present invention including two type E saddle elements as well as rigid structural elements fixed to the edges thereof and lying along diagonals of sides of non-cubic rectangular parallelepipeds. The rigid structural elements define part of an octet-like structure As seen in FIG. 19, the building structure comprises type E saddle elements 910 and 914 in two different orientations A single type E saddle element surrounded by rigid structural elements in the form of beams is shown in window 920 and a single type E saddle element surrounded by rigid structural elements in the form of trusses is shown in window 922. The use of trusses, particularly octet-like trusses, enables significantly increased dimensions to be spanned, as illustrated symbolically by the size difference between the saddle elements shown in windows 920 and 922.

It is appreciated that type E saddle elements are each circumscribed by three adjacent non-cubic rectangular parallelepipeds having a common edge, whose side dimensions X, Y & Z are not all equal. FIG. 19 illustrates a type E saddle element which is circumscribed by three adjacent rectangular parallelepipeds having a common edge, designated by reference numeral 924, whose side dimensions X, Y & Z are not all equal Type E saddle elements are characterized in that they have four edges, designated in FIG. 19 by reference numerals 925, 926, 927 and 928, each defined by a diagonal extending along a side surface of a rectangular parallelepiped, and an edge 929, which extends along side surfaces of two rectangular parallelepipeds and normally has a length greater than the length of any of the remaining four edges The side surfaces whose diagonals define edges 925, 926, 927 and 928 are respectively designated by reference numerals 935, 936, 937 and 938 The side surfaces whose diagonals define edge 929 are designated by reference numerals 939 and 940.

Figure 20:
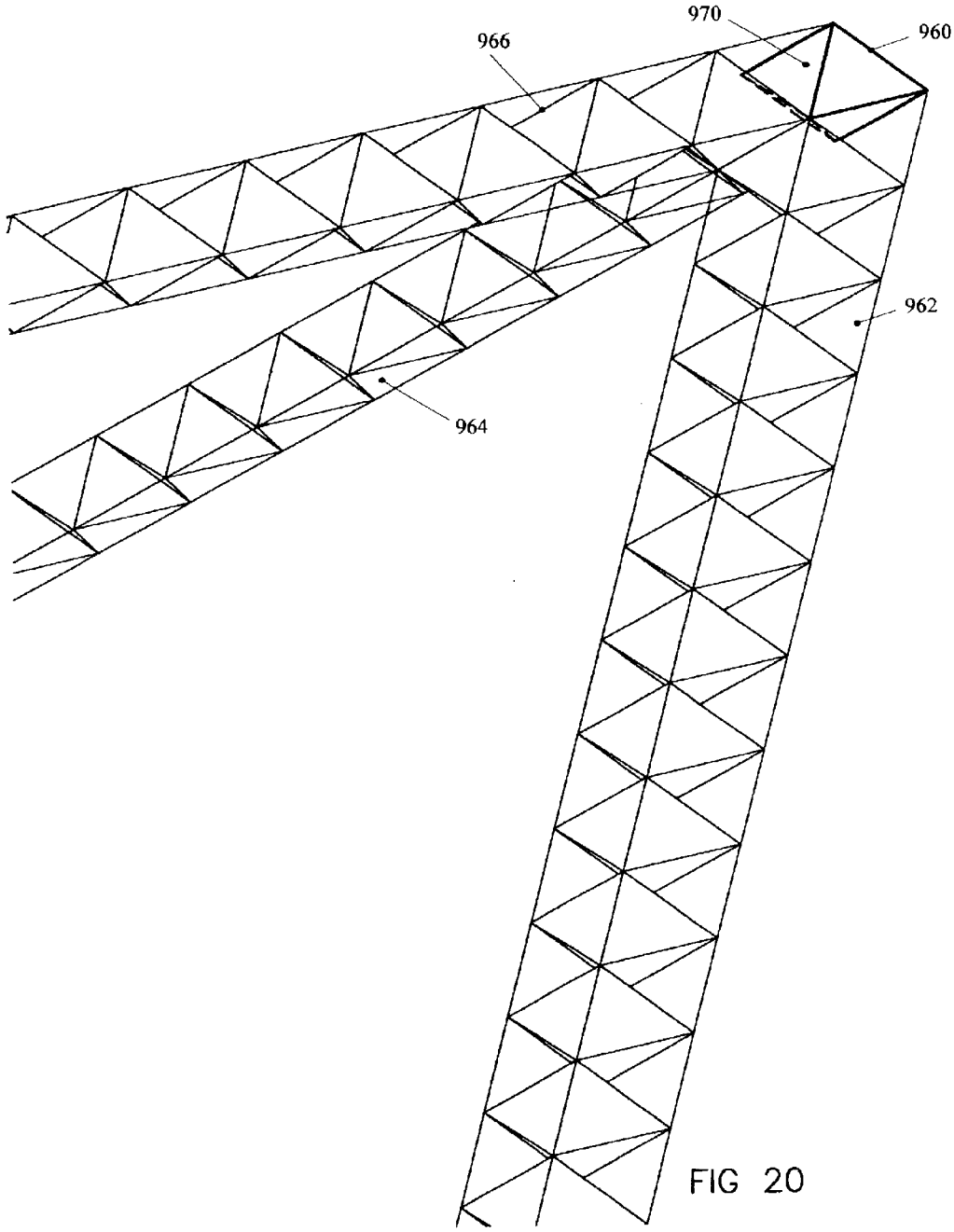
FIG. 20 is a simplified illustration of a junction of rigid structural elements in the embodiment of FIG. 19.
Figure 21:
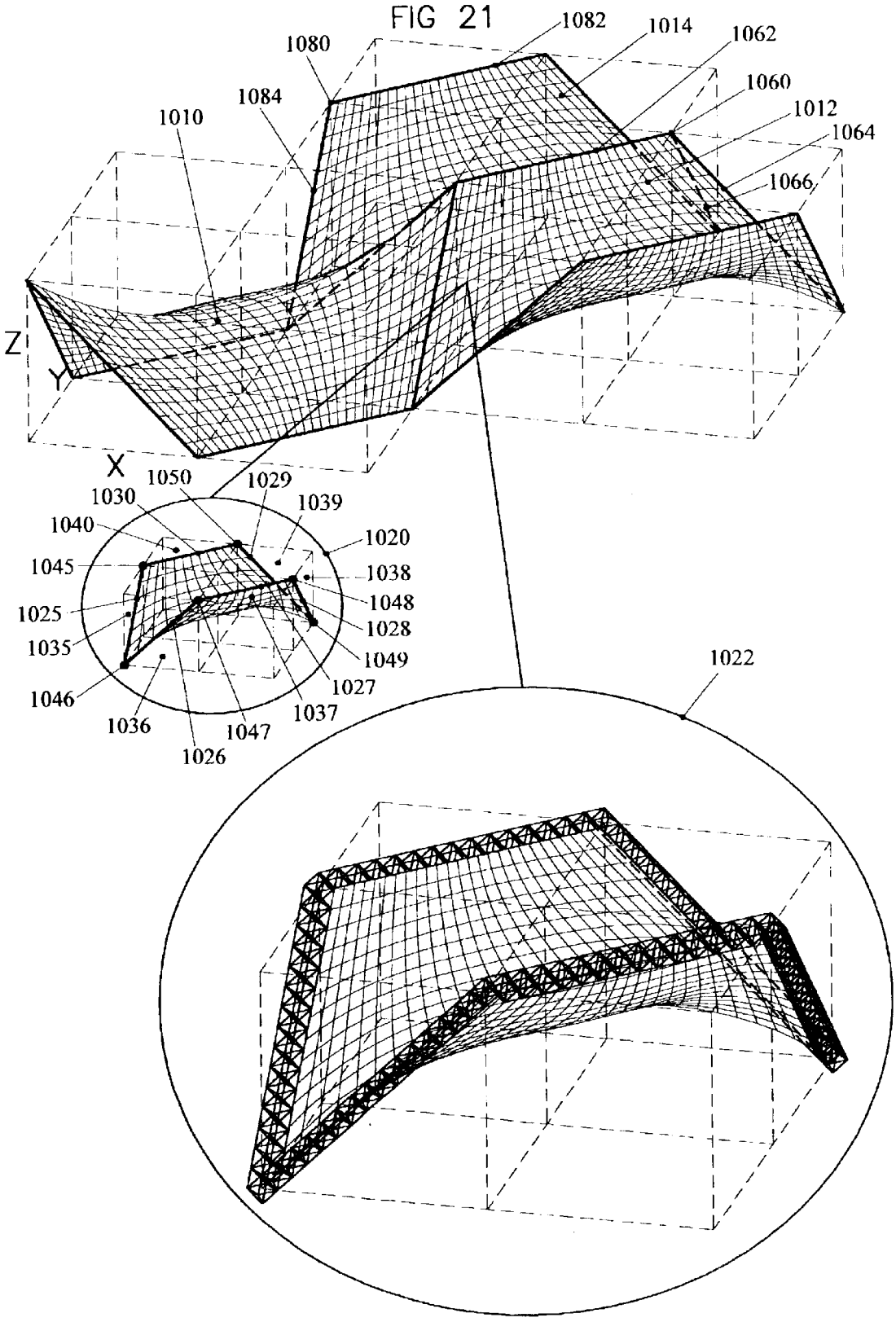
FIG. 21 is a simplified illustration of a building structure, constructed and operative in accordance with a further preferred embodiment of the present invention.

Surfaces 935 and 936 lie in the same plane, which extends perpendicular to the plane of surfaces 937 and 938 These two planes lie perpendicular to a plane of surfaces 939 and 940 Five junctions, designated by reference numerals 943, 944, 945, 946 and 947 are defined by the five edges, each junction being located at the meeting of the ends of two adjacent edges The rigid structural elements may be any suitable rigid structural elements, such as beams, as shown in window 920 According to a preferred embodiment of the present invention, rigid structural elements are constructed as trusses, most preferably as octet-like trusses, linear combinations of octahedron-like structures and tetrahedron-like structures, as shown in window 922. Rigid structural elements of this type are known, for example in U.S. Pat. No. 4,869,041, for other applications Reference is now made to FIG. 20, which is a simplified illustration of a junction of rigid structural elements in the embodiment of FIG. 19 FIG. 20 shows the junction 960 of three rigid structural elements, designated by reference numerals 962, 964 and 966 It is seen that the junction of rigid structural elements 962, 964 and 966 defines octahedron-like pair of pyramids having a common base This pair of pyramids, designated by reference numeral 970, is common to all three elements Reference is now made to FIG. 21, which is a simplified illustration of a building structure, constructed and operative in accordance with a preferred embodiment of the present invention including three type F saddle elements as well as rigid structural elements fixed to the edges thereof and lying along diagonals of sides of cubes The rigid structural elements define part of an octet structure As seen in FIG. 21, the building structure comprises type F saddle elements 1010, 1012 and 1014 in two different orientations A single type F saddle element surrounded by rigid structural elements in the form of beams arranged to define part of an octet structure is shown in window 1020 and a single type F saddle element surrounded by rigid structural elements in the form of trusses arranged to define part of an octet structure is shown in window 1022 The use of trusses, particularly octet trusses, enables significantly increased dimensions to be spanned, as illustrated symbolically by the size difference between the saddle elements shown in windows 1020 and 1022

Figure 22A:
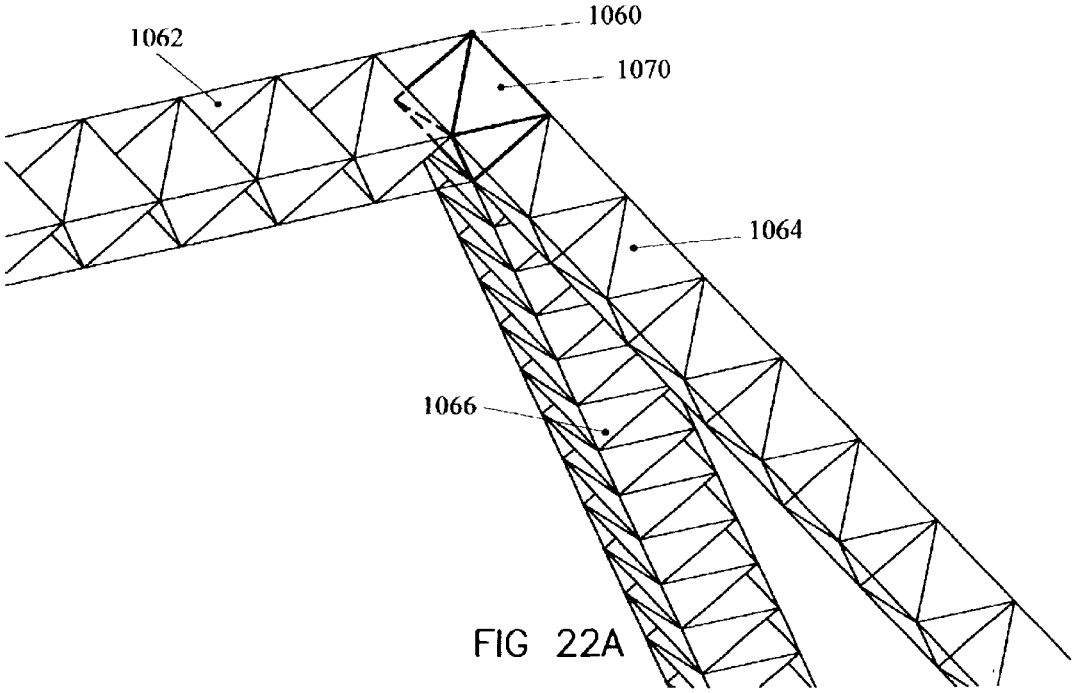
FIGS. 22A & 22B are simplified illustrations of two junctions of rigid structural elements in the embodiment of FIG. 21.
Figure 22B:
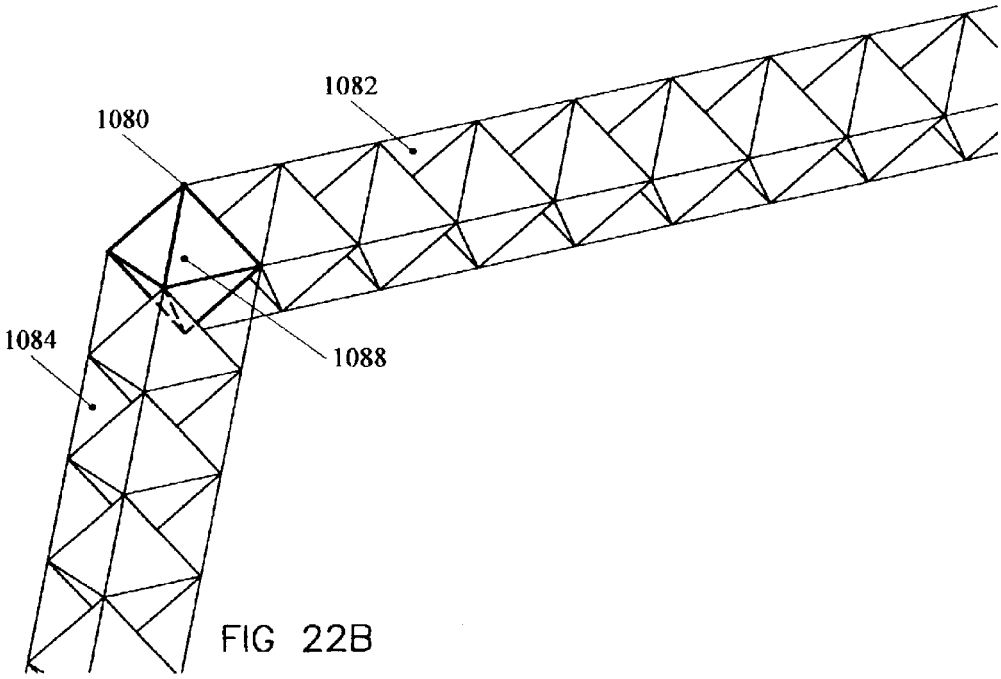

The type F saddle elements in this embodiment are characterized in that they define two 60 degree junctions and four 120 degree junctions. It is appreciated that type F saddle elements are each circumscribed by four cubes all having a common edge. FIG. 21 illustrates a type F saddle element which is circumscribed by four rectangular parallelepipeds having a common edge) and whose side dimensions X, Y & Z are all equal, thus defining cubes Type F saddle elements are characterized in that they have six edges, designated in FIG. 21 by reference numerals 1025, 1026, 1027, 1028, 1029 and 1030, each defined by a diagonal extending along a side surface of the rectangular parallelepiped The side surfaces whose diagonals define edges 1025, 1026, 1027, 1028, 1029 and 1030 are respectively designated by reference numerals 1035, 1036, 1037,

1038, 1039 and 1040 Surfaces 1037 and 1040 lie in the same plane, which extends perpendicular to the remaining surfaces 1035, 1036, 1038 and 1039 Surfaces 1035, 1030 and 1040 are all mutually perpendicular Surfaces 1035 and 1038 are in mutually parallel spaced relationship Six junctions, designated by reference numerals 1045, 1046, 1047, 1048, 1049 and 1050, are defined by the six edges, each junction being located at the meeting of the ends of two adjacent edges The rigid structural elements may be any suitable rigid structural elements, such as beams, as shown in window 1020 According to a preferred embodiment of the present invention, rigid structural elements are constructed as trusses, most preferably as octet trusses, linear combinations of octahedrons and tetrahedrons, as shown in window 1022 Rigid structural elements of this type are known, for example in U.S. Pat. No. 4,869,041, for other applications Reference is now made to FIGS. 22A & 22B, which are simplified illustrations of two junctions of rigid structural elements in the embodiment of FIG. 21 FIG. 22A shows the junction 1060 of three rigid structural elements, designated here and in FIG. 21 by reference numerals 1062, 1064 and 1066 It is seen that the junction of rigid structural elements 1062, 1064 and 1066 defines an octahedron 1070, which is common to all three elements FIG. 22B shows the junction 1080 of two rigid structural elements, designated here and in FIG. 21 by reference numerals 1082 and 1084. It is seen that the junction of rigid structural elements 1082 and 1084 is also an octahedron 1088, which is common to both elements Reference is now made to FIG. 23, which is a simplified illustration of a building, structure, constructed and operative in accordance with another preferred embodiment of the present invention including three type F saddle elements as well as rigid structural elements fixed to the edges thereof and lying along diagonals of sides of non-cubic rectangular parallelepipeds The rigid structural elements define part of an octet-like structure As seen in FIG. 23 the building structure comprises type F saddle elements 1110, 1112 and 1114 in two different orientations A single type F saddle element surrounded by rigid structural elements in the form of beams is shown in window 1120 and a single type F saddle element surrounded by rigid structural elements in the form of trusses is shown in window 1122 The use of trusses, particularly octet-like trusses, enables significantly increased dimensions to be spanned, as illustrated symbolically by the size difference between the saddle elements shown in windows 1120 and 1122

The type F saddle elements in this embodiment are characterized in that they define six junctions which are not necessarily identical It is appreciated that type F saddle elements are each circumscribed by a single rectangular parallelepiped, whose side dimensions X, Y & Z may be, but need not be, equal. FIG. 23 illustrates a type F saddle element which is circumscribed by three rectangular parallelepipeds, whose side dimensions X,Y & Z are not all equal Type F saddle elements are characterized in that they have six edges, designated in FIG. 21 by reference numerals 1125, 1126, 1127, 1128, 1129 and 1130, each defined by a diagonal extending along a side surface of the rectangular parallelepiped The side surfaces whose diagonals define edges 1125, 1126, 1127, 1128, 1129 and 1130 are respectively designated by reference numerals 1135, 1136, 1137, 1138, 1139 and 1140 Surfaces 1137 and 1140 lie in the same plane, which extends perpendicular to the remaining surfaces 1135, 1136, 1138 and 1139 Surfaces 1135, 1136 and 1140 are all mutually perpendicular Surfaces 1135 and 1138 are in mutually parallel spaced relationship Six junctions, designated by reference numerals 1145, 1146, 1147, 1148, 1149 and 1150, are defined by the six edges, each junction being located at the meeting of the ends of two adjacent edges The rigid structural elements may be any suitable rigid structural elements, such as beams, as shown in window 1120. According to a preferred embodiment of the present invention, rigid structural elements are constructed as trusses most preferably as octet-like trusses, linear combinations of octahedron-like structures and tetrahedron-like structures, as shown in window 1122

Figure 23:
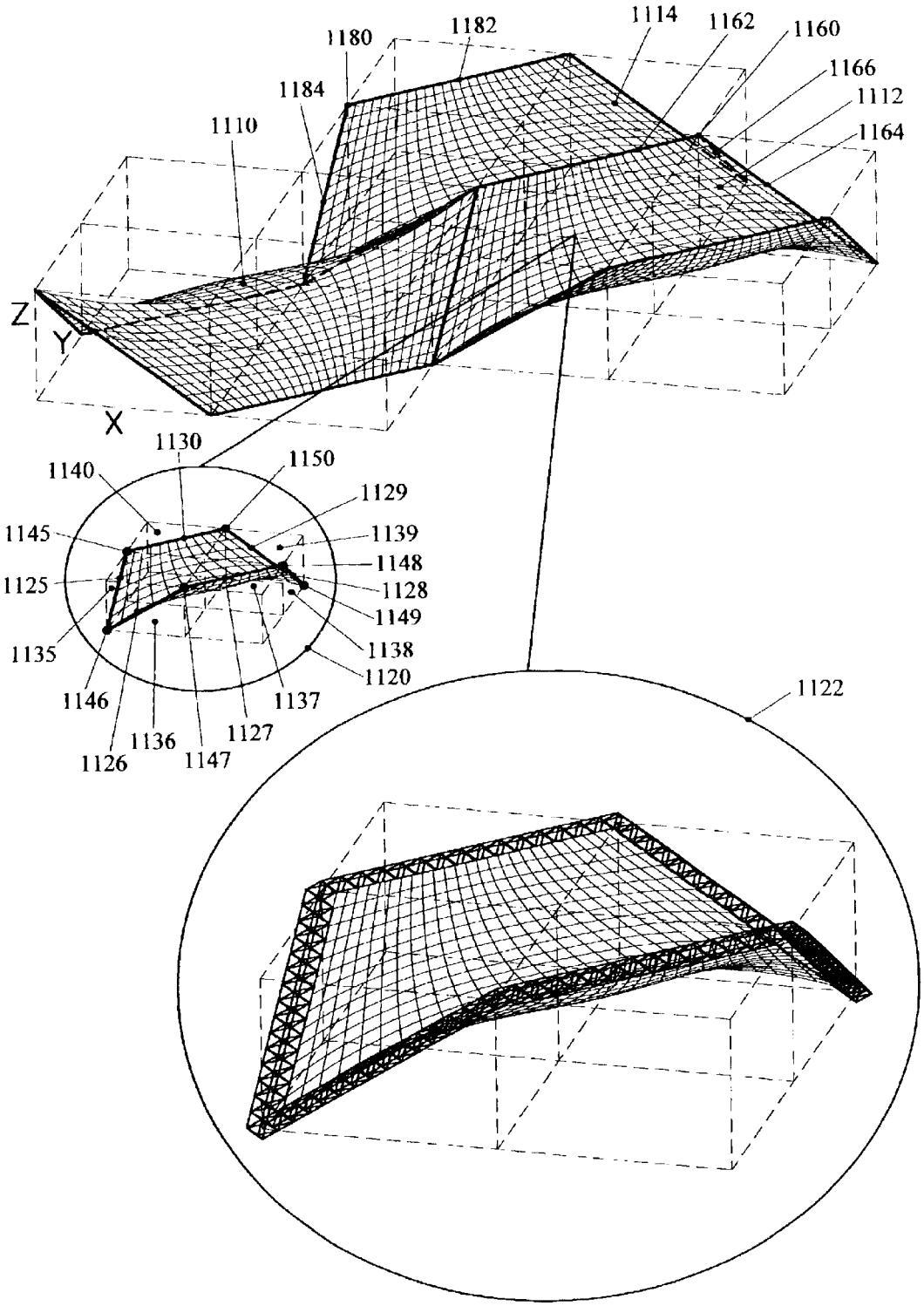
FIG. 23 is a simplified illustration of a building structure, constructed and operative in accordance with another preferred embodiment of the present invention.
Figure 24A:
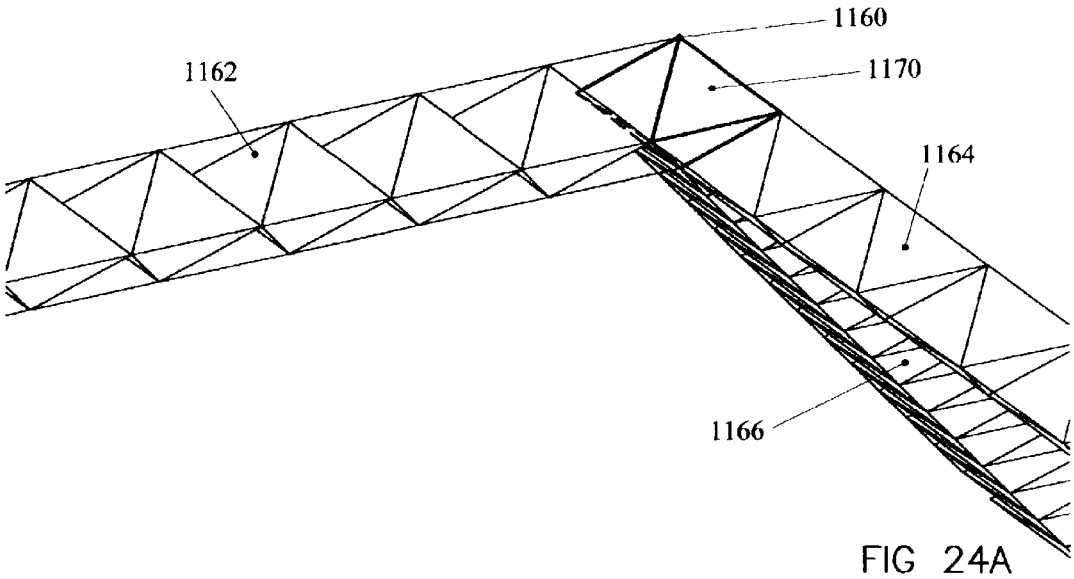
FIGS. 24A & 24B are simplified illustrations of two junctions of rigid structural elements in the embodiment of FIG. 23.
Figure 24B:
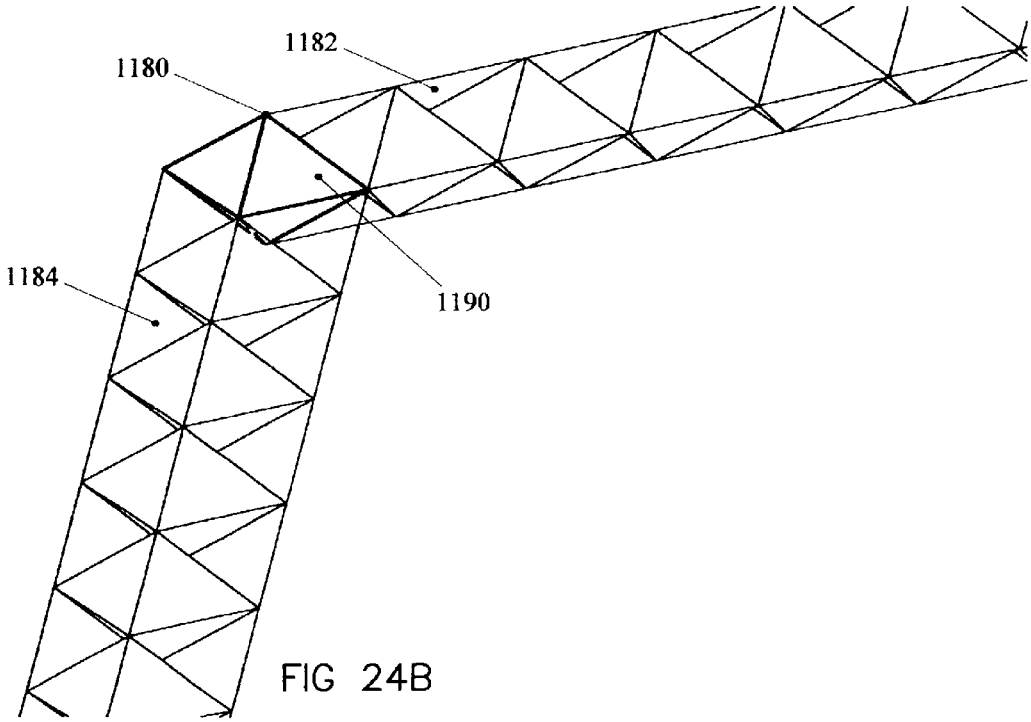
Figure 25:
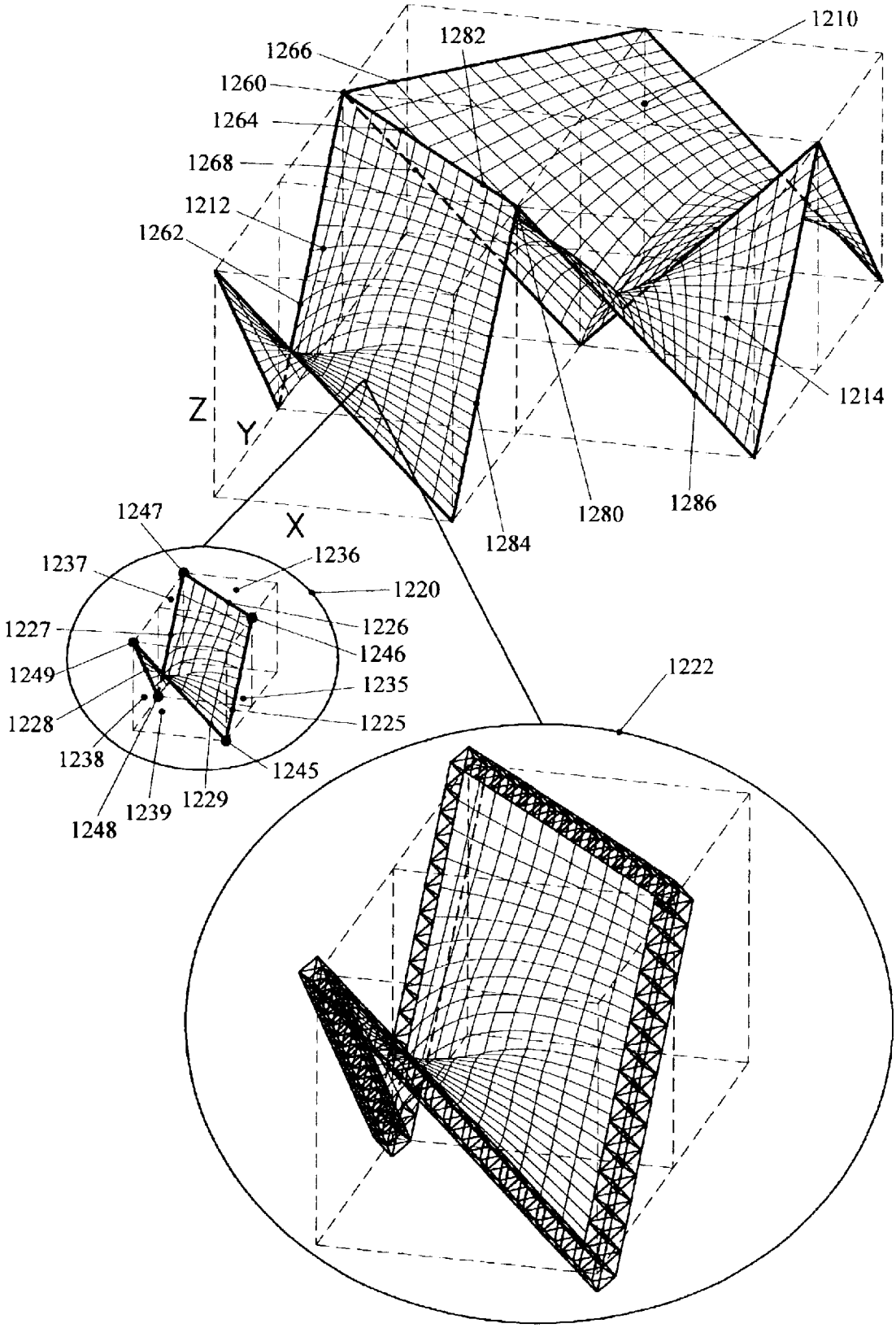
FIG. 25 is a simplified illustration of a building structure, constructed and operative in accordance with a still further preferred embodiment of the present invention.

Reference is now made to FIGS. 24A & 24B, which are simplified illustrations of two junctions of rigid structural elements in the embodiment of FIG. 23 FIG. 24A shows the junction 1160 of three rigid structural elements, designated here and in FIG. 23 by reference numerals 1162, 1164 and 1166 It is seen that the junction of rigid structural elements 1162, 1164 and 1166 defines an octahedron-like pair of pyramids having a common base This pair of pyramids, designated by reference numeral 1170, is common to all three elements FIG. 24B shows a junction 1180 of two rigid structural elements designated here and in FIG. 23 by reference numerals 1182 and 1184 It is seen that the junction of rigid structural elements 1182 and 1184 is also an octahedron-like pair of pyramids leaving a common base This pair of pyramids, designated by reference numeral 1190, is common to both elements Reference is now made to FIG. 25, which is a simplified illustration of a building structure, constructed and operative in accordance with a preferred embodiment of the present invention including three type G saddle elements as well as rigid structural elements fixed to the edges thereof and lying along diagonals of sides of cubes The rigid structural elements define part of an octet structure.

As seen in FIG. 25, the building structure comprises type G saddle elements 1210, 1212 and 1214 in two different orientations A single type G saddle elements surrounded by rigid structural elements in the form of beams arranged to define part of an octet structure is shown in window 1220 and a single type G saddle element surrounded by rigid structural elements in the form of trusses arranged to define part of an octet structure is shown in window 1222 The use of trusses, particularly octet trusses, enables significantly increased dimensions to be spanned, as illustrated symbolically by the size difference between the saddle elements shown in windows 1920 and 1222

The type G saddle elements in this embodiment are characterized in that they define three 60 degree junctions and one 90 degree junction and one 120 degree junction It is appreciated that type C saddle elements are each circumscribed by two cubes all having, a common side surface FIG. 25 illustrates a type G saddle element which is circumscribed by two rectangular parallelepipeds having a common edge and whose side dimensions X, Y & Z are all equal, thus defining cubes Type G saddle elements are characterized in that they have five edges, designated in FIG. 25, by reference numerals 1225, 1226, 1227, 1228 and 1229 each defined by a diagonal extending along a side surface of the rectangular parallelepiped The side surfaces whose diagonals define edges 1225, 1226, 1227, 1228 and 1229 are respectively designated by reference numerals 1235, 1236, 1237, 1238 and 1239. Surfaces 1237 and 1238 lie in the same plane, which extends parallel to and in spaced relationship to surface 1235 Surfaces 1235, 1237 and 1238 are perpendicular to the remaining surfaces 1236 and 1239, which are mutually perpendicular.

Figure 26A:
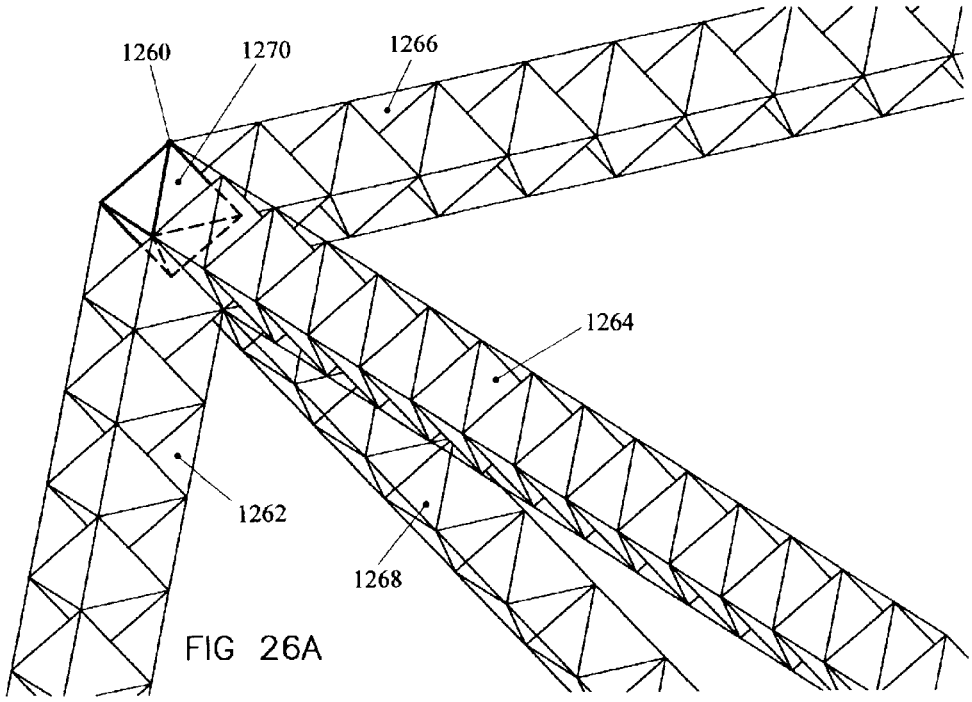
FIGS. 26A & 26B are simplified illustrations of two junctions of rigid structural elements in the embodiment of FIG. 25.
Figure 26B:
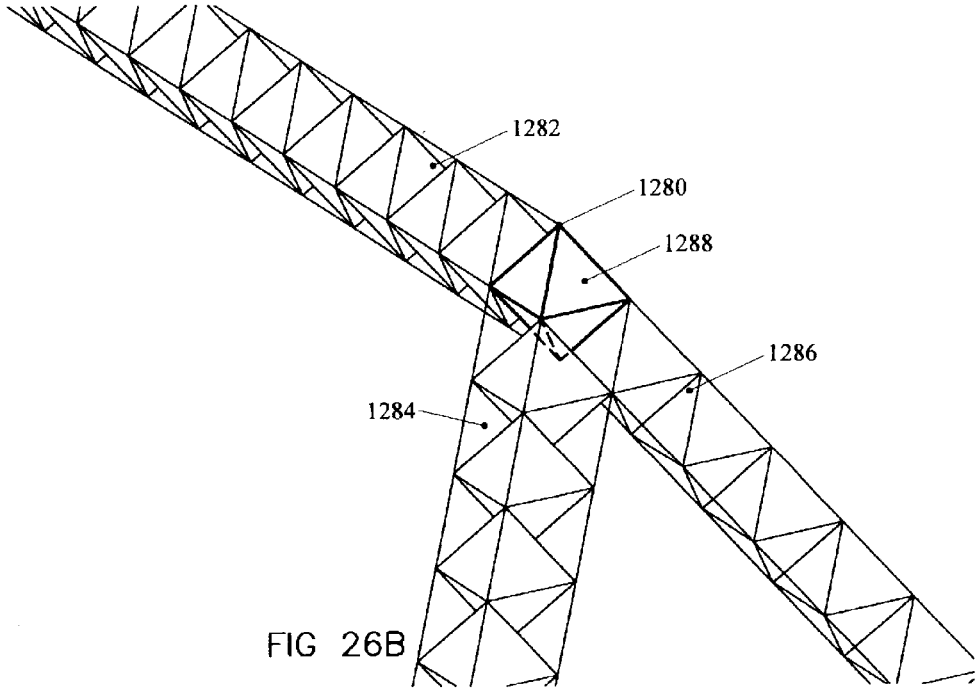

Five junctions, designated by reference numerals 1245, 1246, 1247, 1248 and 1249, are defined by the five edges, each junction being located at the meeting of the ends of two adjacent edges The rigid structural elements may be any suitable rigid structural elements, such as beams, as shown in window 1220 According to a preferred embodiment of the present invention, rigid structural elements are constructed as trusses, most preferably as octet trusses, linear combinations of octahedrons and tetrahedrons, as shown in window 1222. Rigid structural elements of this type are known for example in U.S. Pat. No. 4,869,041, for other applications Reference is now made to FIGS. 26A & 26B, which are simplified illustrations of two junctions of rigid structural elements in the embodiment of FIG. 25 FIG. 26A shows the junction 1260 of four rigid structural elements, designated here and in FIG. 25 by reference numerals 1262, 1264, 1266 and 1268 It is seen that the junction of rigid structural elements 1262, 1264, 1266 and 1268 defines an octahedron 1270, which is common to all four elements FIG. 26B shows the junction 1280 of three rigid structural elements, designated here and in FIG. 25 by reference numerals 1282, 1284 and 1286 It is seen that the junction of rigid structural elements 1282, 1284 and 1286 is also an octahedron 1288, which is common to all three elements.

Figure 27:
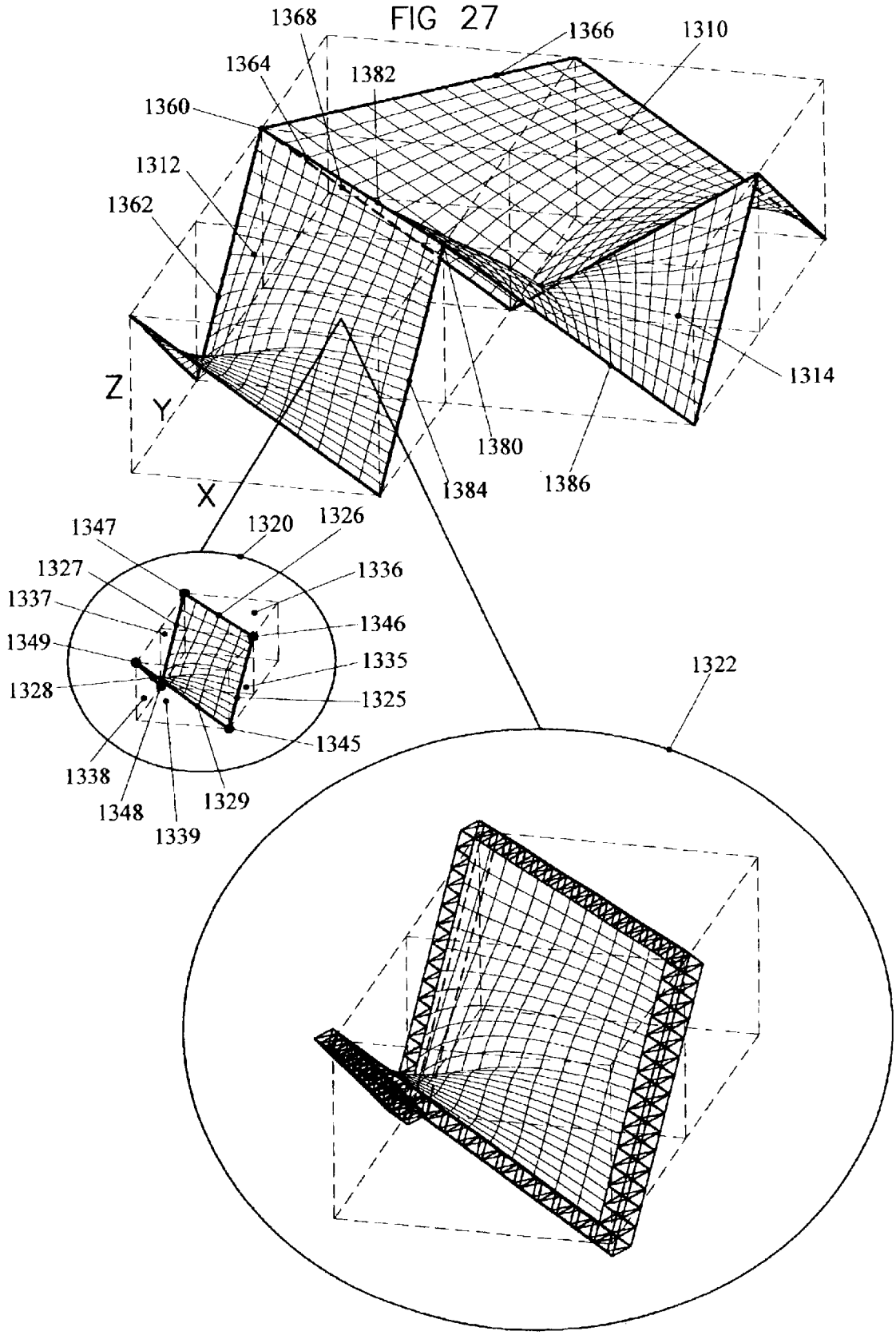
FIG. 27 is a simplified illustration of a building structure, constructed and operative in accordance with another preferred embodiment of the present invention.

Reference is now made to FIG. 27, which is a simplified illustration of a building structure, constructed and operative in accordance with another preferred embodiment of the present invention including three type G saddle elements as well as rigid structural elements fixed to the edges thereof and lying along diagonals of sides of non-cubic rectangular parallelepipeds The rigid structural elements define part of an octet-like structure As seen in FIG. 27, the building structure comprises type G saddle elements 1310, 1312 and 1314 in three different orientations A single type G saddle element surrounded by rigid structural elements in the form of beams is shown in window 1320 and a single type G saddle element surrounded by rigid structural elements in the form of trusses is shown in window 1322 The use of trusses, particularly octet-like trusses, enables significantly increased dimensions to be spanned, as illustrated symbolically by the size difference between the saddle elements shown in windows 1320 and 1322.

The type G saddle elements in this embodiment are characterized in that they define five junctions which are not necessarily identical. It is appreciated that type G saddle elements are each circumscribed by a single rectangular parallelepiped, whose side dimensions X, Y & Z may be, but need not be, equal. FIG. 27 illustrates a type G saddle element which is circumscribed by two rectangular parallelepipeds, whose side dimensions X, Y & Z are not all equal.

Type G saddle elements are characterized in that they have five edges, designated in FIG. 27 by reference numerals 1325, 1326, 1327, 1328 and 1329, each defined by a diagonal extending along a side surface of the rectangular parallelepiped. The side surfaces whose diagonals define edges 1325, 1326, 1327, 1328 and 1329 are respectively designated by reference numerals 1335, 1336, 1337, 1338 and 1339 Surfaces 1337 and 1338 lie in the same plane, which extends parallel to and in spaced relationship to surface 1335 Surfaces 1335, 1337 and 1338 are perpendicular to the remaining surfaces 1336 and 1339, which are mutually perpendicular Five junctions, designated by reference numerals 1345, 1346, 1347, 1348 and 1349, are defined by the five edges, each junction being located at the meeting of the ends of two adjacent edges The rigid structural elements may be any suitable rigid structural elements, such as beams, as shown in window 1320 According to a preferred embodiment of the present invention, rigid structural elements are constructed as trusses, most preferably as octet-like trusses, linear combinations of octahedron-like structures and tetrahedron-like structures, as shown in window 1322

Figure 28A:
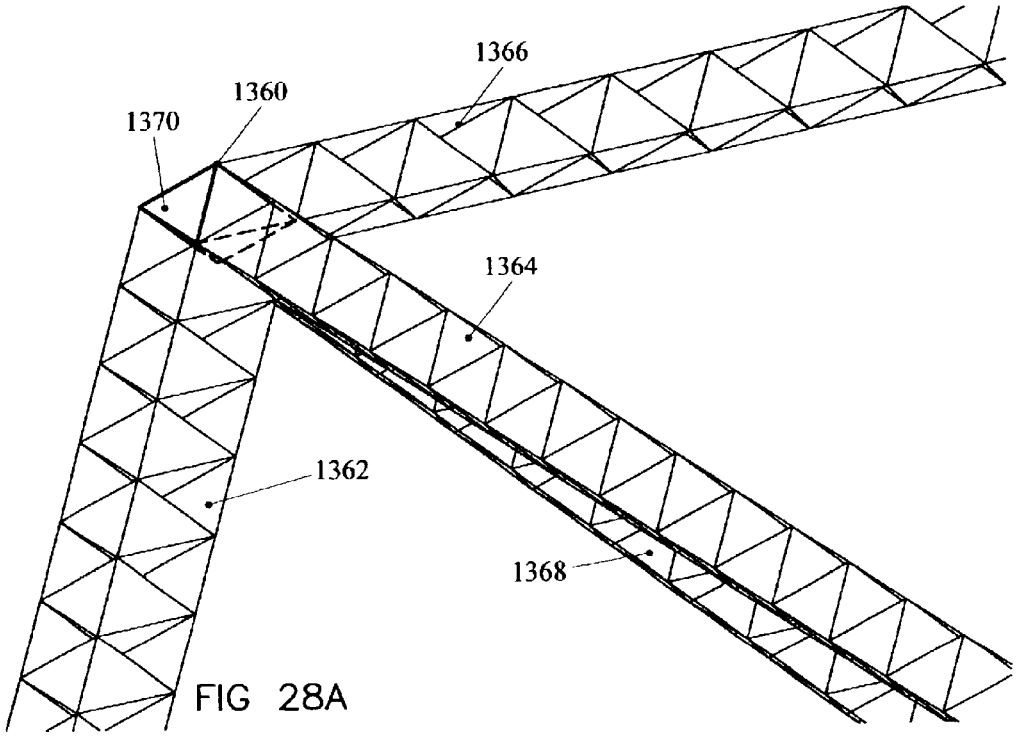
FIGS. 28A & 28B are simplified illustrations of two junctions of rigid structural elements in the embodiment of FIG. 27, FIGS. 29A, 29B, 29C and 29D are simplified illustrations of four variations of rigid structural elements useful in various embodiments of the present invention.
Figure 28B:
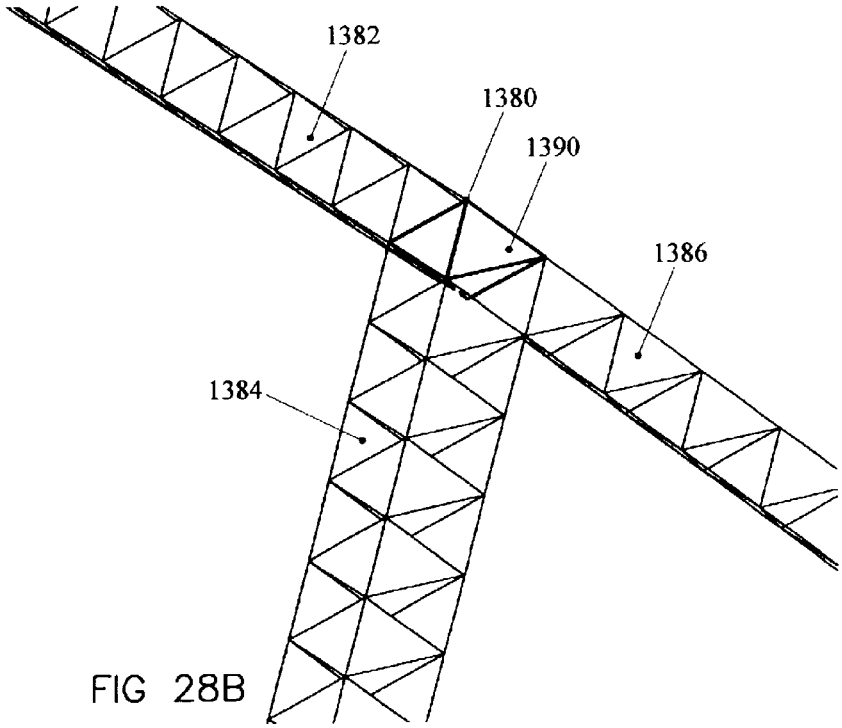

Reference is now made to FIGS. 28A & 28B, which are simplified illustrations of two junctions of rigid structural elements in the embodiment of FIG. 27 FIG. 28A shows the junction 1360 of four rigid structural elements, designated by reference numerals 1362, 1364, 1366 and 1368 It is seen that the junction of rigid structural elements 1362, 1364, 1366 and 1368 defines an octahedron-like pair of pyramids having a common base This pair of pyramids, designated by reference numeral 1370, is common to all three elements FIG. 28B shows a junction 1380 of three rigid structural elements designated here and in FIG. 27 by reference numerals 1382, 1384 and 1386. It is seen that the junction of rigid structural elements 1382, 1384 and 1386 is also an octahedron-like pair of pyramids having a common base This pair of pyramids, designated by reference numeral 1390, is common to both elements.

Figure 29A:
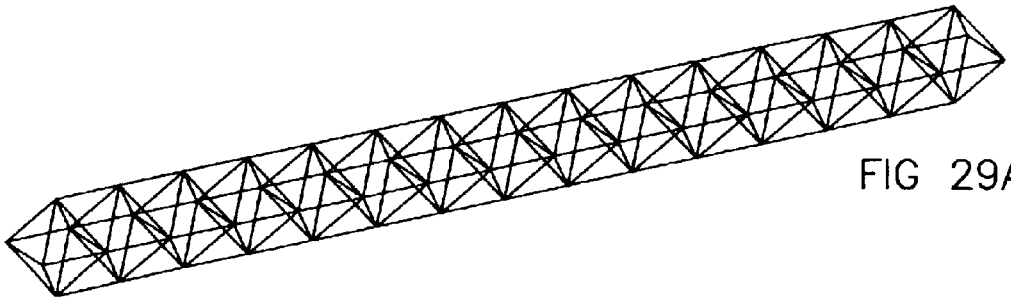

Reference is now made to FIGS. 29A, 29B, 29C and 29D, which are simplified illustrations of four variations of rigid structural elements useful in various embodiments of the present invention FIG. 29A illustrates a truss structure comprising a linear arrangement of octahedrons and tetrahedrons defining an octet geometry The truss structure is formed of struts having identical lengths and octet joints.

Figure 29B:
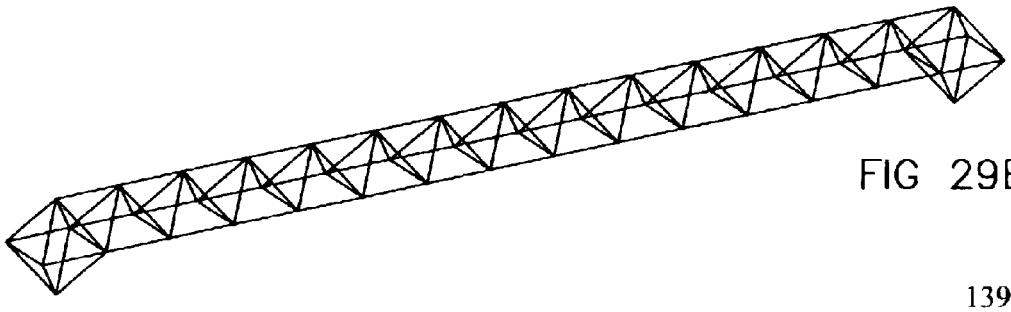

FIG. 29B illustrates a truss structure comprising a linear arrangement of half-octahedrons and tetrahedrons defining an octet geometry The truss structure is formed of struts having identical lengths and octet joints This structure is more economical in terms of material than that of FIG. 29A.

Figure 29C:
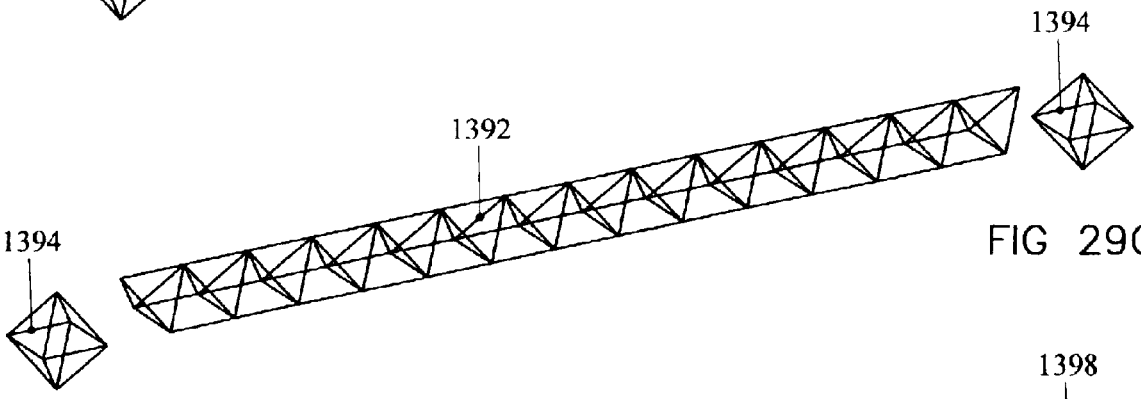
Figure 29D:
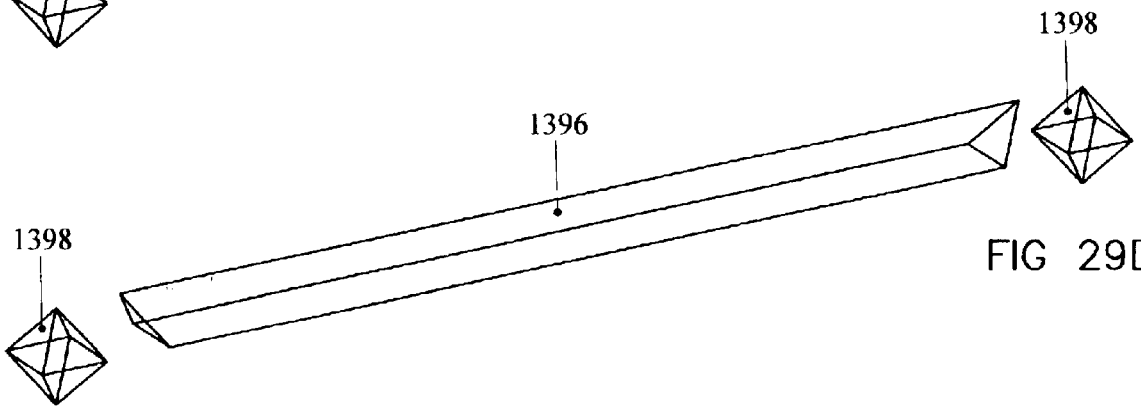
Figure 30A:
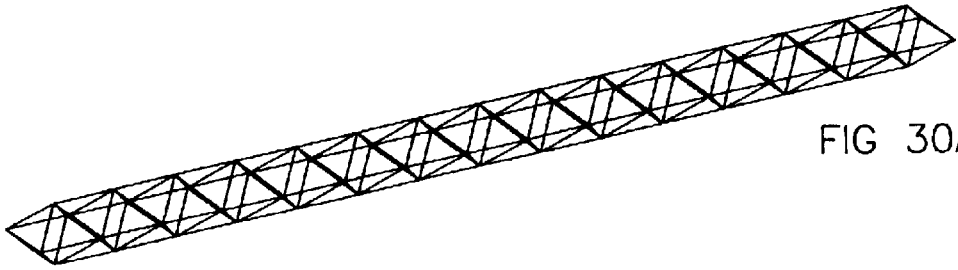
FIGS. 30A, 30B, 30C and 30D are simplified illustrations of an additional four variations of rigid structural elements useful in various embodiments of the present invention.

FIG. 29C illustrates a truss structure comprising a prefabricated linear arrangement 1392 of half-octahedrons and tetrahedrons defining an octet geometry such as that in FIG. 29B, or alternatively that in FIG. 29A, which may be coupled on-site with octahedron elements 1394 to define various structures FIG. 29D illustrates a truss structure comprising a prefabricated linear rigid structural element 1396 of any suitable construction, which may be coupled on-site with octahedron elements 1398 to define various structures Reference is now made to FIGS. 30A, 30B, 30C and 30D, which are simplified illustrations of four further variations of rigid structural elements useful in various embodiments of the present invention FIG. 30A illustrates a truss structure comprising a linear arrangement of octahedron-like structures and tetrahedron-like structures defining an octet-like geometry The truss structure is formed of struts having octet-like joints.

Figure 30B:
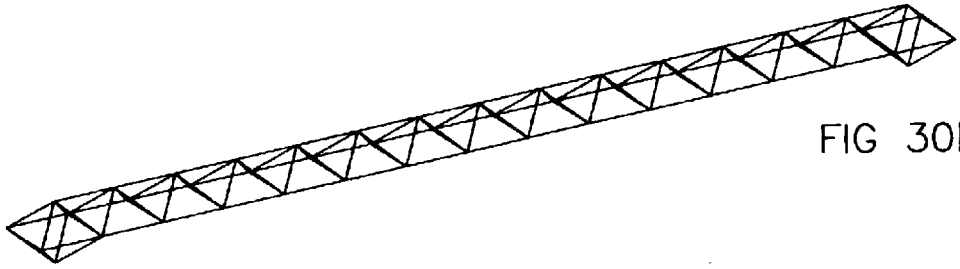

FIG. 30B illustrates a truss structure comprising a linear arrangement of half-octahedron-like structures and tetrahedron-like structures defining an octet-like geometry The truss structure is formed of struts octet-like joints In certain cases, this structure is more economical in terms of material than that of FIG. 30A.

Figure 30C:
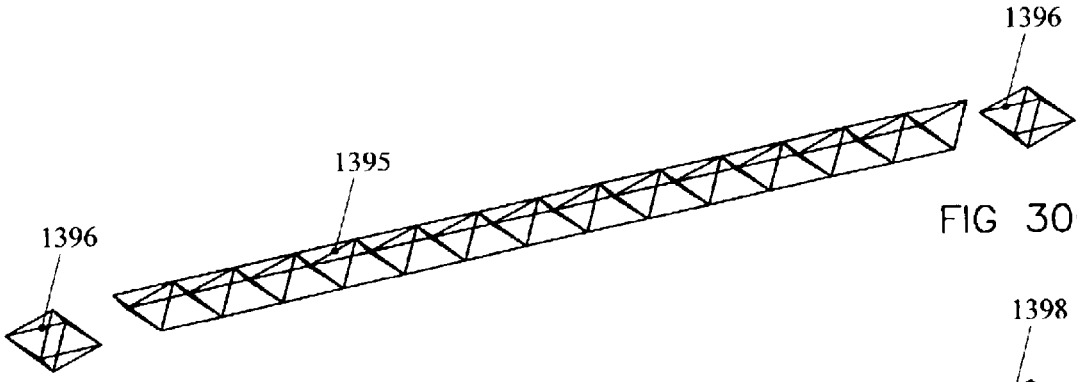
Figure 30D:
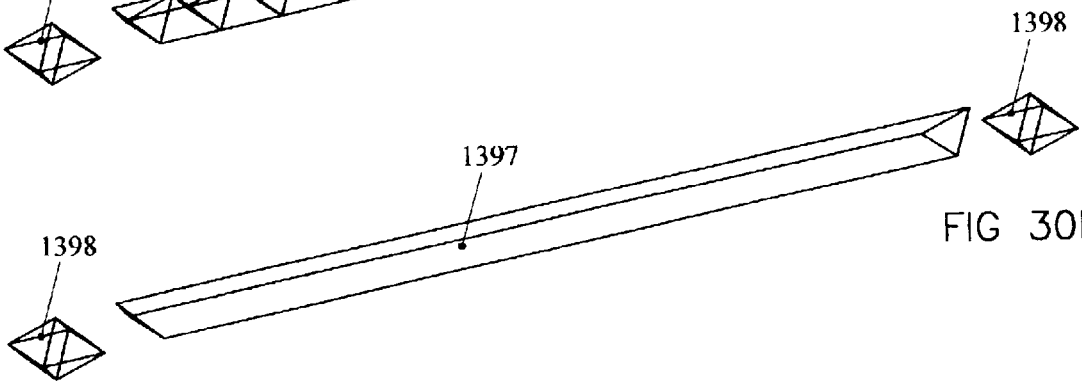

FIG. 30C illustrates a truss structure comprising a prefabricated linear arrangement 1395 of half-octahedron-like structures and tetrahedron-like structures defining an octet geometry such as that in FIG. 30B, or alternatively that in FIG. 30A, which may be coupled on-site with octahedron-like structure elements 1396 to define various structures FIG. 30D illustrates a truss structure comprising a prefabricated linear rigid structural element 1397 of any suitable construction, which may be coupled on-site with octahedron-like structure elements 1398 to define various structures It is appreciated that truss structures which are combinations of the truss structures described hereinabove may also be employed The various truss structures may also be provided with additional reinforcement along all or part of their length Pretensioned rigid structural elements and any other suitable rigid structural elements may also be employed.

Figure 31A:
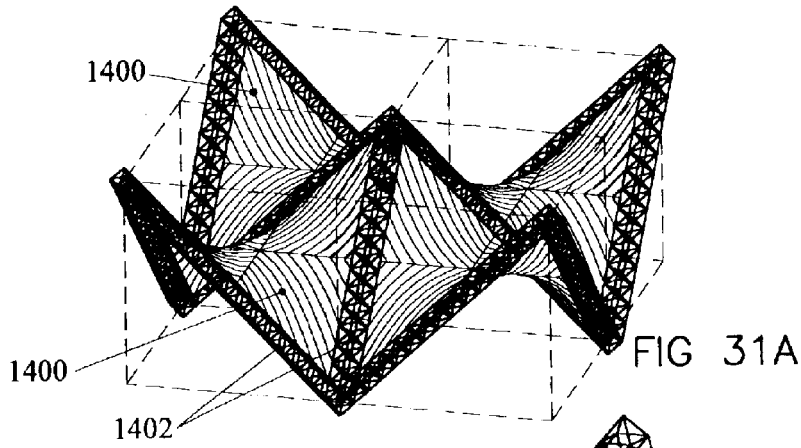
FIGS. 31A and 31B are respective isometric and perspective illustrations of a structure constructed and operative in accordance with another preferred embodiment of the present invention.
Figure 31B:
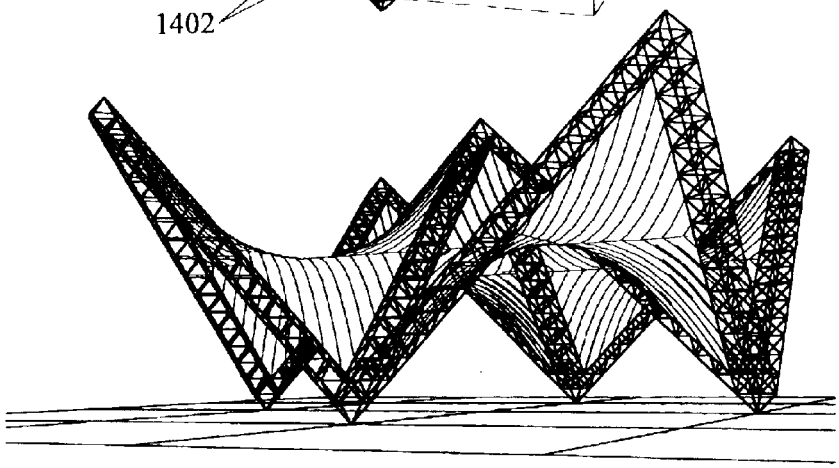
Figure 32A:
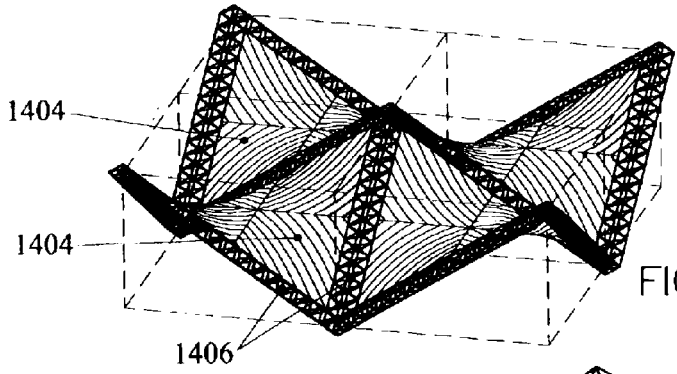
FIGS. 32A and 32B are respective isometric and perspective illustrations of a structure constructed and operative in accordance with yet another preferred embodiment of the present invention.
Figure 32B:
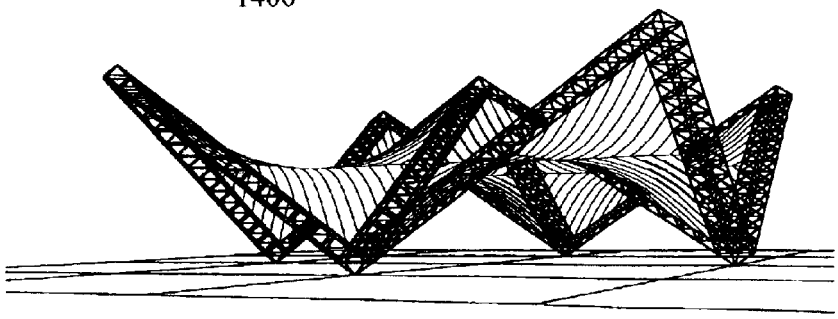

Reference is now made to FIGS. 31A and 31B, which are respective isometric and perspective illustrations of a structure comprising four type A saddle elements 1400, in two different orientations, arranged in an octet structure and rigid structural elements 1402 incorporating an octet truss structure Reference is now made to FIGS. 32A and 32B, which are respective isometric and perspective illustrations of a structure comprising four type A saddle elements 1404 in two different orientations arranged in an octet-like structure and rigid structural elements 1406 incorporating an octet-like truss structure.

Figure 33A:
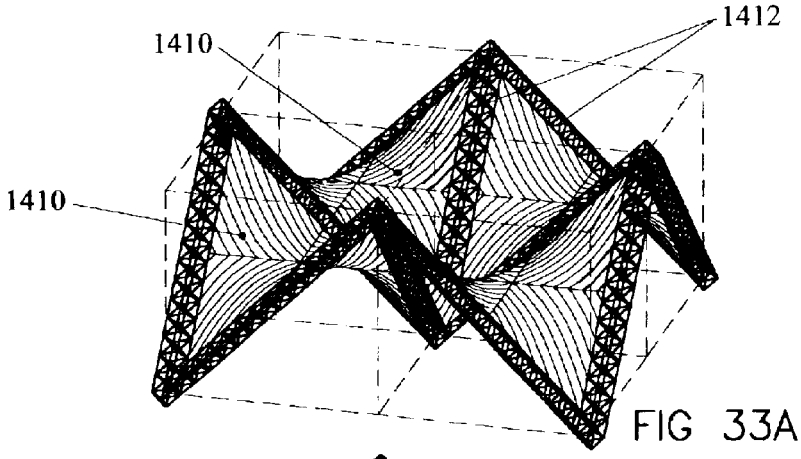
FIGS. 33A and 33B are respective isometric and perspective illustrations of a structure constructed and operative in accordance with still another preferred embodiment of the present invention.
Figure 33B:
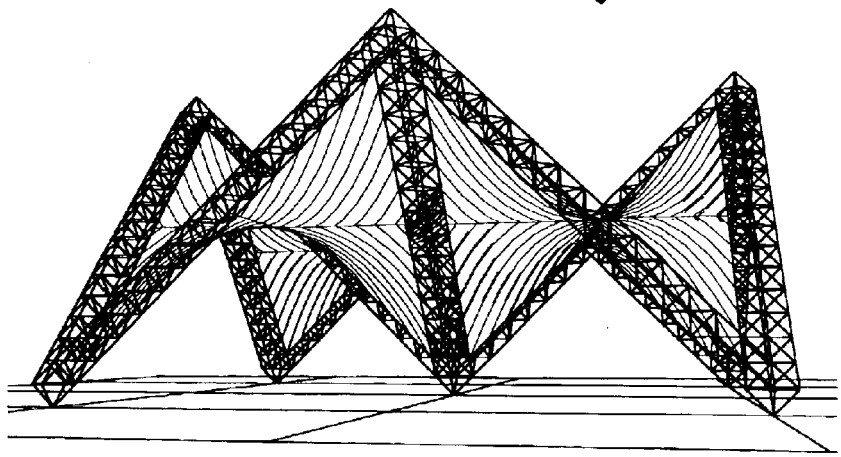
Figure 34A:
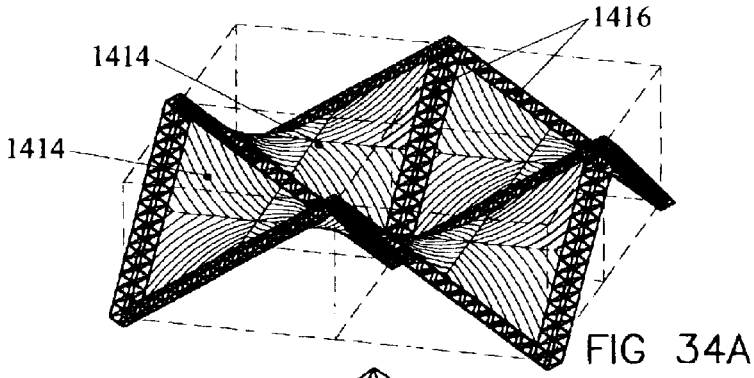
FIGS. 34A and 34B are respective isometric and perspective illustrations of a structure constructed and operative in accordance with another preferred embodiment of the present invention.
Figure 34B:
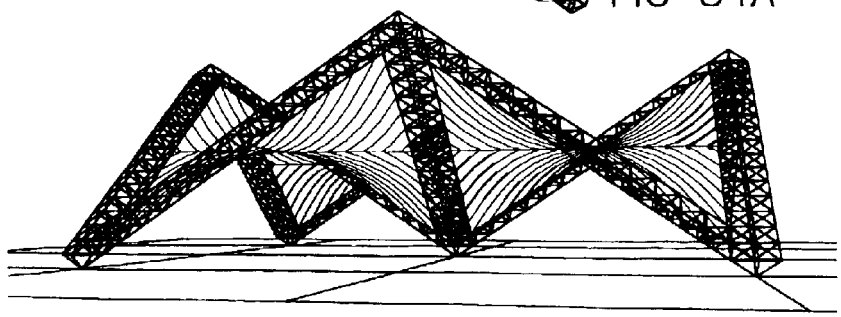
Figure 35A:
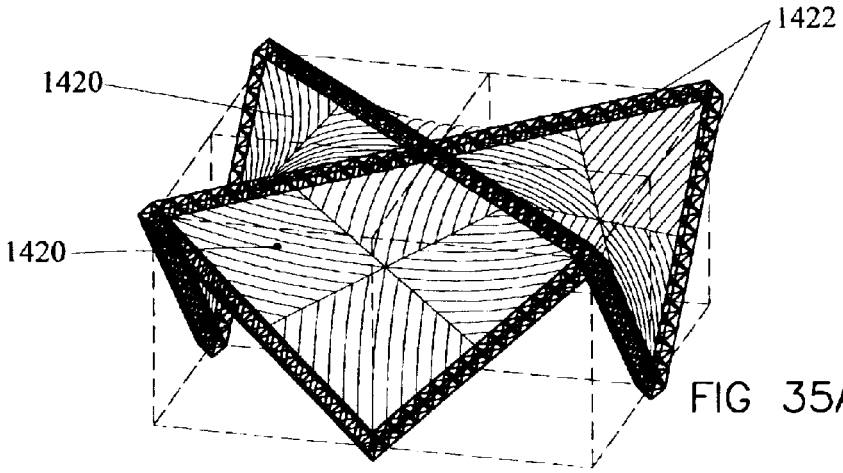
FIGS. 35A and 35B are respective isometric and perspective illustrations of a structure constructed and operative in accordance with yet another preferred embodiment of the present invention.
Figure 35B:
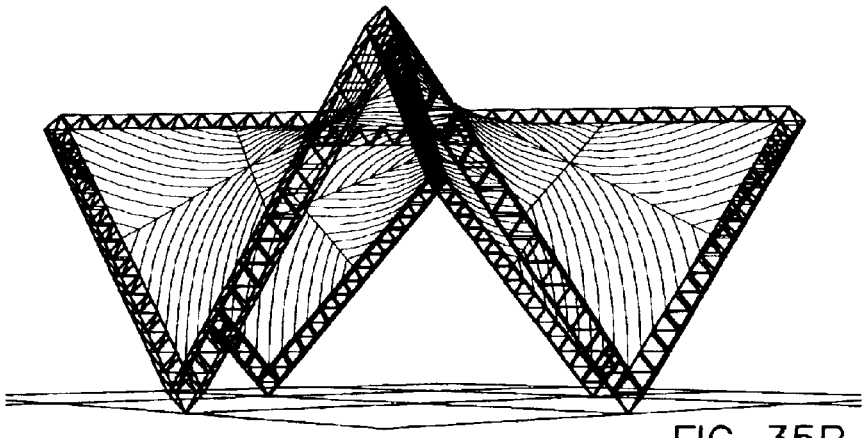
Figure 36A:
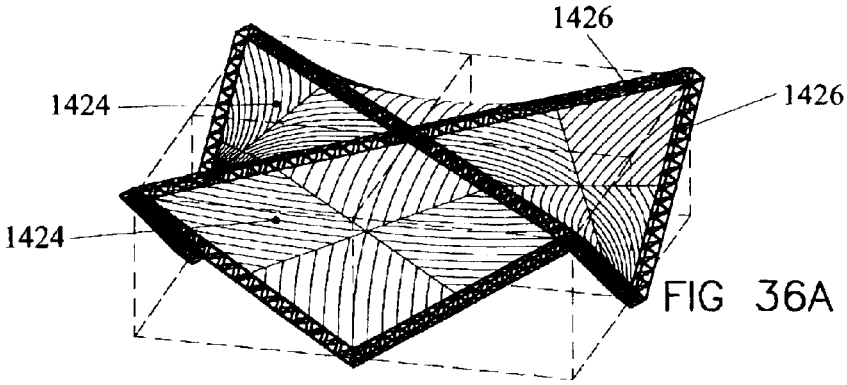
FIGS. 36A and 36B are respective isometric and perspective illustrations of a structure constructed and operative in accordance with still another preferred embodiment of the present invention.
Figure 36B:
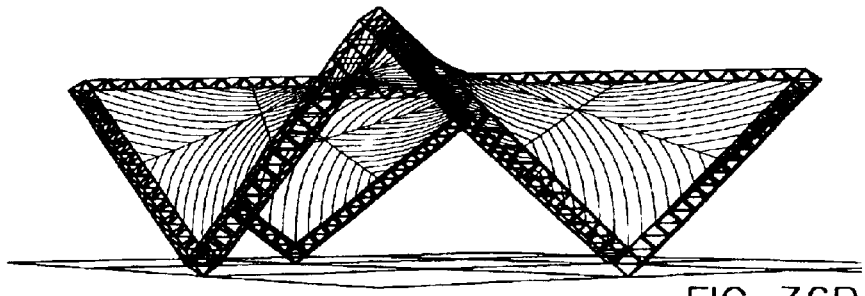
Figure 37A:
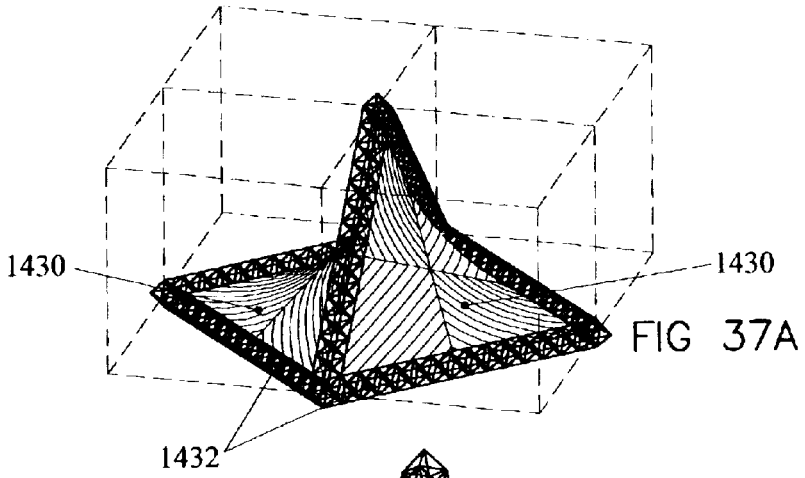
FIGS. 37A and 37B are respective isometric and perspective illustrations of a structure constructed and operative in accordance with another preferred embodiment of the present invention.
Figure 37B:
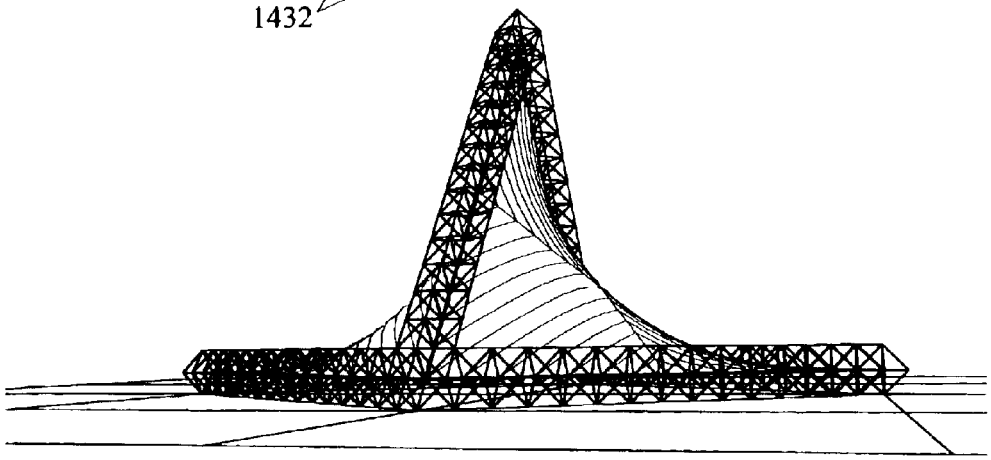

Reference is now made to FIGS. 33A and 33B, which are respective isometric and perspective illustrations of a structure comprising four type A saddle elements 1410, in two different orientations, arranged in an octet structure and rigid structural elements 1412 incorporating an octet truss structure Reference is now made to FIGS. 34A and 34B, which are respective isometric and perspective illustrations of a structure comprising four type A saddle elements 1414 in two different orientations arranged in an octet-like structure and rigid structural elements 1416 incorporating an octet-like truss structure It is noted from a comparison of FIGS. 31A–32B and 33A–34B that although the structures both comprise identical elements, very different configurations are realized Reference is now made to FIGS. 35A and 35B, which are respective isometric and perspective illustrations of a structure comprising four type B saddle elements 1420, in four different orientations, arranged in an octet structure and rigid structural elements 1422 incorporating an octet truss structure Reference is now made to FIGS. 36A and 36B, which are respective isometric and perspective illustrations of a structure comprising four type A saddle elements 1424 in two different orientations arranged in an octet-like structure and rigid structural elements 1426 incorporating an octet-like truss structure Reference is now made to FIGS. 37A and 37B, which are respective isometric and perspective illustrations of a structure comprising two type A saddle elements 1430, in two different orientations, arranged in an octet structure and rigid structural elements 1432 incorporating an octet truss structure.

Figure 38A:
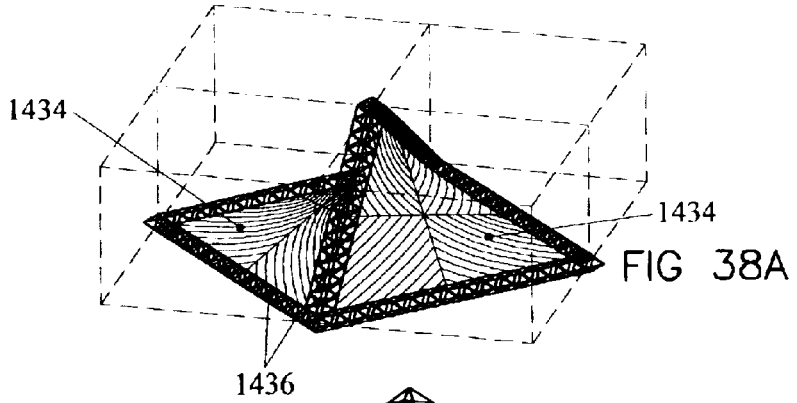
FIGS. 38A and 38B are respective isometric and perspective illustrations of a structure constructed and operative in accordance with yet another preferred embodiment of the present invention.
Figure 38B:
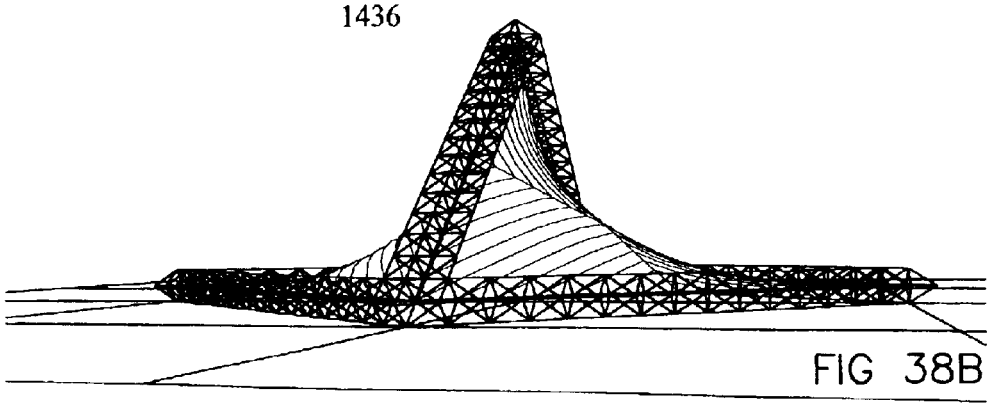
Figure 39A:
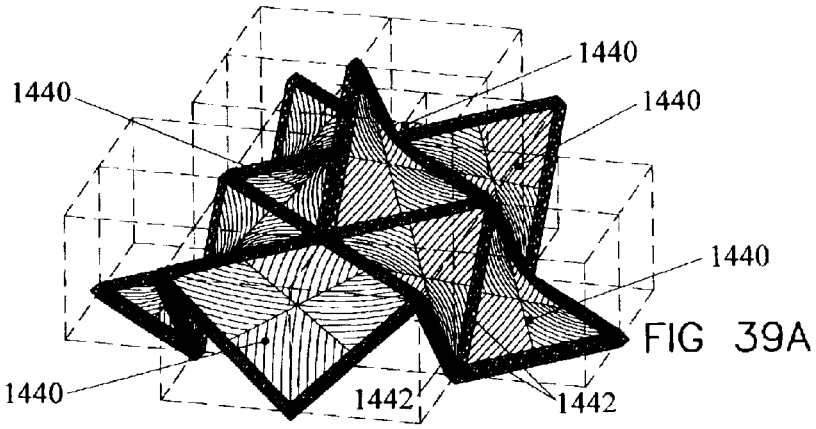
FIGS. 39A and 39B are respective isometric and perspective illustrations of a structure constructed and operative in accordance with still another preferred embodiment of the present invention.
Figure 39B:
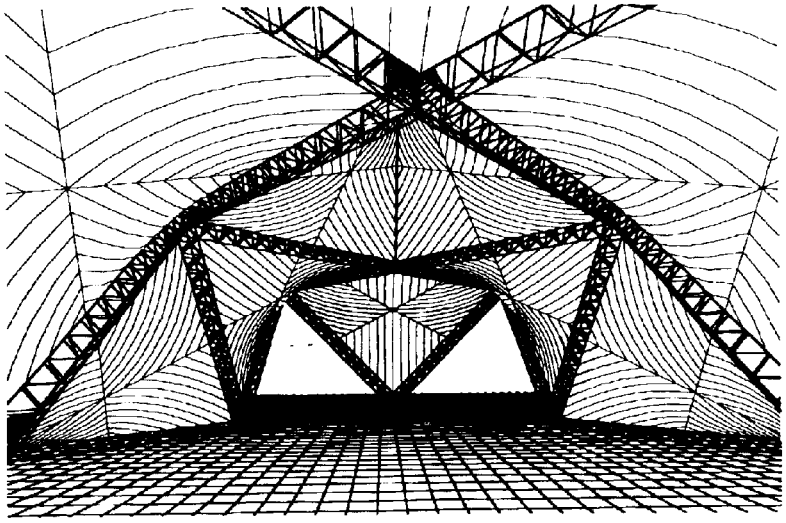
Figure 40A:
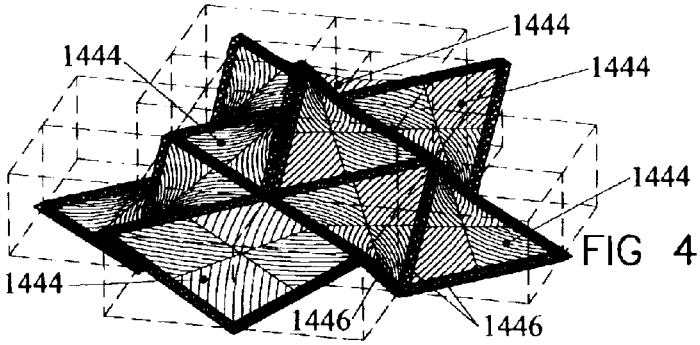
FIGS. 40A and 40B are respective isometric and perspective illustrations of a structure constructed and operative in accordance with another preferred embodiment of the present invention.
Figure 40B:
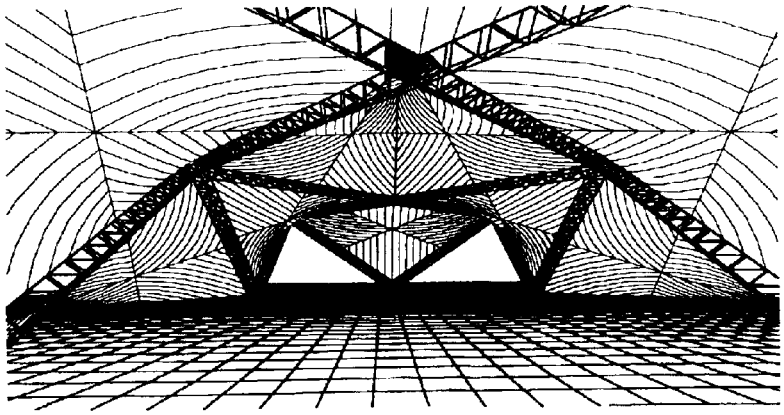
Figure 41A:
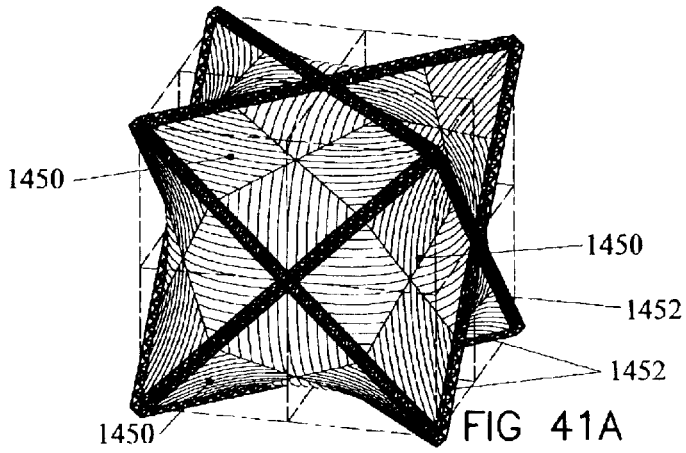
FIGS. 41A and 41B are respective isometric and perspective illustrations of a structure constructed and operative in accordance with yet another preferred embodiment of the present invention.
Figure 41B:
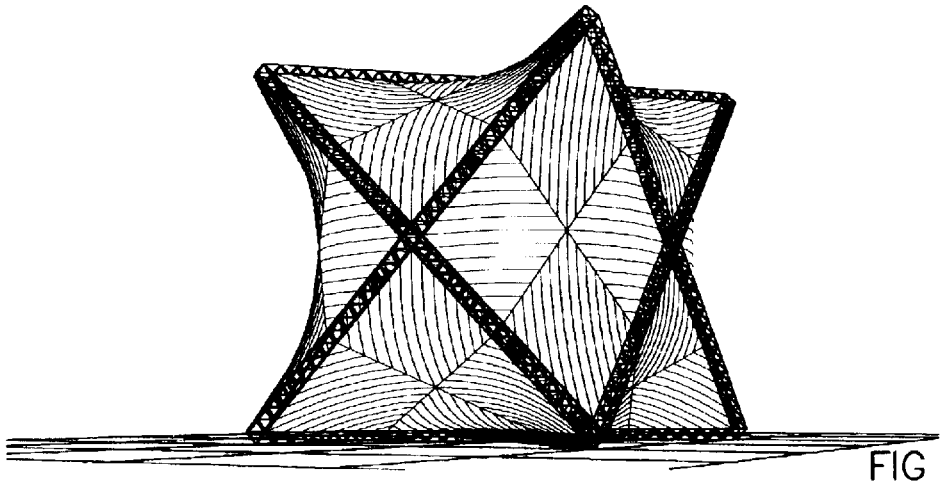
Figure 42A:
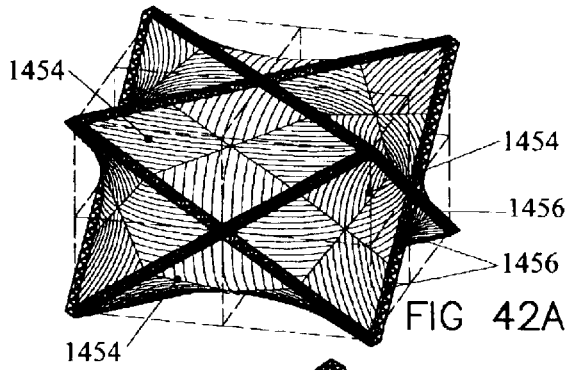
FIGS. 42A and 42B are respective isometric and perspective illustrations of a structure constructed and operative in accordance with still another preferred embodiment of the present invention.
Figure 42B:
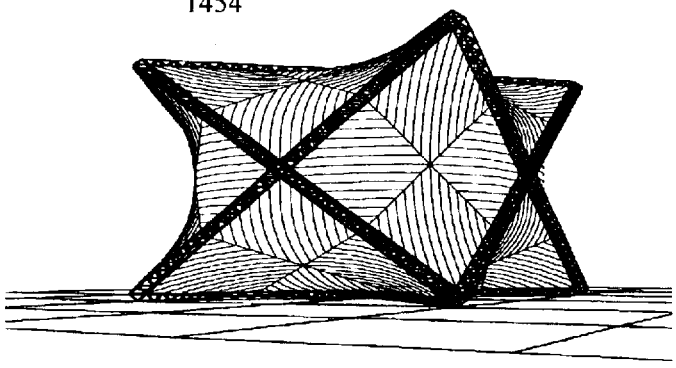

Reference is now made to FIGS. 38A and 38B, which are respective isometric and perspective illustrations of a structure comprising two type A saddle elements 1434 in two different orientations arranged in an octet-like structure and rigid structural elements 1436 incorporating an octet-like truss structure Reference is now made to FIGS. 39A and 39B, which are respective isometric and perspective illustrations of a structure comprising ten type B saddle elements 1440, in six different orientations, arranged in an octet structure and rigid structural elements 1442 incorporating an octet truss structure Reference is now made to FIGS. 40A and 40B, which are respective isometric and perspective illustrations of a structure comprising ten type B saddle elements 1444 in six different orientations arranged in an octet-like structure and rigid structural elements 1446 incorporating an octet-like truss structure It is noted, from a consideration of FIGS. 39A–40B, that a two layered structure is realized Reference is now made to FIGS. 41A and 41B, which are respective isometric and perspective illustrations of a structure comprising twelve type B saddle elements 1450, in twelve different orientations, arranged in an octet structure and rigid structural elements 1452 incorporating an octet truss structure Reference is now made to FIGS. 42A and 42B, which are respective isometric and perspective illustrations of a structure comprising twelve type B saddle elements 1454 in twelve different orientations arranged in an octet-like structure and rigid structural elements 1456 incorporating an octet-like truss structure.

Figure 43A:
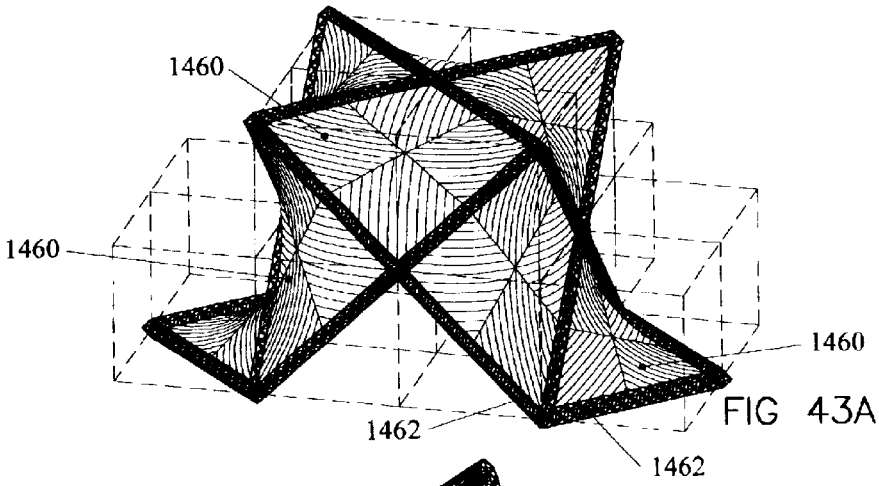
FIGS. 43A and 43B are respective isometric and perspective illustrations of a structure constructed and operative in accordance with another preferred embodiment of the present invention.
Figure 43B:
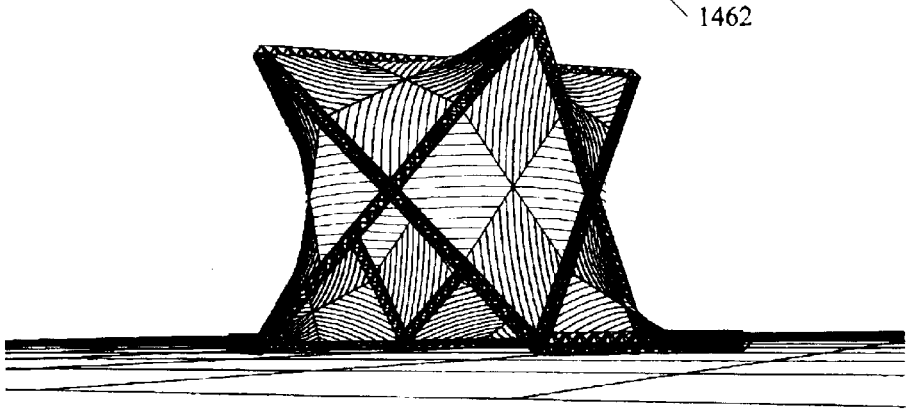

It is noted from a consideration of FIGS. 41A–42B that an enclosure is realized Reference is now made to FIGS. 43A and 43B, which are respective isometric and perspective illustrations of a structure comprising eleven type B saddle elements 1460, in eleven different orientations, arranged in an octet structure and rigid structural elements 1462 incorporating an octet truss structure.

Figure 44A:
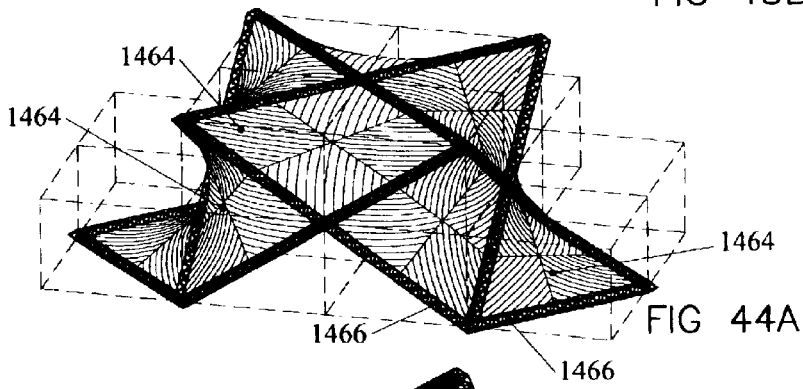
FIGS. 44A and 44B are respective isometric and perspective illustrations of a structure constructed and operative in accordance with yet another preferred embodiment of the present invention.
Figure 44B:
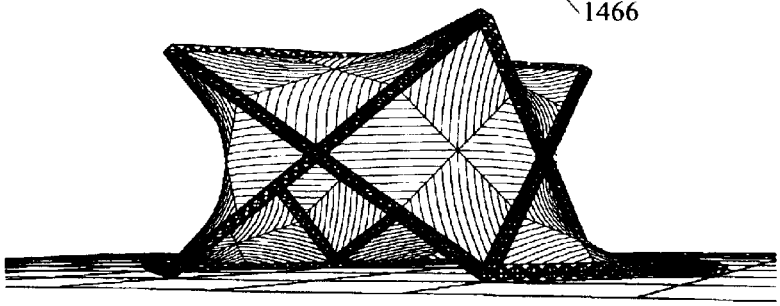

Reference is now made to FIGS. 44A and 44B, which are respective isometric and perspective illustrations of a structure comprising eleven type B saddle elements 1464 in eleven different orientations arranged in an octet-like structure and rigid structural elements 1466 incorporating an octet-like truss structure.

Figure 45:
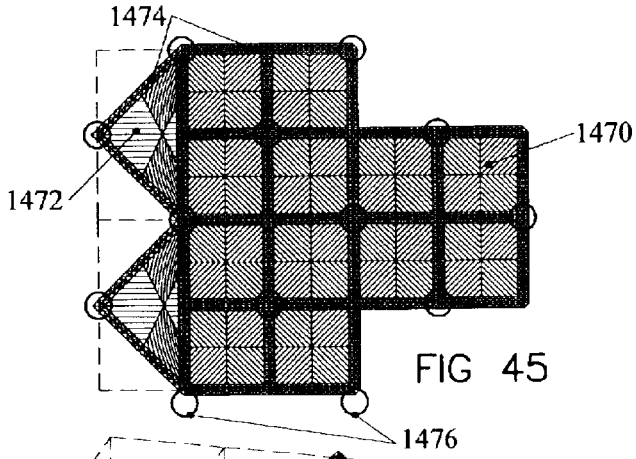
FIG. 45 is a roof plan view illustration of a structure constructed and operative in accordance with another preferred embodiment of the present invention.

Reference is now made to FIG. 45, which is a roof plan view illustration of a structure comprising twelve type A saddle elements 1470 in two different orientations and two type B saddle elements 1472 in the same orientation and rigid structural elements 1474 Locations at which the structure touches a base surface are indicated by circles 1476

Figure 46A:
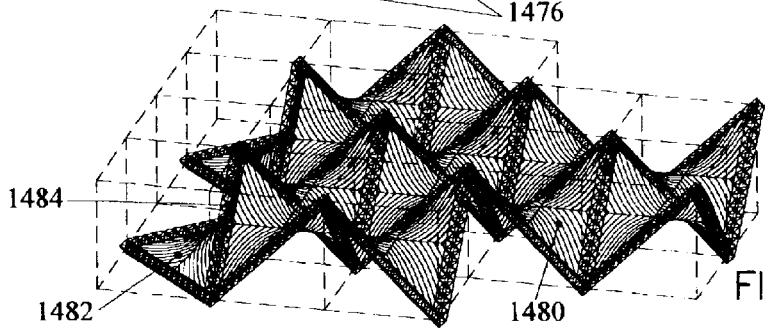
FIGS. 46A and 46B are respective isometric and perspective illustrations of one embodiment of the structure of FIG. 45, FIGS. 47A and 47B are respective isometric and perspective illustrations of another embodiment of the structure of FIG. 45.
Figure 46B:
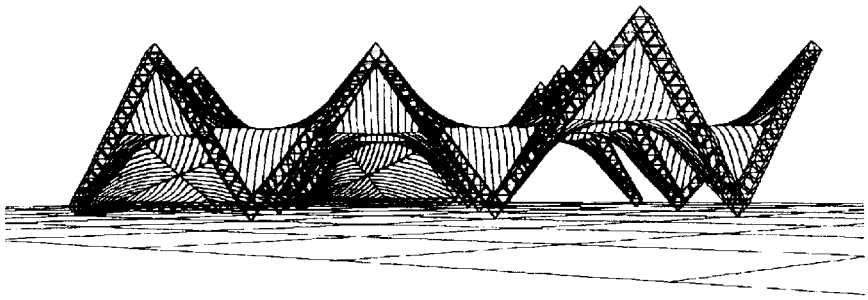

Reference is now made to FIGS. 46A and 46B, which are respective isometric and perspective illustrations of one embodiment of the structure of FIG. 45 wherein the type A saddle elements, here designated by reference numerals 1480, and the type B saddle elements, here designated by reference numeral 1482, are arranged in an octet structure and the rigid structural elements, here designated by reference numerals 1484, incorporate an octet truss structure.

Figure 47A:
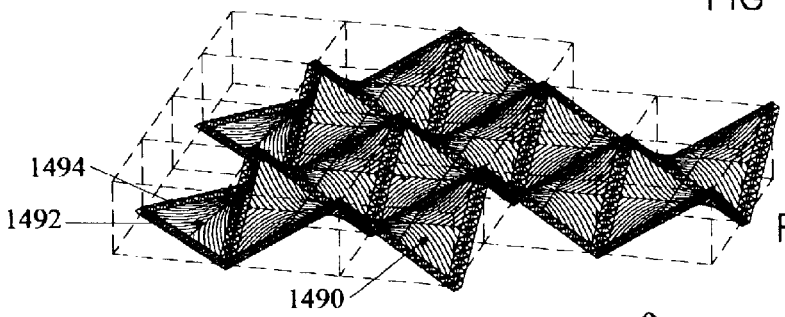
Figure 47B:
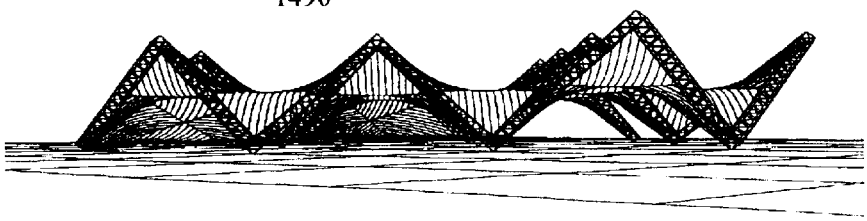
Figure 48:
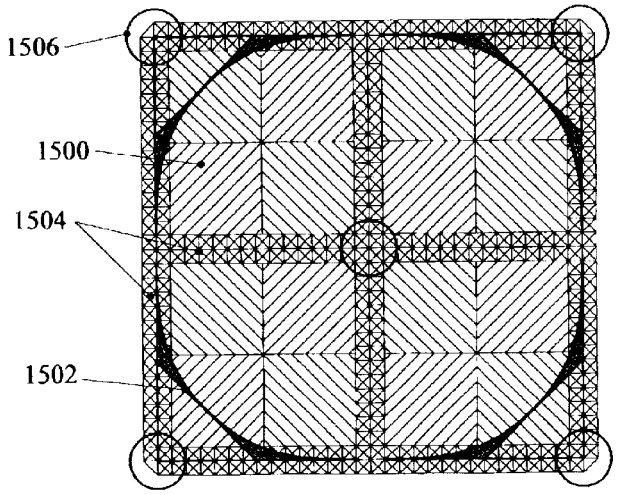
FIG. 48 is a roof plan view illustration of a structure constructed and operative in accordance with yet another preferred embodiment of the present invention.

Reference is now made to FIGS. 47A and 47B, which are respective isometric and perspective illustrations of another embodiment of the structure of FIG. 45 wherein the type A saddle elements, here designated by reference numerals 1490, and the type B saddle elements, here designated by reference numerals 1492, are arranged in an octet-like structure and the rigid structural elements, here designated by reference numerals 1494, incorporate an octet-like truss structure Reference is now made to FIG. 48, which is a roof plan view illustration of a structure comprising eight type A saddle elements 1500 in two different orientations and four type B saddle elements 1502 in four different orientations and rigid structural elements 1504 Locations at which the structure touches a base surface are indicated by circles 1506

Figure 49A:
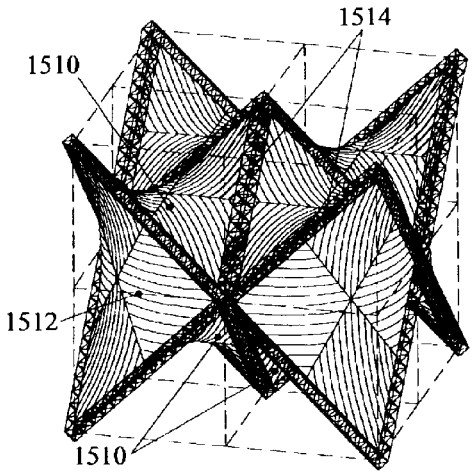
FIGS. 49A and 49B are respective isometric and perspective illustrations of one embodiment of the structure of FIG. 48.
Figure 49B:
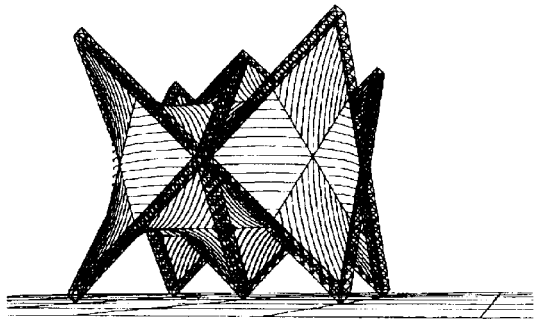
Figure 50A:
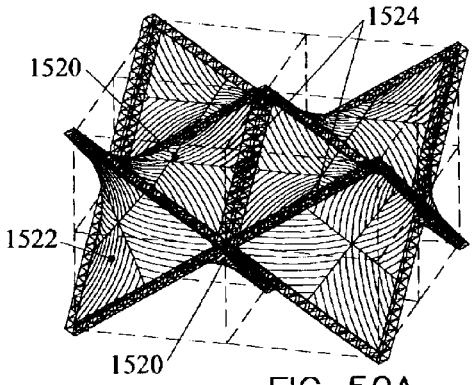
FIGS. 50A and 50B are respective isometric and perspective illustrations of another embodiment of the structure of FIG. 48.
Figure 50B:
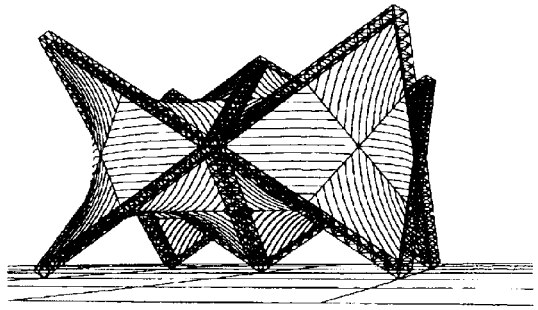
Figure 51:
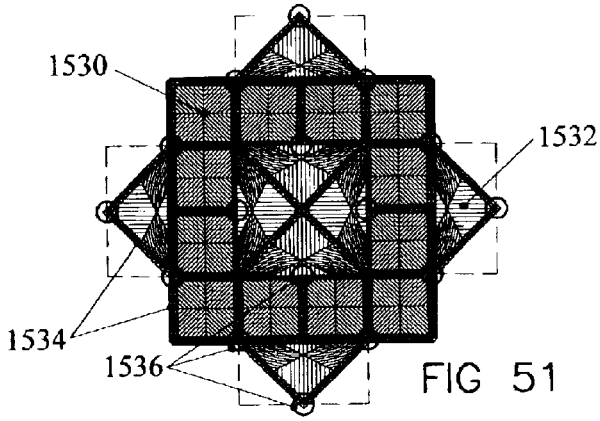
FIG. 51 is a roof plan view illustration of a structure constructed and operative in accordance with still another preferred embodiment of the present invention.

Reference is now made to FIGS. 49A and 49B, which are respective isometric and perspective illustrations of one embodiment of the structure of FIG. 48 wherein the type A saddle elements, here designated by reference numerals 1510, and the type B saddle elements, here designated by reference numeral 1512, are arranged in an octet structure and the rigid structural elements, here designated by reference numerals 1514, incorporate an octet truss structure Reference is now made to FIGS. 50A and 50B, which are respective isometric and perspective illustrations of another embodiment of the structure of FIG. 48 wherein the type A saddle elements, here designated by reference numerals 1520, and the type B saddle elements, here designated by reference numerals 1522, are arranged in an octet-like structure and the rigid structural elements, here designated by reference numerals 1524, incorporate an octet-like truss structure Reference is now made to FIG. 51, which is a roof plan view illustration of a structure comprising twelve type A saddle elements 1530 in two different orientations and eight type B saddle elements 1532 in eight different orientations and rigid structural elements 1534 Locations at which the structure touches a base surface are indicated by circles 1536

Figure 52A:
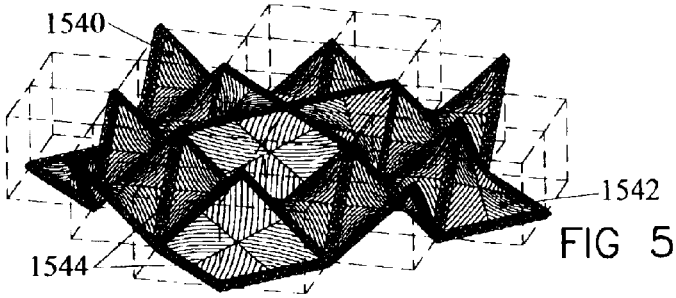
FIGS. 52A and 52B are respective isometric and perspective illustrations of one embodiment of the structure of FIG. 51, FIGS. 53A and 53B which are respective isometric and perspective illustrations of another embodiment of the structure of FIG. 51.
Figure 52B:
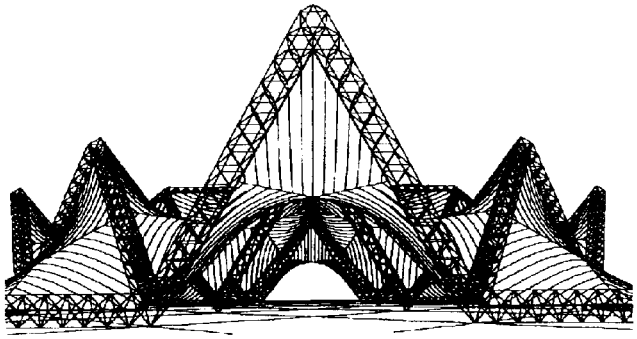
Figure 53A:
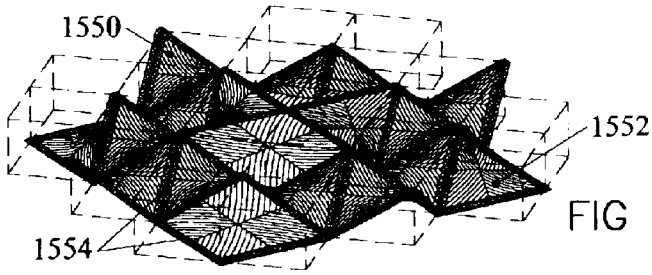
Figure 53B:
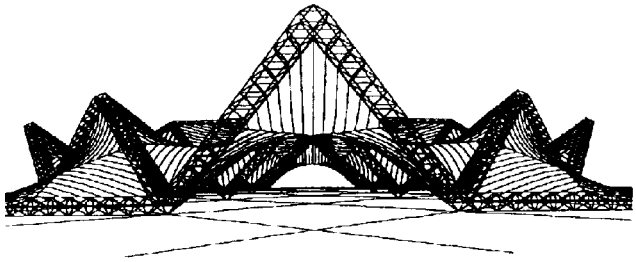

Reference is now made to FIGS. 52A and 52B, which are respective isometric and perspective illustrations of one embodiment of the structure of FIG. 51 wherein the type A saddle elements, here designated by reference numerals 1540, and the type B saddle elements, here designated by reference numeral 1542, are arranged in an octet structure and the rigid structural elements, here designated by reference numerals 1544, incorporate an octet truss structure Reference is now made to FIGS. 53A and 53B, which are respective isometric and perspective illustrations of another embodiment of the structure of FIG. 51 wherein the type A saddle elements, here designated by reference numerals 1550, and the type B saddle elements, here designated by reference numerals 1552, are arranged in an octet-like structure and the rigid structural elements, here designated by reference numerals 1554, incorporate an octet-like truss structure.

Figure 54:
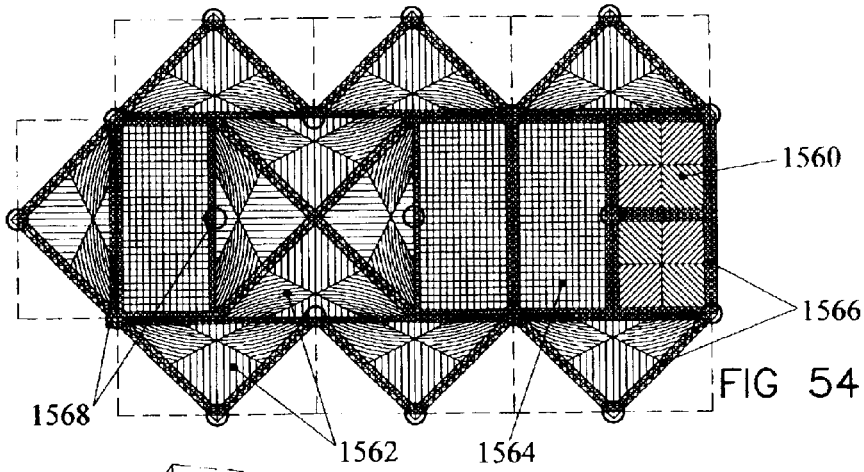
FIG. 54 is a roof plan view illustration of a structure constructed and operative in accordance with another preferred embodiment of the present invention.

Reference is now made to FIG. 54, which is a roof plan view illustration of a structure comprising two type A saddle elements 1560 in two different orientations, eleven type B saddle elements 1562 in seven different orientations and three type C saddle elements 1564 and rigid structural elements 1566. Locations at which the structure touches a base surface are indicated by circles 1568

Figure 55A:
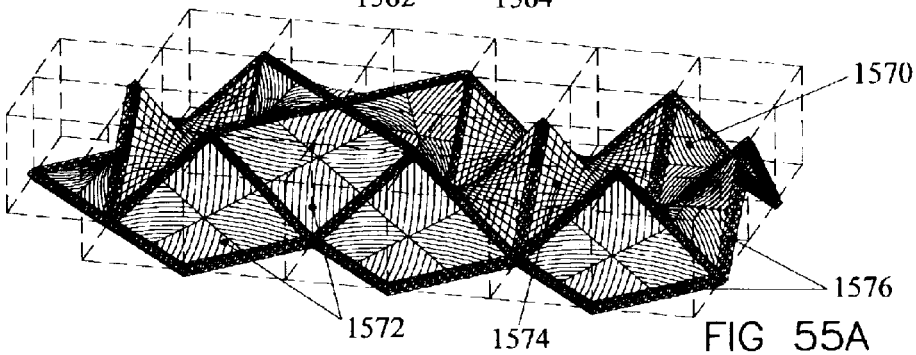
FIGS. 55A and 55B are respective isometric and perspective illustrations of one embodiment of the structure of FIG. 54, FIGS. 56A and 56B are respective isometric and perspective illustrations of another embodiment of the structure of FIG. 54.
Figure 55B:
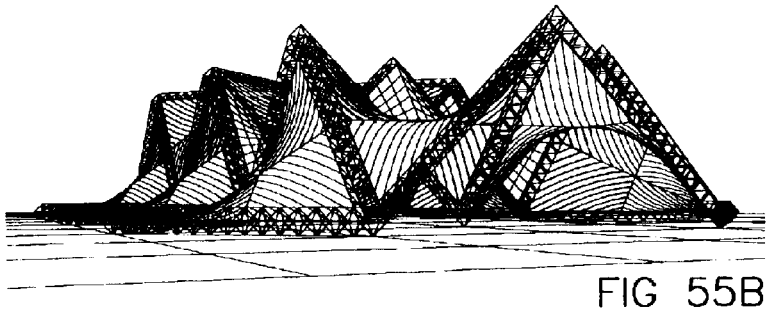
Figure 56A:
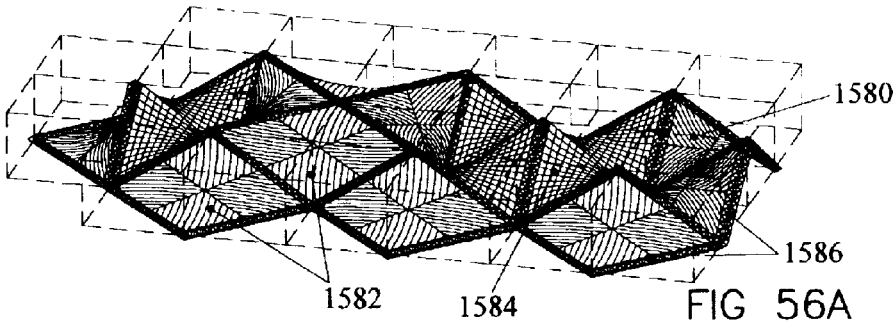
Figure 56B:
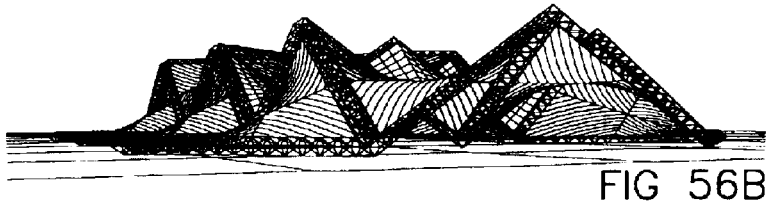
Figure 57:
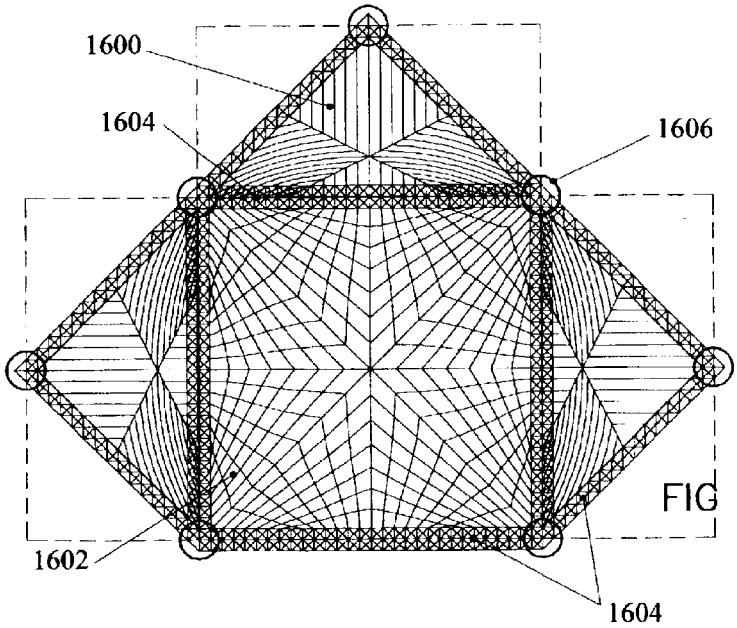
FIG. 57 is a roof plan view illustration of a structure constructed and operative in accordance with yet another preferred embodiment of the present invention.

Reference is now made to FIGS. 55A and 55B, which are respective isometric and perspective illustrations of one embodiment of the structure of FIG. 54 wherein the type A saddle elements, here designated by reference numerals 1570, the type B saddle elements, here designated by reference numeral 1572, and the type C saddle elements, here designated by reference numeral 1574, are arranged in an octet structure and the rigid structural elements, here designated by reference numerals 1576, incorporate an octet truss structure Reference is now made to FIGS. 56A and 56B, which are respective isometric and perspective illustrations of another embodiment of the structure of FIG. 54 wherein the type A saddle elements, here designated by reference numerals 1580, the type B saddle elements, here designated by reference numeral 1582 and the type C saddle elements, here designated by reference numerals 1584, are arranged in an octet-like structure and the rigid structural elements, here designated by reference numerals 1524, incorporate an octet-like truss structure Reference is now made to FIG. 57, which is a roof plan view illustration of a structure comprising, three type B saddle elements 1600 in three different orientations and one type D saddle element 1602 and rigid structural elements 1604. Locations at which the structure touches a base surface are indicated by circles 1606.

Figure 58A:
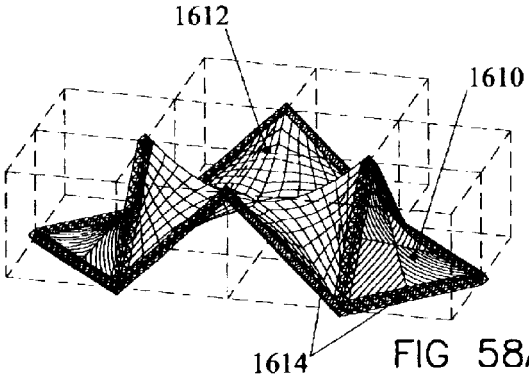
FIGS. 58A and 58B are respective isometric and perspective illustrations of one embodiment of the structure of FIG. 57, FIGS. 59A and 59B which are respective isometric and perspective illustrations of another embodiment of the structure of FIG. 57.
Figure 58B:
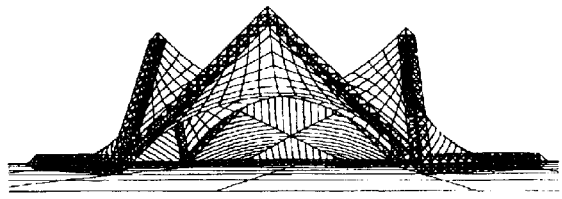
Figure 59A:
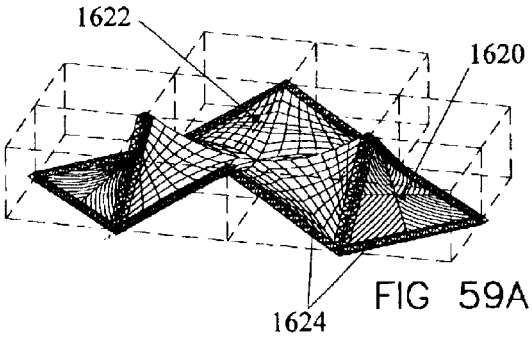
Figure 59B:
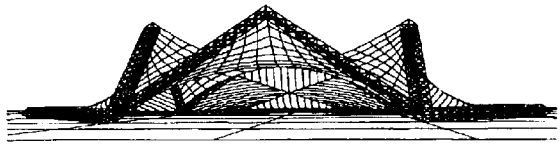

Reference is now made to FIGS. 58A and 58B, which are respective isometric and perspective illustrations of one embodiment of the structure of FIG. 57 wherein the type B saddle elements, here designated by reference numerals 1610 and the type D saddle element, here designated by reference numeral 1612, are arranged in an octet structure and the rigid structural elements, here designated by reference numerals 1614, incorporate an octet truss structure Reference is now made to FIGS. 59A and 59B, which are respective isometric and perspective illustrations of another embodiment of the structure of FIG. 57 wherein the type B saddle elements, here designated by reference numerals 1620 and the type D saddle element, here designated by reference numerals 1622, are arranged in an octet-like structure and the rigid structural elements, here designated by reference numerals 1624, incorporate an octet-like truss structure.

Figure 60:
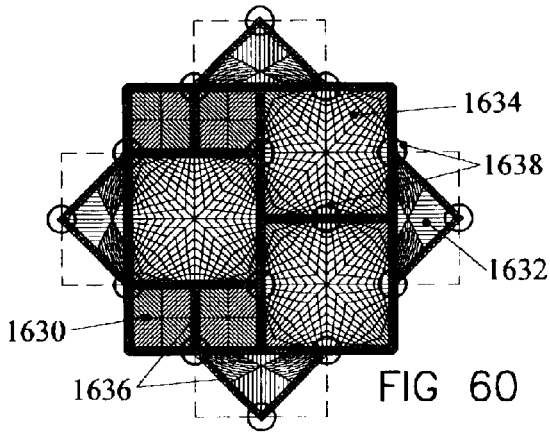
FIG. 60 is a roof plan view illustration of a structure constructed and operative in accordance with still another preferred embodiment of the present invention.

Reference is now made to FIG. 60, which is a roof plan view illustration of a structure comprising four type A saddle elements 1630 in two different orientations, four type B saddle elements 1632 in four different orientations, and three type D saddle elements 1634 in two different orientations and rigid structural elements 1636. Locations at which the structure touches a base surface are indicated by circles 1638

Figure 61A:
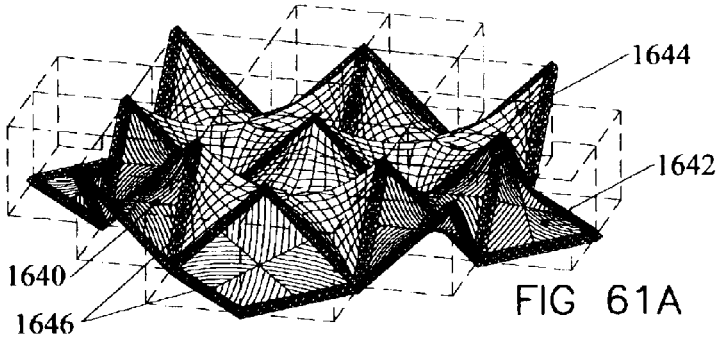
FIGS. 61A and 61B are respective isometric and perspective illustrations of one embodiment of the structure of FIG. 60, FIGS. 62A and 62B are respective isometric and perspective illustrations of another embodiment of the structure of FIG. 60.
Figure 61B:
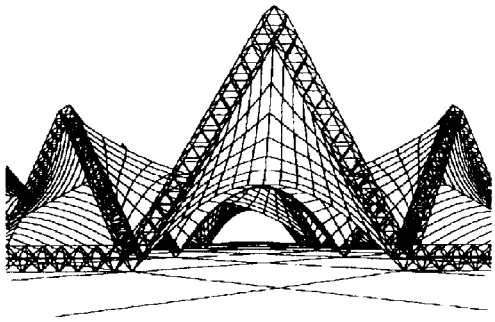
Figure 62A:
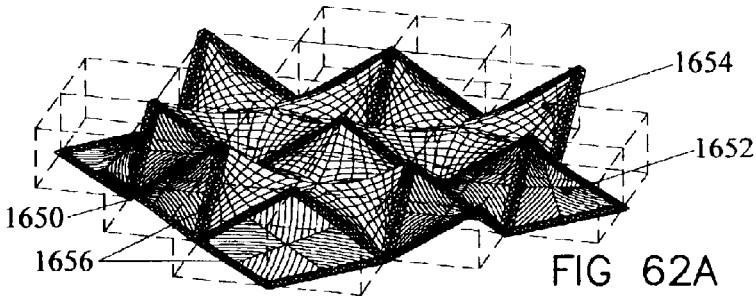
Figure 62B:
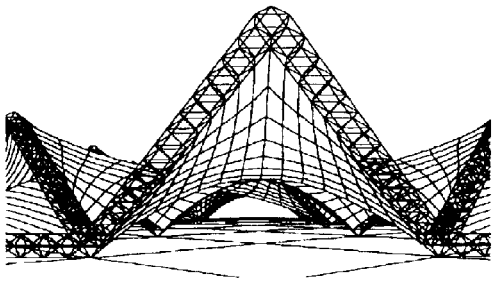
Figure 63:
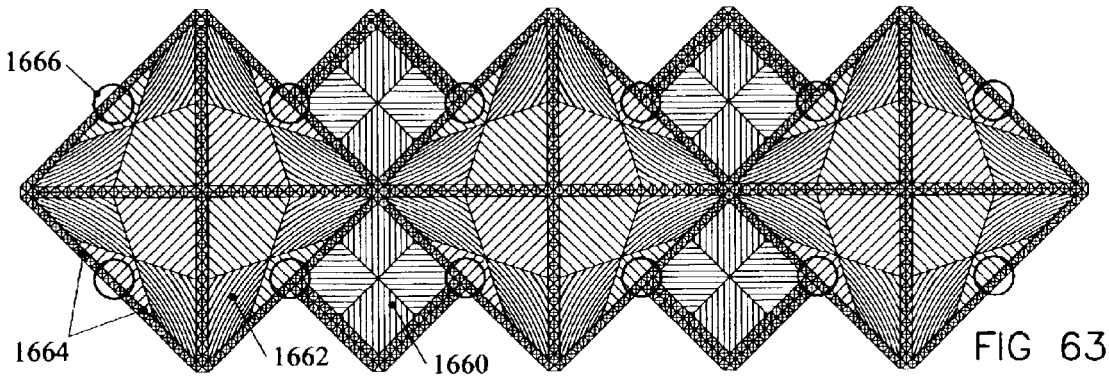
FIG. 63 is a roof plan view illustration of a structure constructed and operative in accordance with another preferred embodiment of the present invention.

Reference is now made to FIGS. 61A and 61B, which are respective isometric and perspective illustrations of one embodiment of the structure of FIG. 60 wherein the type A saddle elements, here designated by reference numerals 1640, the type B saddle elements 1642 and the type D saddle elements, here designated by reference numeral 1644, are arranged in an octet structure and the rigid structural elements, here designated by reference numerals 1646 incorporate an octet truss structure Reference is now made to FIGS. 62A and 62B, which are respective isometric and perspective illustrations of another embodiment of the structure of FIG. 60 wherein the type A saddle elements, here designated by reference numerals 1650, the type B saddle elements 1652 and the type D saddle elements, here designated by reference numerals 1654, are arranged in an octet-like structure and the rigid structural elements, here designated by reference numerals 1656, incorporate an octet-like truss structure Reference is now made to FIG. 63, which is a roof plan view illustration of a structure comprising four type A saddle elements 1660 in two different orientations and twelve type B saddle elements 1662 in four different orientations and rigid structural elements 1664 Locations at which the structure touches a base surface are indicated by circles 1666

Figure 64A:
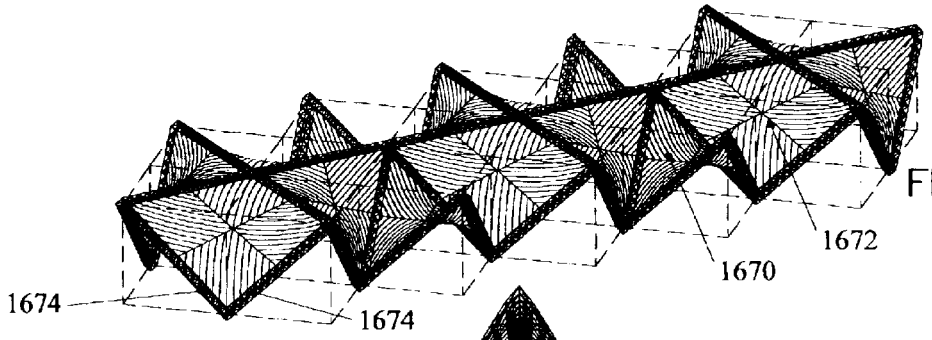
FIGS. 64A and 64B are respective isometric and perspective illustrations of one embodiment of the structure of FIG. 63, FIGS. 65A and 65B are respective isometric and perspective illustrations of another embodiment of the structure of FIG. 63.
Figure 64B:
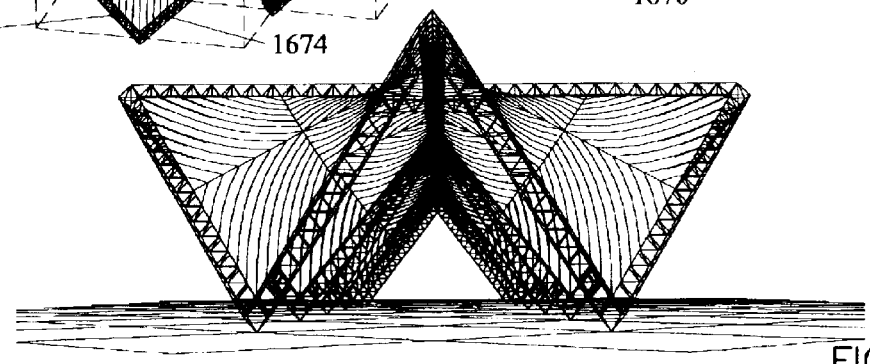
Figure 65A:
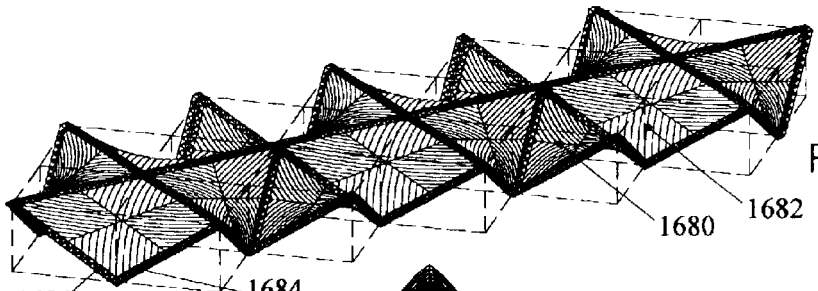
Figure 65B:
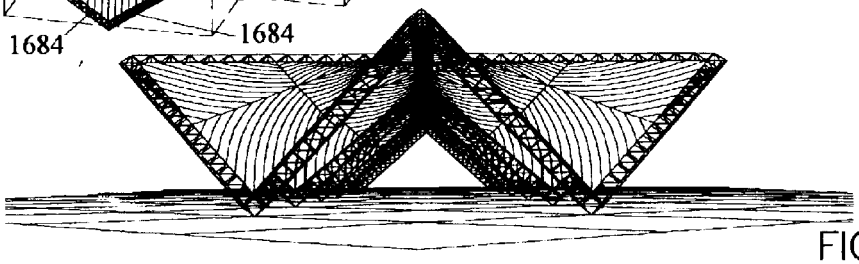
Figure 66:
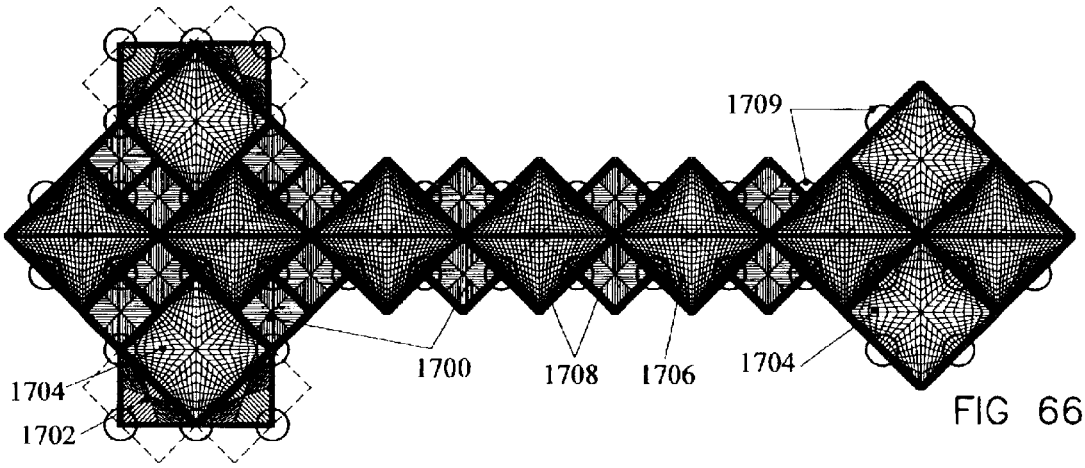
FIG. 66 is a roof plan view illustration of a structure constructed and operative in accordance with yet another preferred embodiment of the present invention.

Reference is now made to FIGS. 64A and 64B, which are respective isometric and perspective illustrations of one embodiment of the structure of FIG. 63 wherein the type A saddle elements, here designated by reference numerals 1670 and the type B saddle elements 1672, are arranged in an octet structure and the rigid structural elements, here designated by reference numerals 1674, incorporate an octet truss structure Reference is now made to FIGS. 65A and 65B, which are respective isometric and perspective illustrations of another embodiment of the structure of FIG. 63 wherein the type A saddle elements, here designated by reference numerals 1680 and the type B saddle elements 1682 are arranged in an octet-like structure and the rigid structural elements, here designated by reference numerals 1684, incorporate an octet-like truss structure Reference is now made to FIG. 66, which is a roof plan view illustration of a structure comprising fourteen type A saddle elements 1700 in two different orientations, four type B saddle elements 1702 in four different orientations, four type D saddle elements 1704 in two different orientations, seven type E saddle elements 1706 all in the same orientation and rigid structural elements 1708 Locations at which the structure touches a base surface are indicated by circles 1709

Figure 67A:
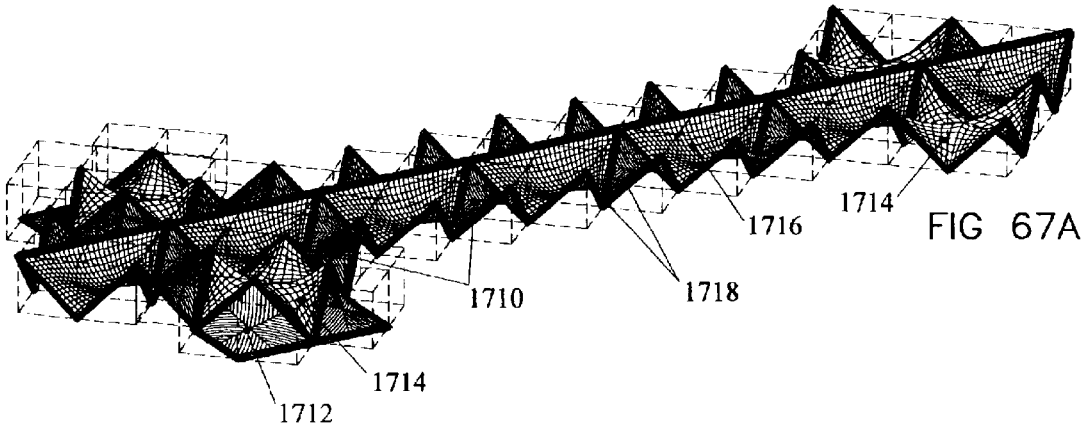
FIGS. 67A and 67B are respective isometric and perspective illustrations of one embodiment of the structure of FIG. 66, FIGS. 68A and 68B are respective isometric and perspective illustrations of another embodiment of the structure of FIG. 66.
Figure 67B:
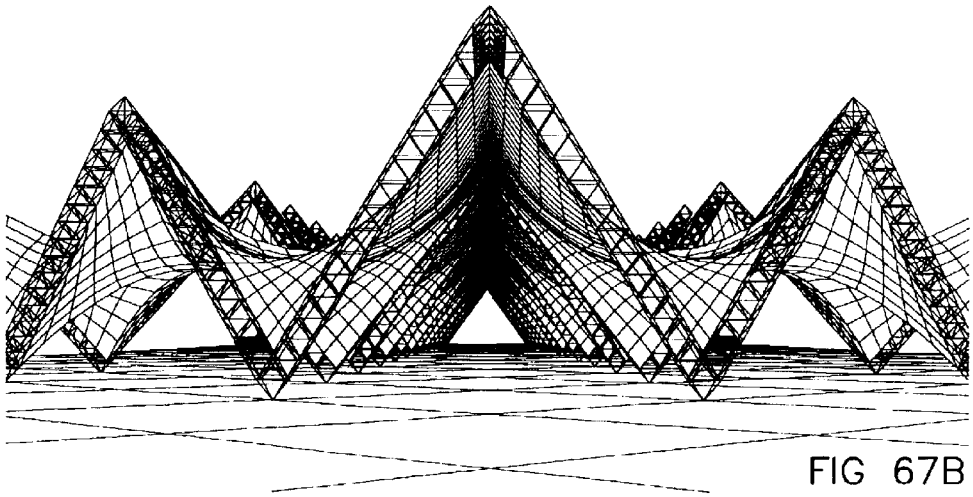

Reference is now made to FIGS. 67A and 67B, which are respective isometric and perspective illustrations of one embodiment of the structure of FIG. 66 wherein the type A saddle elements, here designated by reference numerals 1710, the type B saddle elements 1712, the type D saddle elements 1714, the type E saddle elements 1716 are arranged in an octet structure and the rigid structural elements, here designated by reference numerals 1718, incorporate an octet truss structure.

Figure 68A:
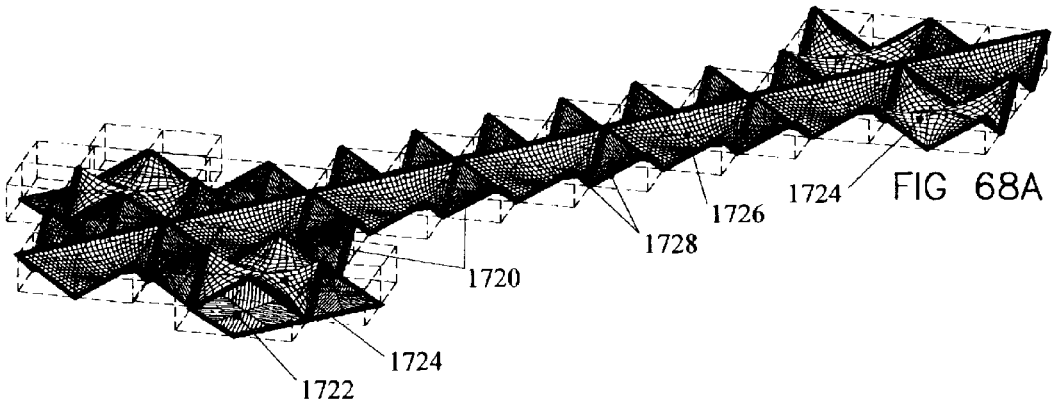
Figure 68B:
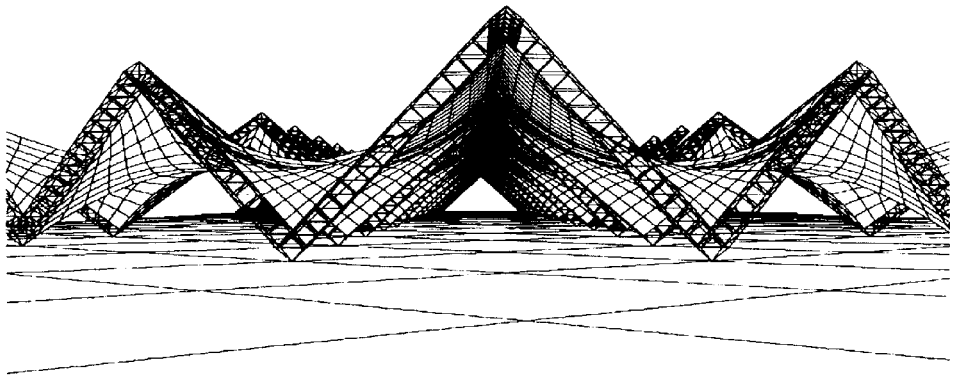

Reference is now made to FIGS. 68A and 68B, which are respective isometric and perspective illustrations of another embodiment of the structure of FIG. 66 wherein the type A saddle elements, here designated by reference numerals 1720, the type B saddle elements 1722, the type D saddle elements 1724, the type E saddle elements 1726 are arranged in an octet-like structure and the rigid structural elements, here designated by reference numerals 1728, incorporate an octet-like truss structure.

Figure 69:
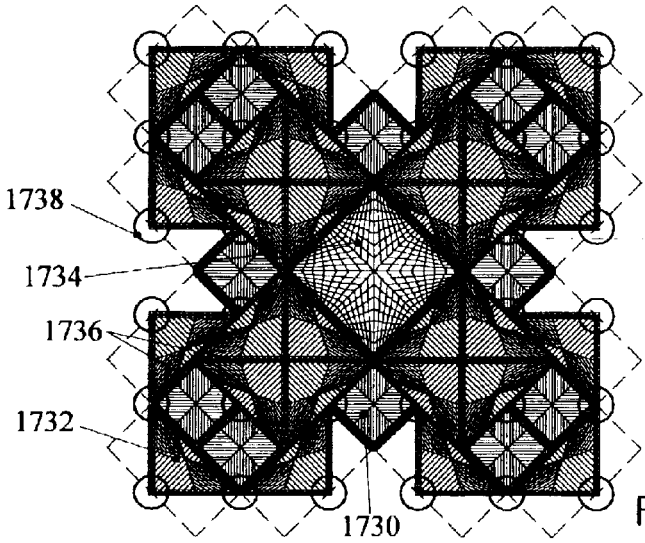
FIG. 69 is a roof plan view illustration of a structure constructed and operative in accordance with still another preferred embodiment of the present invention.

Reference is now made to FIG. 69, which is a roof plan view illustration of a structure comprising twelve type A saddle elements 1730 in two different orientations, 28 type B saddle elements 1732 in eight different orientations, one type D saddle element 1734 and rigid structural elements 1736 Locations at which the structure touches a base surface are indicated by circles 1738

Figure 70A:
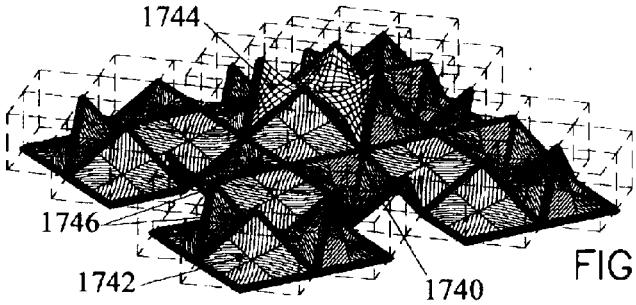
FIGS. 70A and 70B are respective isometric and perspective illustrations of one embodiment of the structure of FIG. 69, FIGS. 71A and 71B are respective isometric and perspective illustrations of another embodiment of the structure of FIG. 69.
Figure 70B:
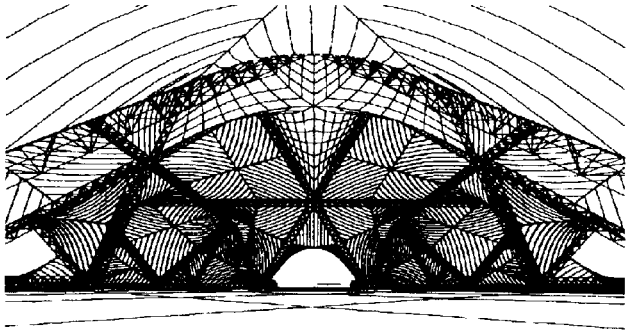
Figure 71A:
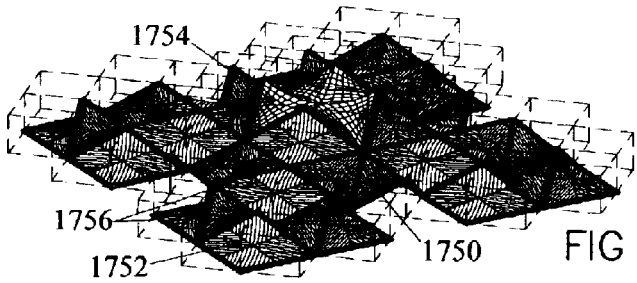
Figure 71B:
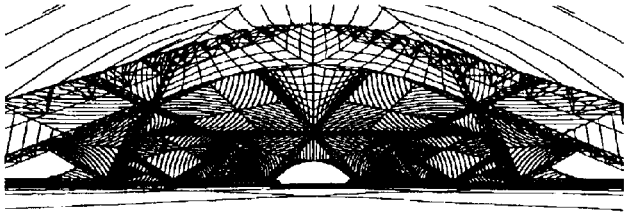

Reference is now made to FIGS. 70A and 70B, which are respective isometric and perspective illustrations of one embodiment of the structure of FIG. 69 wherein the type A saddle elements, here designated by reference numerals 1740, the type B saddle elements 1742 and the type D saddle element 1744 are arranged in an octet structure and the rigid structural elements, here designated by reference numerals 1746, incorporate an octet truss structure Reference is now made to FIGS. 71A and 71B, which are respective isometric and perspective illustrations of another embodiment of the structure of FIG. 69 wherein the type A saddle elements, here designated by reference numerals 1750, the type B saddle elements 1752 and the type D saddle element 1754 are arranged in an octet-like structure and the rigid structural elements, here designated by reference numerals 1756, incorporate an octet-like truss structure It is appreciated, from a consideration of FIGS. 69–71B, that a multilayer structure, having a relatively very large free space, is realized.

Figure 72:
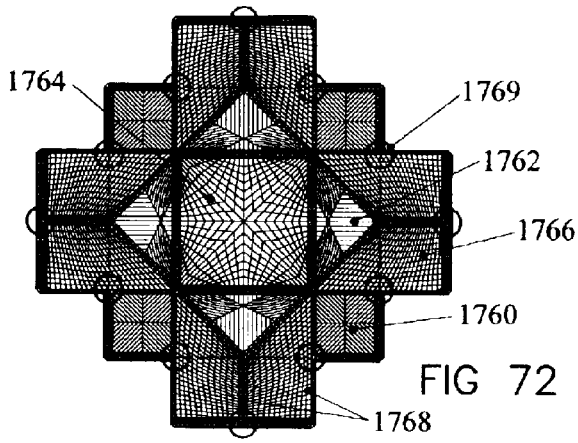
FIG. 72 is a roof plan view illustration of a structure constructed and operative in accordance with another preferred embodiment of the present invention.

Reference is now made to FIG. 72, which is a roof plan view illustration of a structure comprising, four type A saddle elements 1760 in two different orientations, four type B saddle elements 1762 in four different orientations, one type D saddle element 1764 and eight type G saddle elements 1766 in eight different orientations as well as rigid structural elements 1768 Locations at which the structure touches a base surface are indicated by circles 1769

Figure 73A:
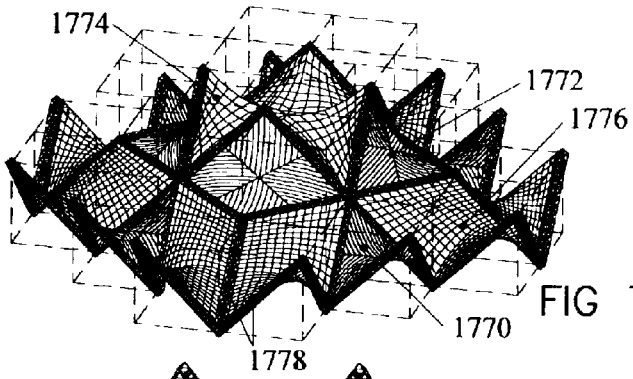
FIGS. 73A and 73B are respective isometric and perspective illustrations of one embodiment of the structure of FIG. 72, FIGS. 74A and 74B which are respective isometric and perspective illustrations of another embodiment of the structure of FIG. 72, FIGS. 75A and 75B illustrate an example of an integrated structure employing structural elements of the types described hereinabove together with a conventional three-dimensional tensioned cable system for providing enhanced overall constructional efficiency in accordance with another preferred embodiment of the present invention.
Figure 73B:
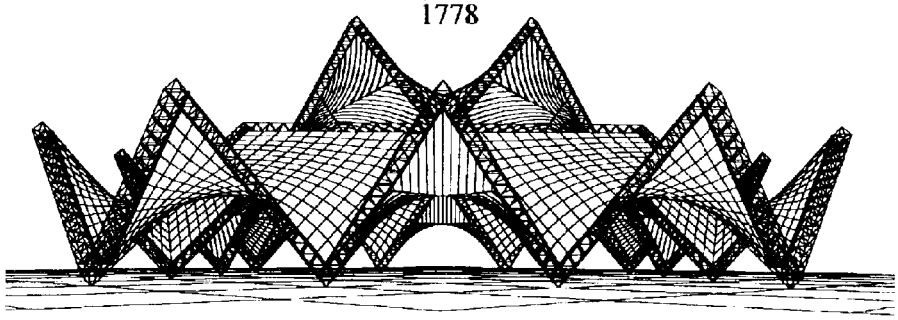
Figure 74A:
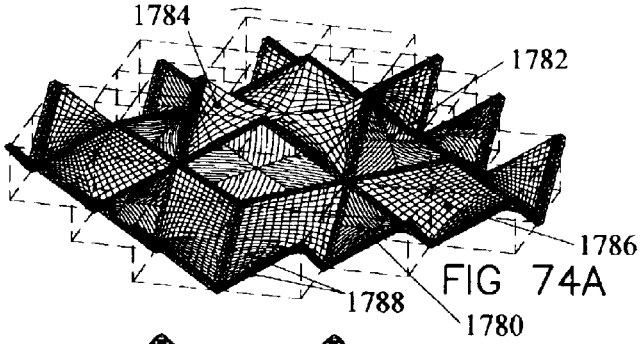
Figure 74B:
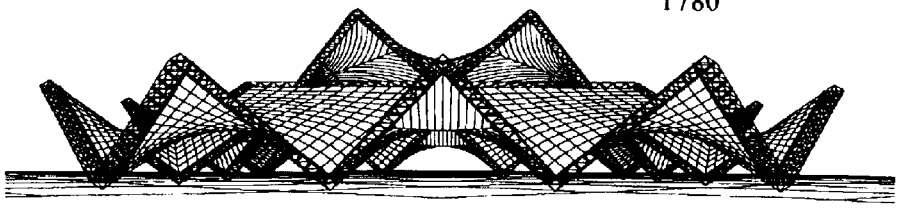

Reference is now made to FIGS. 73A and 73B, which are respective isometric and perspective illustrations of one embodiment of the structure of FIG. 72 wherein the type A saddle elements, here designated by reference numerals 1770, the type B saddle elements 1772, the type D saddle element 1774 and the type G saddle elements 1776 are arranged in an octet structure and the rigid structural elements, here designated by reference numerals 1778, incorporate an octet truss structure Reference is now made to FIGS. 74A and 74B, which are respective isometric and perspective illustrations of another embodiment of the structure of FIG. 72 wherein the type A saddle elements, here designated by reference numerals 1780, the type B saddle elements 1782, the type D saddle element 1784 and the type G saddle elements 1786 are arranged in an octet-like structure and the rigid structural elements, here designated by reference numerals 1788, incorporate an octet-like truss structure.

It is appreciated, from a consideration of FIGS. 72–74B, that a multilayer structure, having a relatively large free space, is realized.

Figure 75A:
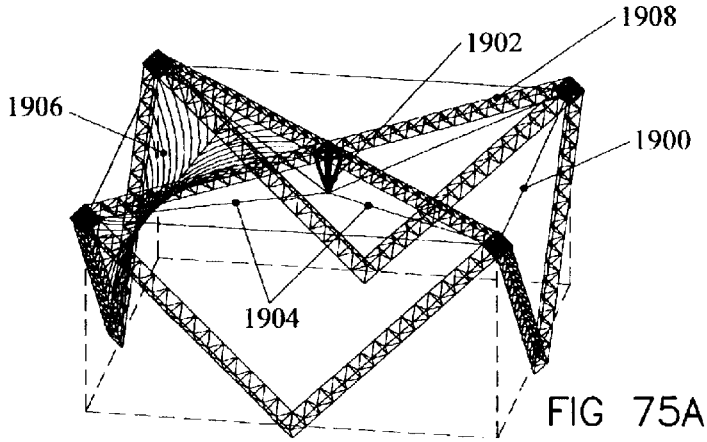
Figure 75B:
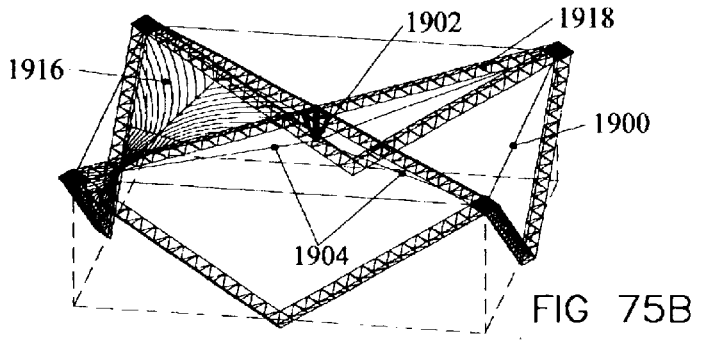

Reference is now made to FIGS. 75A and 75B, which illustrate one example of an integrated structure employing structural elements of the types described hereinabove together with a conventional three-dimensional tensioned cable system for providing enhanced overall constructional efficiency The basic structure of FIGS. 75A and 75B is similar to that of FIGS. 35A and 35B, with the addition of a peripheral tensioned cable 1900 and a center mounted element 1902 which is supported by a pair of crossing cables 1904

FIG. 75A is an isometric illustration of a structure comprising four type B saddle elements 1906, in four different orientations, arranged in an octet structure and rigid structural elements 1908 incorporating an octet truss structure FIG. 75B is an isometric illustration of a structure comprising four type B saddle elements 1916, in four different orientations, arranged in an octet-like structure and rigid structural elements 1918 incorporating an octet-like truss structure.

In both FIGS. 75A & 75B, the crossing cables 1904 support the junction of generally horizontal rigid structural elements 1908 and 1918 and thus enable any of all of the rigid structural elements 1908 and 1918 to be formed with less material and/or fewer struts and joints Reference is now made to FIGS. 76A & 76B, which illustrate another example of an integrated structure employing structural elements of the types described hereinabove together with a conventional three-dimensional tensioned cable system for providing enhanced overall constructional efficiency.

Figure 76A:
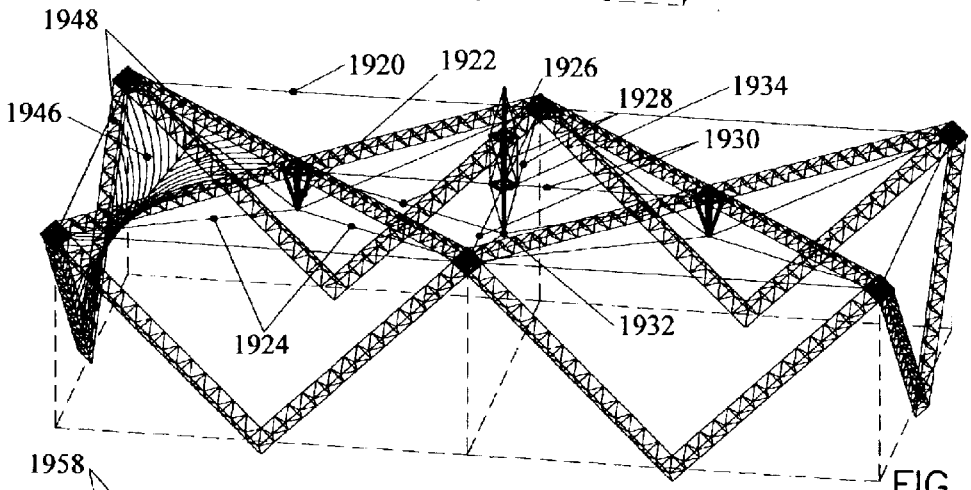
FIGS. 76A & 76B illustrate another example of an integrated structure employing structural elements of the types described hereinabove together with a conventional three-dimensional tensioned cable system for providing enhanced overall constructional efficiency in accordance with another preferred embodiment of the present invention.
Figure 76B:
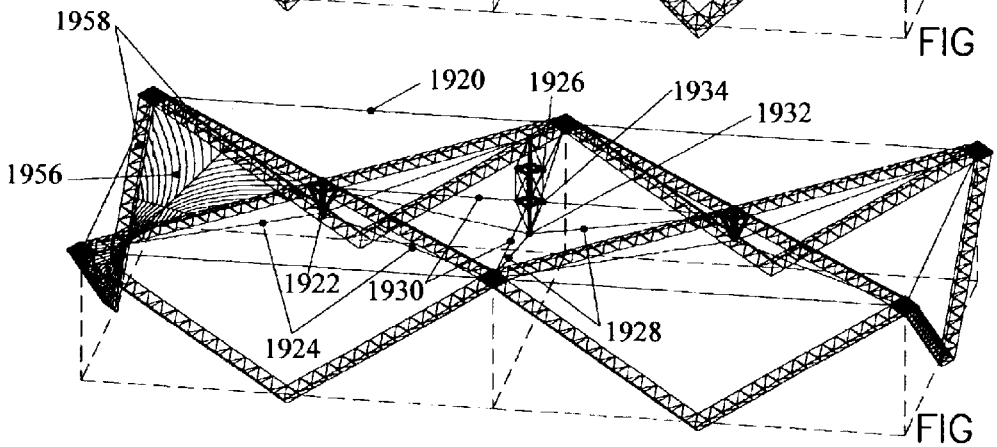

The basic structure of FIGS. 76A and 76B is a combination of two structures of, respectively, the types shown in FIGS. 75A & 75B together with a tent-like addition preferably embodied in a pyramidal tensioned membrane (not shown) Each of the structures shown in respective FIGS. 75A & 75B includes a peripheral tensioned cable 1920 and a center mounted element 1922 which is supported by a pair of crossing cables 1924 A central shaft 1926 is supported well above the ground surface by two pairs of crossings cables 1928 and 1930 Crossing cables 1928 engage a bottom location 1932 of central shaft 1926, while crossing cables 1930 engage a central location 1934 of central shaft 1926

FIG. 76A is an isometric illustration of a structure comprising six type B saddle elements 1946, in four different orientations, arranged in an octet structure, and rigid structural elements 1948 incorporating an octet truss structure.

FIG. 76B is an isometric illustration of a structure comprising six type B saddle elements 1956, in four different orientations, arranged in an octet-like structure, and rigid structural elements 1958 incorporating an octet-like truss structure.

Figure 77:
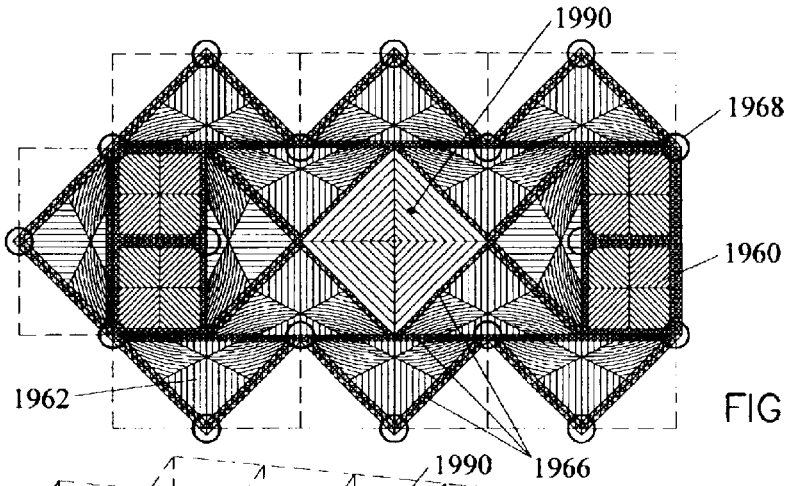
FIG. 77 is a roof plan view illustration of the structure of FIGS. 76A & 76B, FIGS. 78A and 78B are respective isometric and perspective illustrations of one embodiment of the structure of FIG. 77.
Figure 78A:
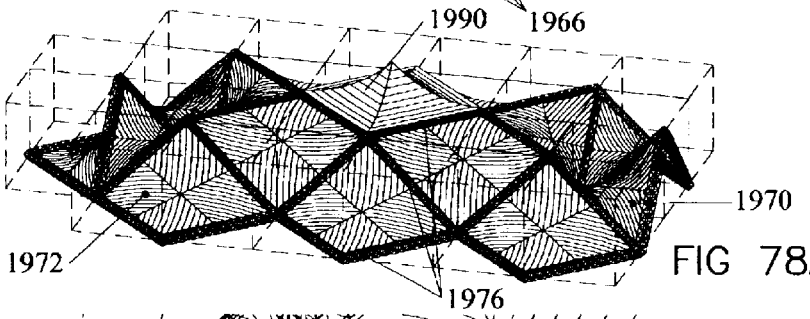
Figure 78B:
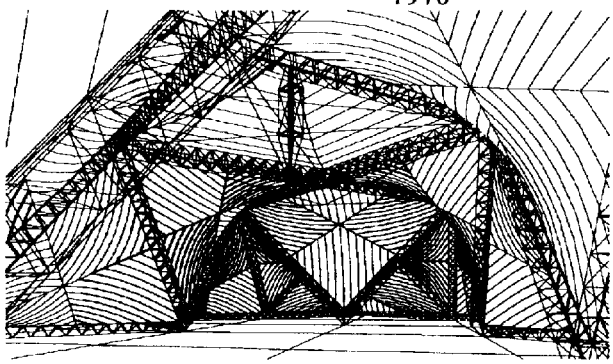

Reference is now made to FIG. 77, which is a roof plan view illustration of a structure comprising four type A saddle elements 1960 in two different orientations, thirteen type B saddle elements 1962 in seven different orientations as well as rigid structural elements 1966 Locations at which the structure touches a base surface are indicated by circles 1968 It is appreciated that the structure of FIG. 77 incorporates that of FIGS. 76A & 76B Reference is now made to FIGS. 78A and 78B, which are respective isometric and perspective illustrations of one embodiment of the structure of FIG. 77 wherein the type A saddle elements, here designated by reference numerals 1970 and the type B saddle elements 1972 are arranged in an octet structure and the rigid structural elements, here designated by reference numerals 1976, incorporate an octet truss structure.

Figure 79A:
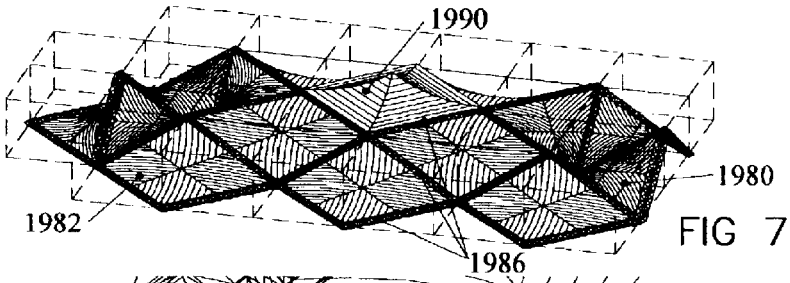
FIGS. 79A and 79B are respective isometric and perspective illustrations of another embodiment of the structure of FIG. 77.
Figure 79B:
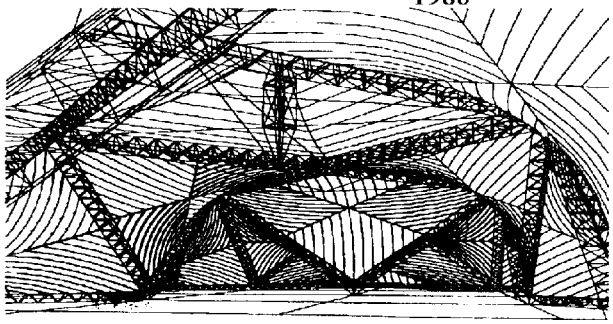
Figure 80A:
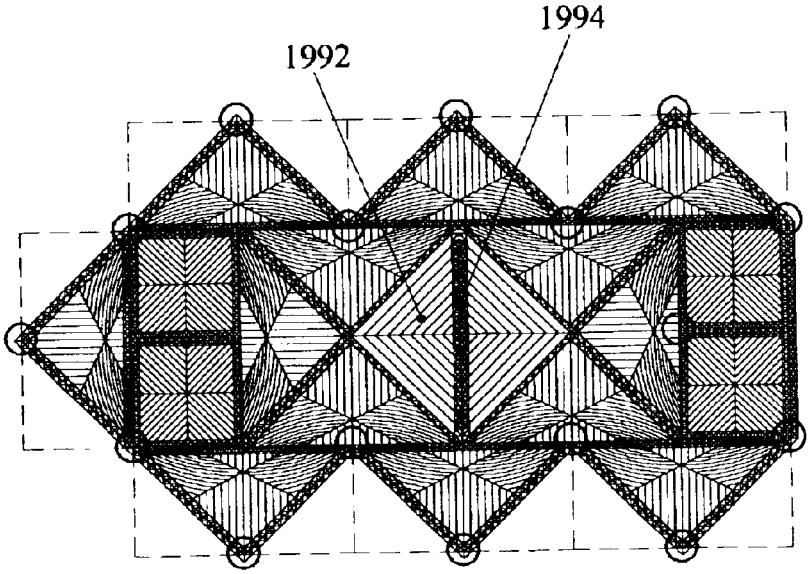
FIGS. 80A and 80B are, respectively, a roof plan view and an isometric illustration of an alternative realization of the structure of FIGS. 76A–79B.
Figure 80B:
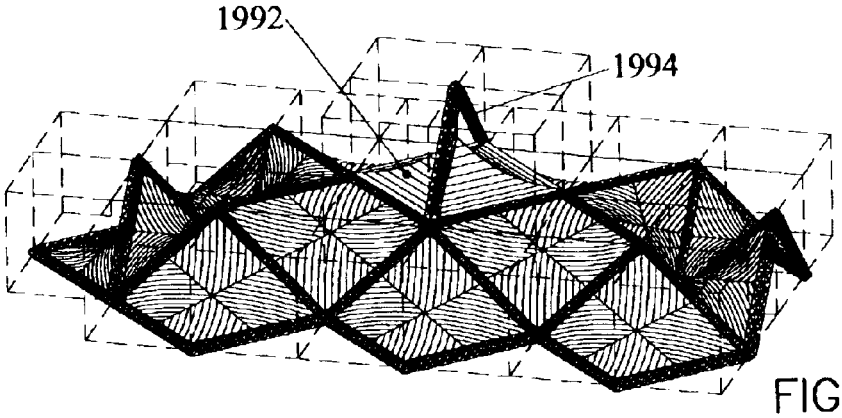
Figure 81:
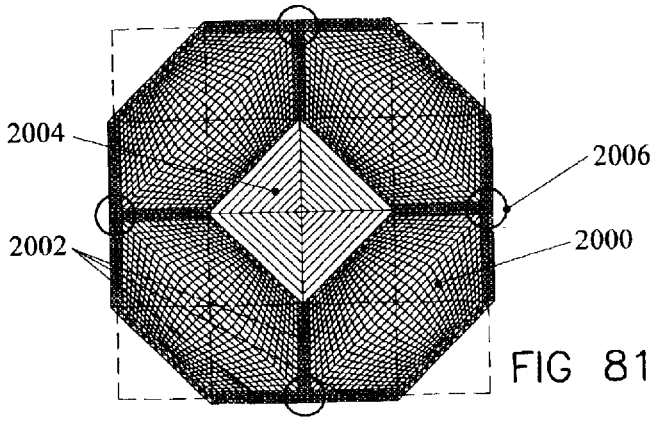
FIG. 81 is a roof plan view illustration of a structure constructed and operative in accordance with another preferred embodiment of the present invention.

Reference is now made to FIGS. 79A and 79B, which are respective isometric and perspective illustrations of another embodiment of the structure of FIG. 77 wherein the type A saddle elements, here designated by reference numerals 1980 and the type B saddle elements 1982 are arranged in an octet-like structure and the rigid structural elements, here designated by reference numerals 1986, incorporate an octet-like truss structure It is appreciated from a consideration of FIGS. 76A, 76B and 77–79B that a multilayer structure is provided including a pyramidal tensioned membrane 1990 which is supported by a tensioned cable system as described A relatively large free space is realized Reference is now made to FIGS. 80A and 80B, which are, respectively, a roof plain view and an isometric illustration of an alternative realization of the structure of FIGS. 76A–79B, wherein a pyramidal tensioned membrane 1992 is supported by a truss structure 1994, which may form part of an octet structure or octet-like structure and may incorporate an octet or octet-like truss structure Reference is now made to FIG. 81, which is a roof plan view illustration of a structure comprising four type F saddle elements 2000, in four different orientations, as well as rigid structural elements 2002 and a pyramidal tensioned membrane 2004 Locations at which the structure touches a base surface are indicated by circles 2006

Figure 82A:
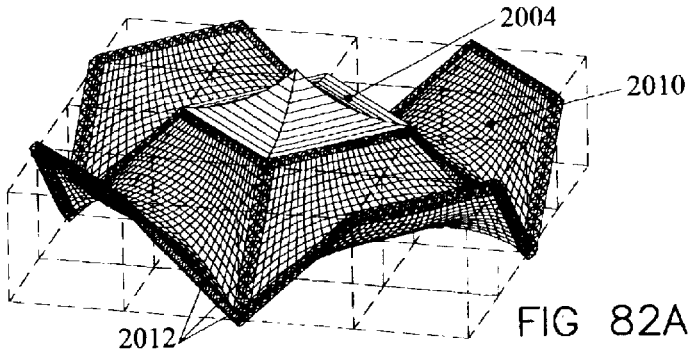
FIGS. 82A and 82B are respective isometric and perspective illustrations of one embodiment of the structure of FIG. 81, FIGS. 83A and 83B are respective isometric and perspective illustrations of another embodiment of the structure of FIG. 81.
Figure 82B:
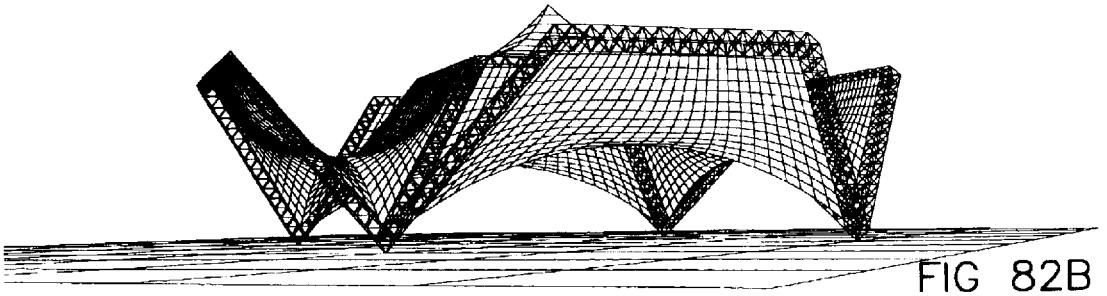
Figure 83A:
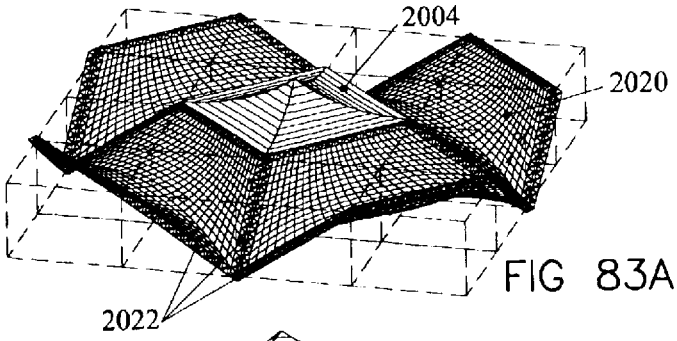
Figure 83B:
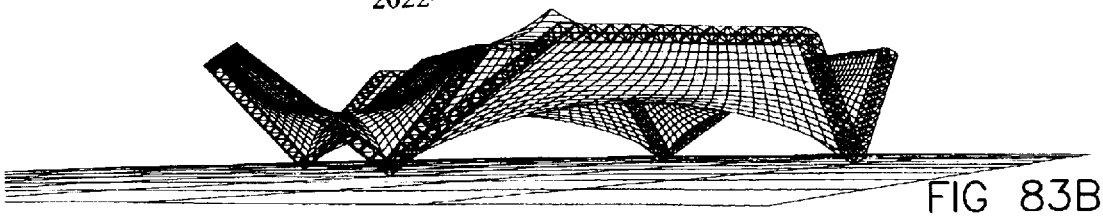

Reference is now made to FIGS. 82A and 82B, which are respective isometric and perspective illustrations of one embodiment of the structure of FIG. 81 wherein the type F saddle elements, here designated by reference numerals 2010, are arranged in an octet structure and the rigid structural elements, here designated by reference numerals 2012, incorporate an octet truss structure Reference is now made to FIGS. 83A and 83B, which are respective isometric and perspective illustrations of another embodiment of the structure of FIG. 81 wherein the type F saddle elements, here designated by reference numerals 2020, are arranged in an octet-like structure and the rigid structural elements, here designated by reference numerals 2022, incorporate an octet-like truss structure It is appreciated from a consideration of FIGS. 81 and 82A–83B that a multilayer structure is provided wherein a second layer is provided by pyramidal tensioned membrane 2004 which is supported by a tensioned cable system as described hereinabove. A relatively large free space is realized.

Figure 84:
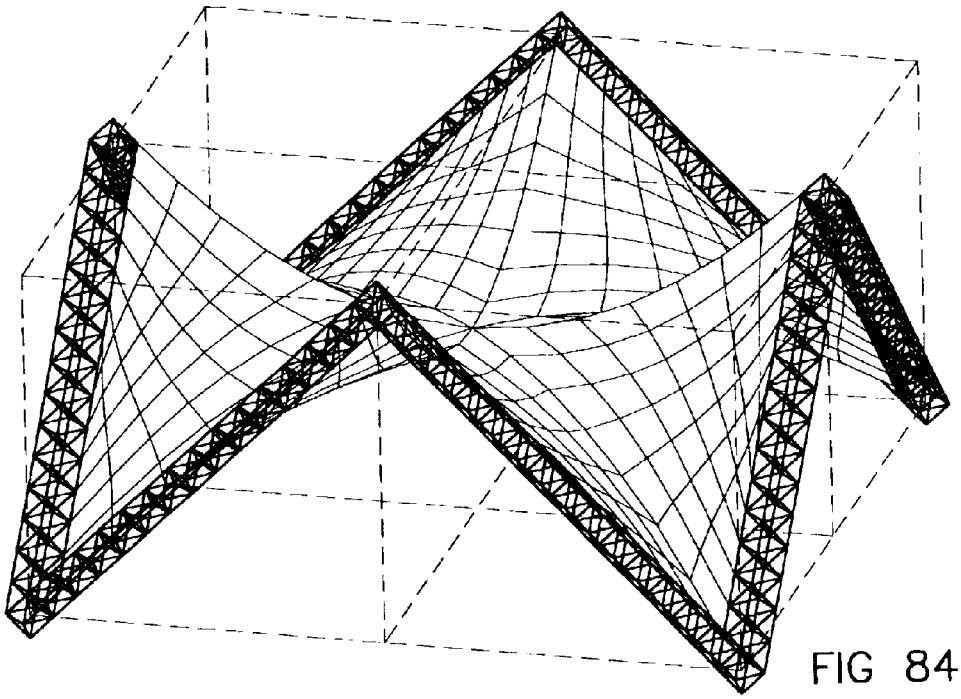
FIG. 84 is a simplified illustration of a structure constructed and operative in accordance with yet another preferred embodiment of the present invention.

Reference is now made to FIG. 84, which is a simplified illustration of a structure employing a single type D saddle element. Such an element is shown at reference numeral 622 in the structure of FIG. 13, albeit in a different orientation Reference is now made to FIG. 85, which illustrates a structure similar to that shown in FIG. 84 with the addition of a pair of crossed rigid structural elements 2100 The addition of cross rigid structural elements redefines the type D saddle element shown in FIG. 84 as a plurality of saddle elements of a different type.

Figure 86:
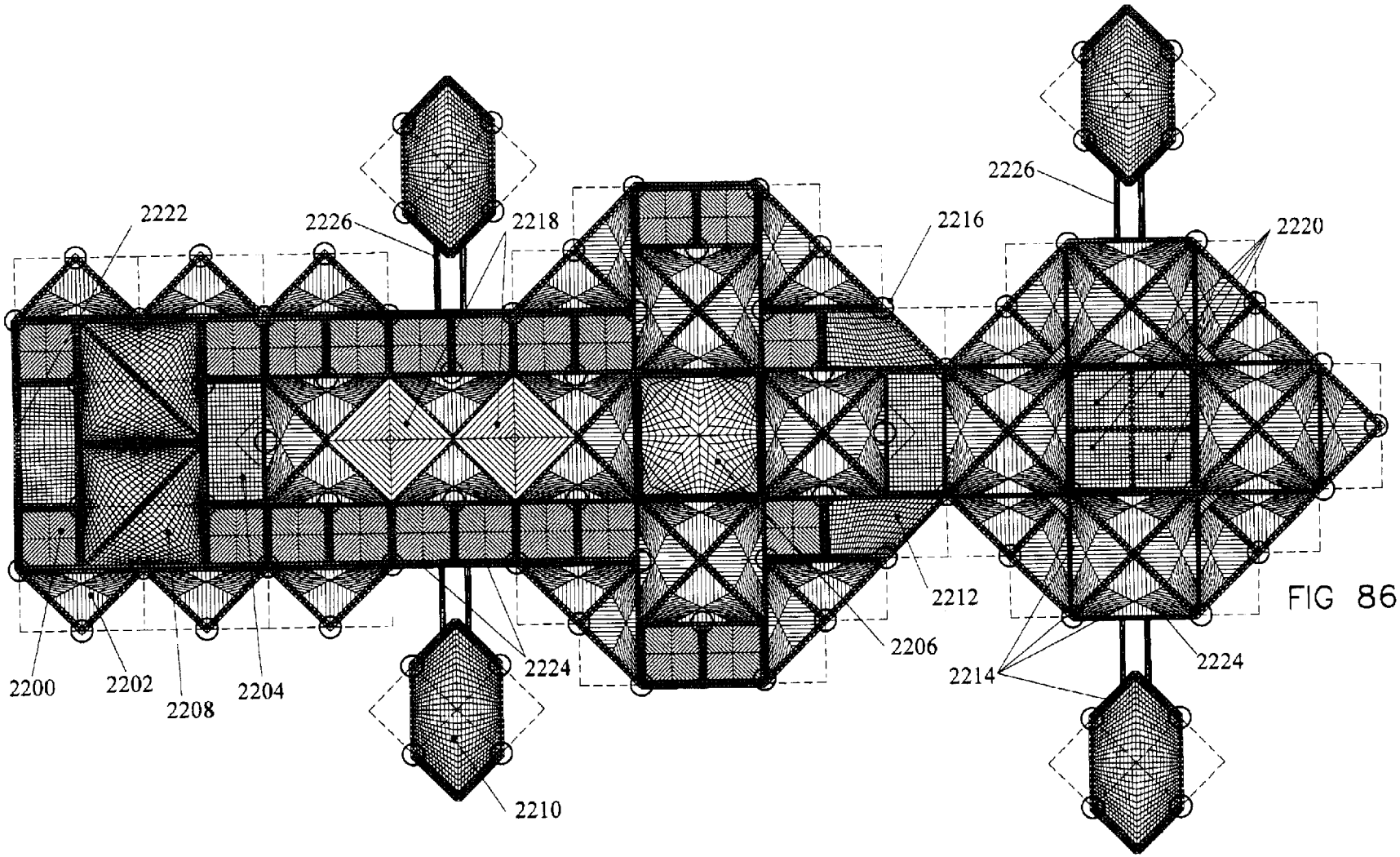
FIG. 86 is a roof plan view illustration of a structure constructed and operative in accordance with still another preferred embodiment of the present invention.

Reference is now made to FIG. 86, which is a roof plan view illustration of a structure comprising 22 type A saddle elements 2200 in two different orientations, 71 type B saddle elements 2202 in twelve different orientations, three type C saddle elements 2204 in two different orientations, one type D saddle element 2206, two type E saddle elements 2208 in two different orientations, four type F saddle elements 2210 in a single orientation and two type G saddle elements 2212 in two different orientations as well as rigid structural elements 2214 Locations at which the structure touches a base surface are indicated by circles 2216

Figure 85:
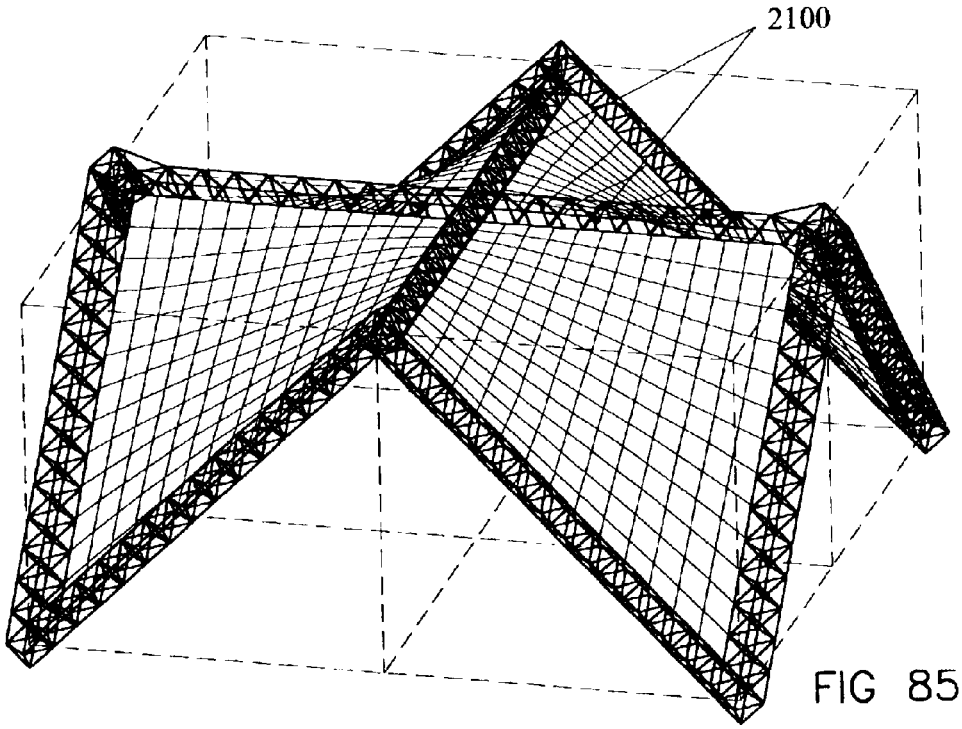
FIG. 85 illustrates a structure similar to that shown in FIG. 84.

The structure of FIG. 86 also includes first and second pyramidal tensioned membranes 2218, a structure of the type illustrated in FIG. 85, here designated by reference numeral 2220, and an arch 2222 The structure of FIG. 86 also preferably includes curtain walls 2224, typically formed of glass, which are at least partially supported by the rigid structural elements 2214 The structure of FIG. 86 is also characterized in that mechanical systems, such as air conditioning systems 2226, can be supported at least partially by the rigid structural elements 2214

Figure 87A:
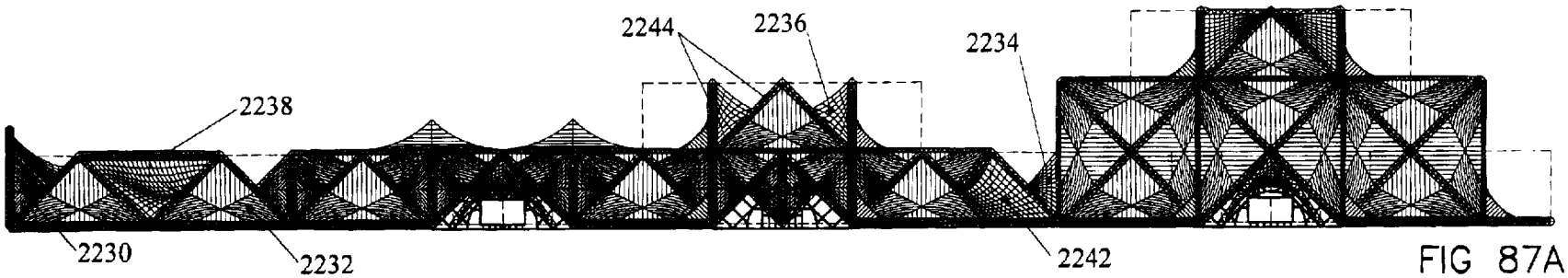
FIGS. 87A, 87B and 87C are three elevation view illustrations of one embodiment of the structure of FIG. 86.
Figure 87B:
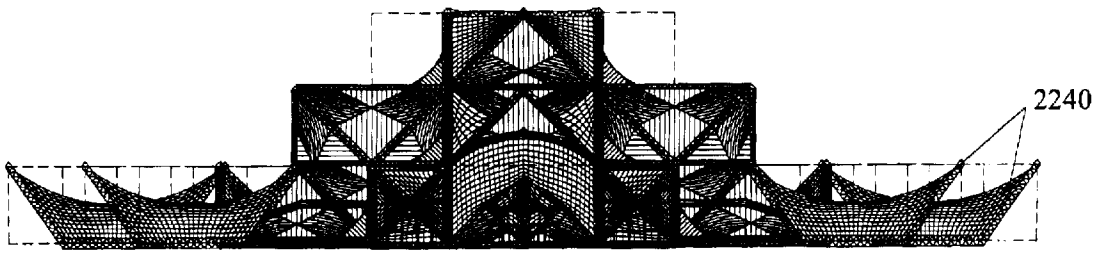
Figure 87C:
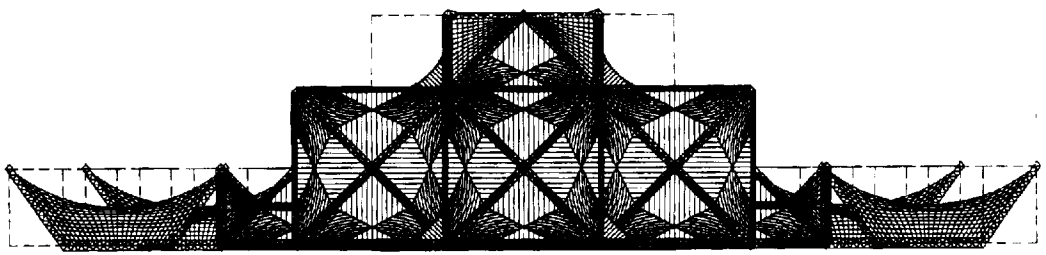
Figure 88:
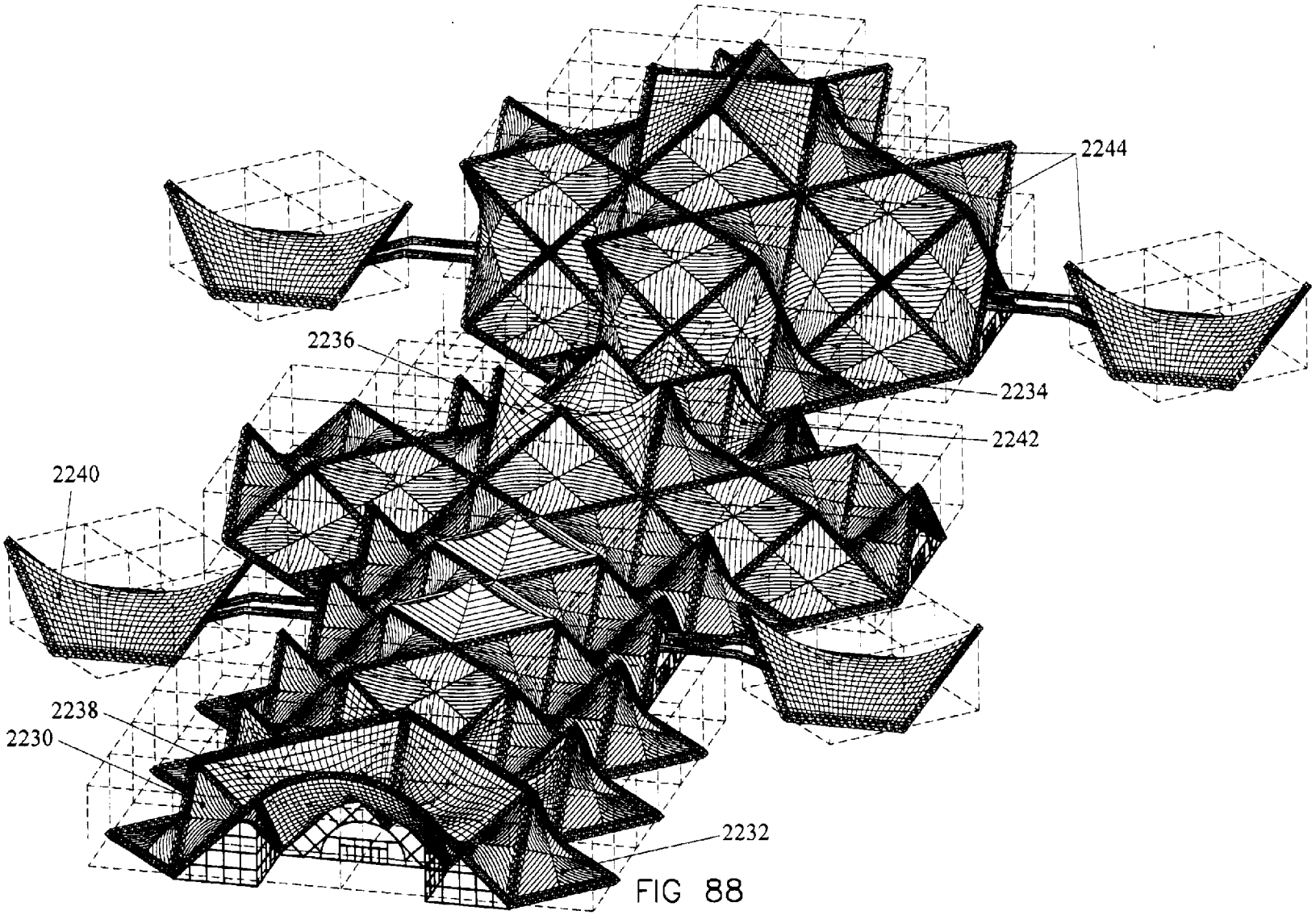
FIG. 88 is an isometric illustration of the embodiment of FIGS. 87A–87C, FIGS. 89A, 89B and 89C are three perspective illustrations of the embodiment of FIGS. 87A–88, FIGS. 90A, 90B and 90C are three elevation view illustrations of another embodiment of the structure of FIG. 86.
Figure 89A:
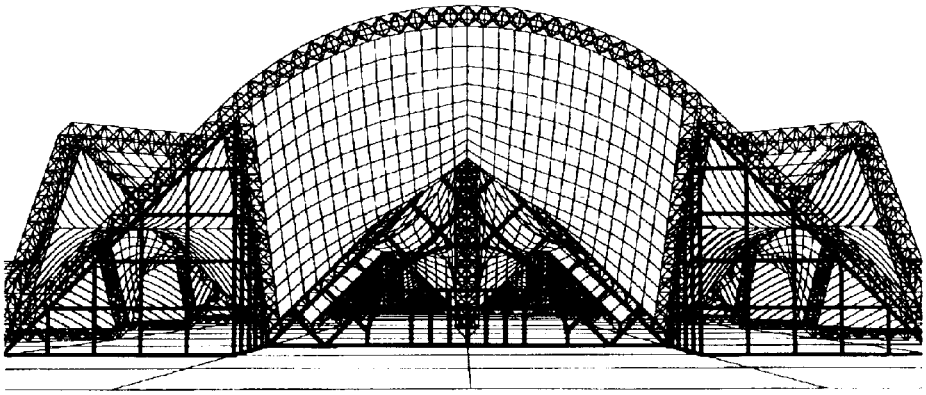
Figure 89B:
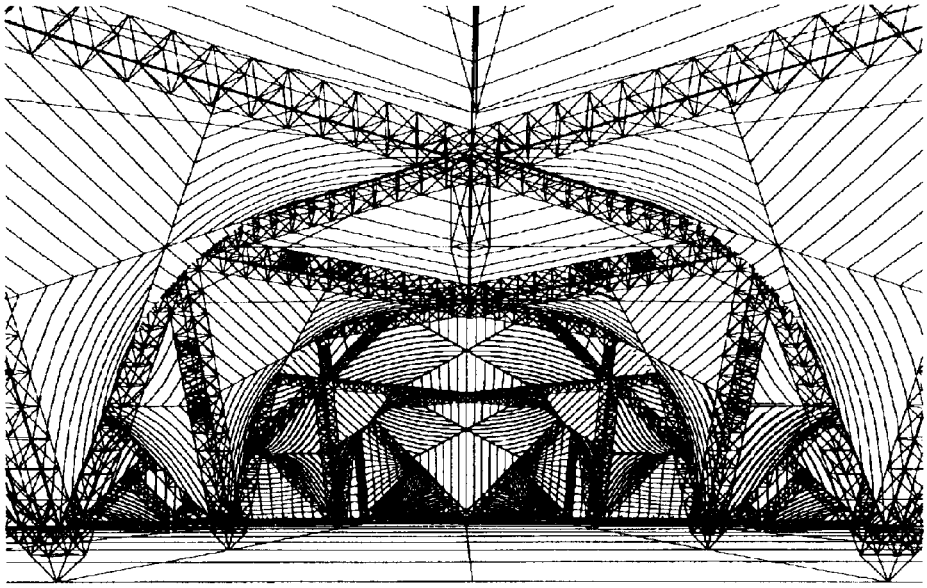
Figure 89C:
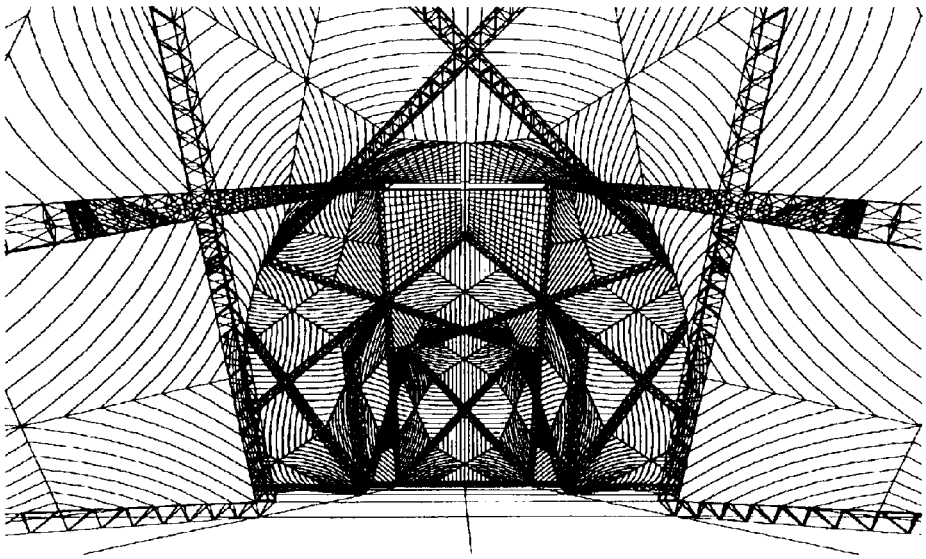
Figure 90A:
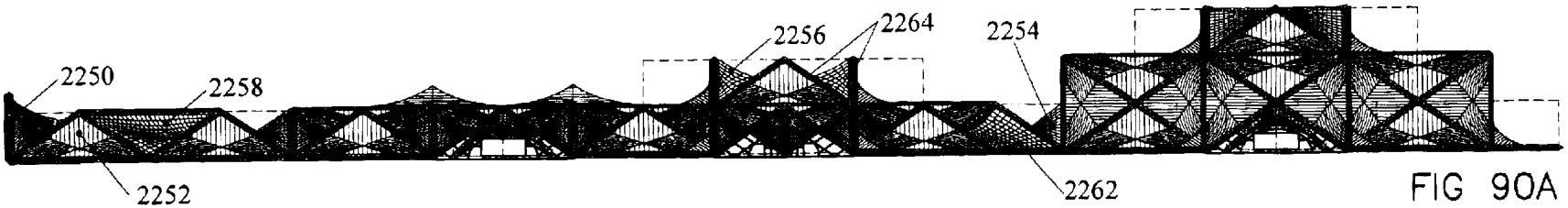
Figure 90B:
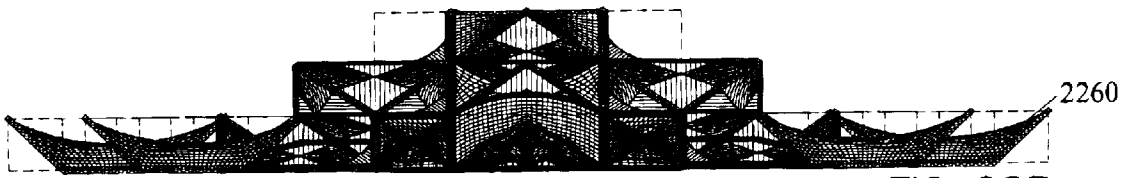
Figure 90C:
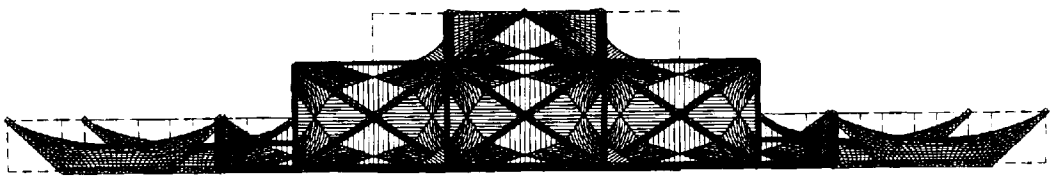
Figure 91:
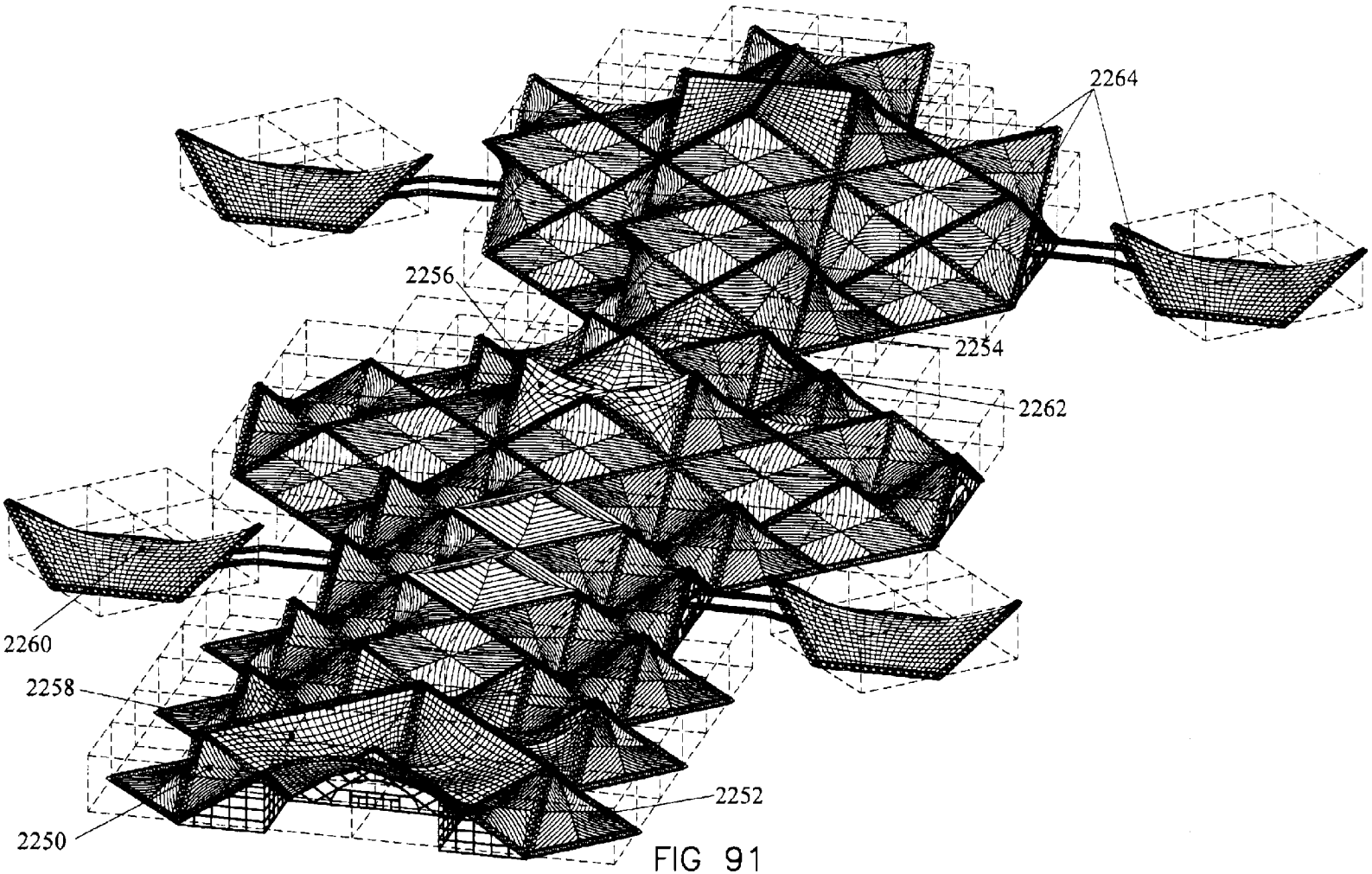
FIG. 91 is an isometric illustration of the embodiment of FIGS. 90A–90C, and FIGS. 92A, 92B and 92C are three perspective illustrations of the of embodiment of FIGS. 90A–91
Figure 92A:
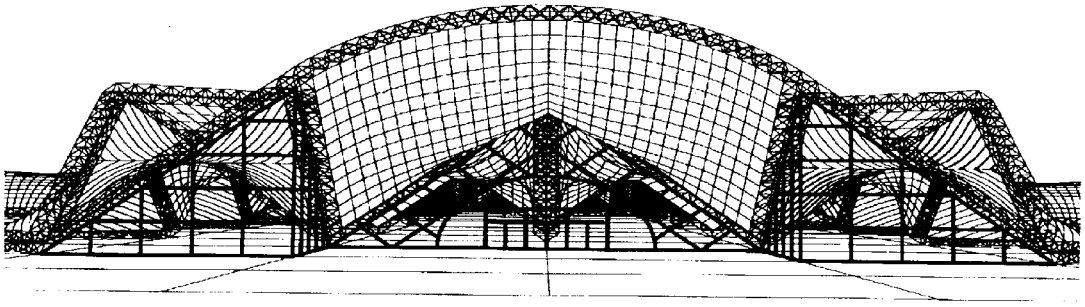
Figure 92B:
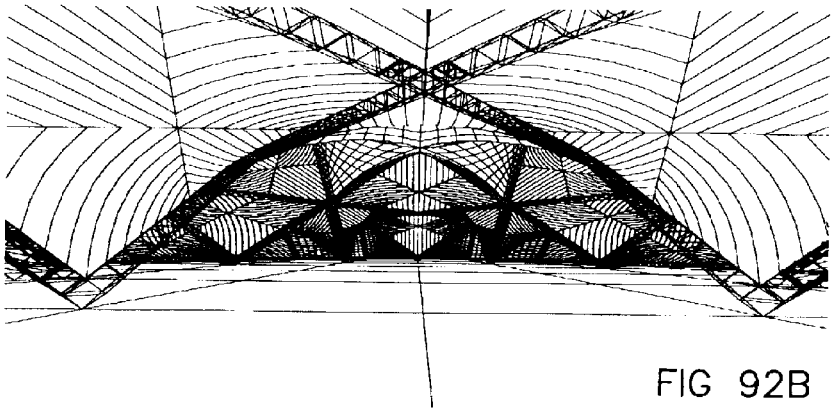
Figure 92C:
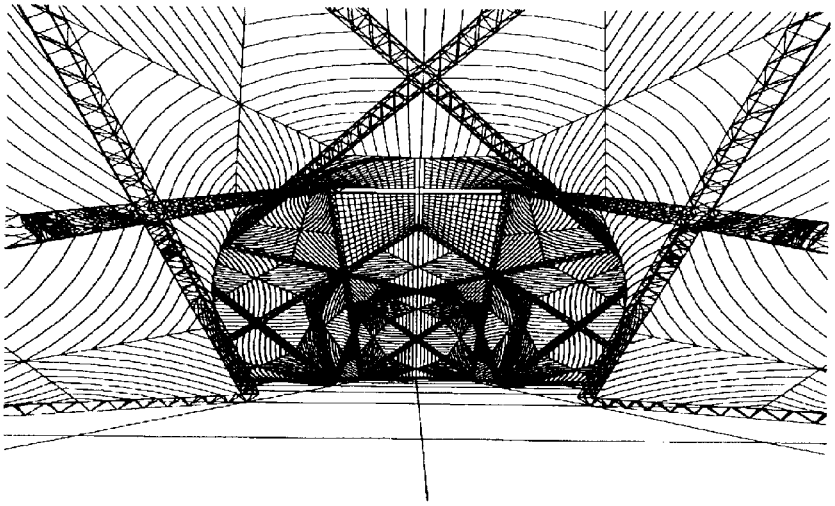

Reference is now made to FIGS. 87A, 87B and 87C, which are three elevation view illustrations of one embodiment of the structure of FIG. 86 Reference is also made to FIG. 88, which is an isometric illustration of the embodiment of FIGS. 87A–87C, and to FIGS. 89A, 89B and 89C, which are three perspective illustrations of the embodiment of FIGS. 87A–88 In FIGS. 87A–89C, the type A saddle elements 2230, the type B saddle elements 2232, the type C saddle elements 2234, the type D saddle element 2236, the type E saddle elements 2238, the type F saddle elements 2240 and the type G saddle elements 2242 are arranged in an octet structure and the rigid structural elements, here designated by reference numerals 2244, incorporate an octet truss structure Reference is now made to FIGS. 90A, 90B and 90C, which are three elevation view illustrations of another embodiment of the structure of FIG. 86 Reference is also made to FIG. 91, which is an isometric illustration of the embodiment of FIGS. 90A–90C, and to FIGS. 92A, 92B and 92C, which are three perspective illustrations of the embodiment of FIGS. 90A–91. In FIGS. 90A–92C, the type A saddle elements 2250, the type B saddle elements 2252, the type C saddle elements 2254, the type D saddle element 2256, the type E saddle elements 2258, the type F saddle elements 2260, and the type G saddle elements 2262 are arranged in an octet-like structure and the rigid structural elements, here designated by reference numerals 2264, incorporate an octets like truss structure It is appreciated that even though the rigid structural elements shown in the illustrated embodiments appear to be uncovered, they may be uncovered or covered by any suitable material It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

What is claimed is:

1. A building structure comprising:

at least one saddle clement defining at least four edges;

rigid structural elements extending along each of said edges of each of said at least one saddle element, said rigid structural elements being characterized in that they lie along diagonals of sides of an imaginary in rectangular parallelepiped forming part of an imaginary modular array of rectangular parallelepiped geometrical structures underlying said at least one saddle element and comprise octet-like trusses, at least two of which define at least one junction therebetween, which junction defines an octahedron-like lair of pyramids which is common to said at least two octet-like trusses.

2. A building structure according to claim 1 and wherein said rigid structural elements are further characterized in that they lie along diagonals which form part of an octet structure and wherein said rigid structural elements are further characterized in that they lie along diagonals of sides of an imaginary cube forming part of an imaginary modular array of cubic geometrical structures underlying said at least one saddle element and comprise octet trusses, at least two of which define at least one junction therebetween, which junction defines an octahedron which is common to said at least two octet trusses.

3. A building structure according to claim 1 and wherein said at least one saddle element includes at least two saddle elements of different types.

4. A building structure according to claim 1 and wherein said rigid structural elements comprise octet trusses.

5. A building structure according to claim 1 and also comprising at least one tensioned non-rigid structural element.

6. A building structure according to claim 2 and wherein said at least one saddle element includes at least two saddle elements of different types.

7. A building structure according to claim 2 and also comprising at least one tensioned non-rigid structural element.

8. A building structure according to claim 3 and wherein said rigid structural elements comprise octet trusses.

9. A building structure according to claim 3 and also comprising at least one tensioned non-rigid structural element.

10. A building structure comprising a plurality of saddle elements each defining at least four edges, rigid structural elements extending along said edges of each of said plurality of saddle elements, said rigid structural elements being characterized in that they lie along diagonals of sides of an imaginary rectangular parallelepiped forming part of an imaginary modular array of rectangular parallelepiped geometrical structures underlying said plurality of saddle elements, at least two of said rigid structural elements defining at least one junction therebetween, which junction defines an octahedron-like pair of pyramids which is common to at least two of said rigid structural elements.

11. A building structure according to claim 10 and wherein said rigid structural elements are further characterized in that they lie along diagonals which form part of an octet structure.

12. A building structure according to claim 10 and wherein said plurality of saddle elements includes at least two saddle elements of different types.

13. A building structure according to claim 10 and wherein said rigid structural elements comprise octet-like trusses.

14. A building structure according to claim 13 and wherein said rigid structural elements comprise octet trusses.

15. A building structure according to claim 10 and also comprising at least one tensioned non-rigid structural element.

16. A building structure according to claim 11 and wherein said at least one saddle element includes at least two saddle elements of different types.

17. A building structure according to claim 11 and wherein said rigid structural elements comprise octet trusses.

18. A building structure according to claim 11 and also comprising at least one tensioned non-rigid structural element.

19. A building structure according to claim 14 and also comprising at least one tensioned non-rigid structural element.

20. A building structure according to claim 4 and wherein said junction defines an octahedron which is common to said at least two octet trusses.

21. A building structure according to claim 14 and wherein said junction defines an octahedron which is common to said at least two octet trusses.

* * * * *